United States Patent [19]

Durant

[11] Patent Number: 4,774,799

[45] Date of Patent: Oct. 4, 1988

[54] BAG PACKING CENTER

[76] Inventor: Will G. Durant, 148 N. "C" St., Tustin, Calif. 92680

[21] Appl. No.: 845,971

[22] Filed: Jun. 6, 1986

[51] Int. Cl.[4] ..... B65B 3/17; B65B 35/50; B65B 43/16

[52] U.S. Cl. ..... 53/535; 53/247; 53/526; 53/530; 53/540; 53/571; 141/68; 414/62; 414/82

[58] Field of Search ..... 53/535, 540, 571, 247, 53/526, 530, 544; 100/151; 141/68; 414/62, 82, 907

[56] References Cited

U.S. PATENT DOCUMENTS

| | | | |
|---|---|---|---|
| 4,000,820 | 1/1977 | Kurk | 53/535 X |
| 4,024,965 | 5/1977 | Marth | 414/907 X |
| 4,159,947 | 7/1979 | Brooks | 100/151 X |
| 4,271,755 | 6/1981 | Kintgen | 414/62 X |
| 4,334,558 | 6/1982 | Durant | 53/571 X |
| 4,411,296 | 10/1983 | Durant | 53/571 X |

*Primary Examiner*—John Sipos
*Attorney, Agent, or Firm*—Leonard Tachner

[57] ABSTRACT

A bag packing center accepts either open mouth bags or valve bags, particulate material to be contained in such bags and pallets upon which filled bags are to be stacked in planned layer configurations and automatically produces full pallets of filled bags stacked in such layer configurations. The packing center utilizes a novel unitary frame structure suitable for transport on a flatbed truck or rail car without any substantial disassembly to permit portability and virtually immediate operation at the user's facility without the usual specialized design, engineering and structural interface problems of the prior art. Bag placing, filling, flattening, turning, layer forming and palletizing are all accomplished automatically in a unitary, two-level integrated structure uniquely designed to occupy a minimum amount of floor space.

10 Claims, 36 Drawing Sheets

BAG PACKING CENTER

BACKGROUND OF THE INVENTION

1. Field of the Invention

The present invention relates generally to a system for automatically placing, filling and palletizing open mouth bags or valve bags and more specifically, to a bag packing center that is capable of automatically pre-conditioning a particulate material product, automatically placing bags onto a filler for filling the bags with the aforementioned product to a desired weight with substantial accuracy, automatically transferring the filled bag from the filler, flattening and shaping the bag to de-aerate the bag and automatically stacking the filled bags on a pallet in an interlocking pattern; the packing center providing an integrated and assembled unit which may be integrally transported to the user's place of business and operated in a manner to minimize manpower, floor space, utilities and other associated services for maximum operating efficiency.

2. Prior Art

The general concent of providing an automatic device for filling bags such as valve bags with particulate material is not new. By way of illustration the following U.S. patents disclosed prior art automatic bag filling apparatus which operates to permit a user to place empty valve bags into the system and retrieve filled valve bags from the system.

U.S. Pat. No. 4,334,558, issued June 15, 1982 to Durant

U.S. Pat. No. 4,411,296, issued Oct. 25, 1983 to Durant

Furthermore, the concept of automatically palletizing valve bags is also not new. For example, U.S. Pat. No. 4,271,755 to Kintgen, et al discloses an automatic valve bag palletizing apparatus. Unfortunately, the valve bag filling and palletizing operations to this day remain distinctly separate and typically, the apparatus utilized for those separate operations are located in separate areas or rooms with conveyors spanning the distances between the apparatus. The user therefore is left with the problem of interface between the bag filler and the bag palletizer.

Typically, the bag filling apparatus manufacturer does not contemplate in his design that the user will have to palletize the filled bags generated by his system and merely leaves it to the user to appropriately transport the filled bags out of his system depending upon the user's specific requirements. Similarly, the manufacturer of the automatic palletizer does not typically contemplate the manner in which the user will bring the bags to the palletizer for appropriate transport and stacking. Thus, the user is left with the problem of integrating the two pieces of equipment and this integration problem is unique to the specific bag filling and palletizing systems that he has purchased. Furthermore, because neither of those systems is designed with the other in mind, often even if the user wishes to place the two systems in the same general proximity, it is difficult or impossible to do so because neither piece of equipment is designed with the space requirements of the other piece of equipment in mind. Thus, after a user has purchased an automatic valve bag placing and filling machine from one manufacturer and an automatic valve bag palletizer from another manufacturer and each such device has been shipped from the respective manufacturers to the user's place of business, the user must then incur the cost and time required to have an appropriate interface device designed, fabricated and assembled on his premises in order to facilitate the interaction between the respective pieces of equipment.

In addition to the above-mentioned difficulties, even after the appropriate interface mechanism has been designed, fabricated and assembled, the total system may not be the most efficient because as previously noted neither piece of equipment has been designed with the other in mind. Thus for example, the rate of placing and filling bags with particulate material may not be suitable for the rate at which such bags can be palletized by the other piece of equipment. Of course, there may also be occasions when the rate at which filled valve bags can be palletized by the automatic palletizer cannot accommodate the rate at which the bags are placed and filled by the other piece of equipment. In fact, the primary focus of automatic palletizer development during the last several years has been toward attaining greater rates of speed. Major advances have been made in developing units capable of handling for example, 25 to 40 bags per minute. To accommodate such a high rate palletizer, the user must have bags fed from conveyor lines which receive bags from several costly fillers ganged together to produce bags at the appropriate rates to match the palletizer.

Furthermore, a new picture has come into focus concerning the development of bag fillers. More specifically, with dramatic increases in the value of certain commodities filled into valve bags, particularly certain chemicals, the emphasis has changed for the filling operation from speed to accuracy. The development of electronic scales on the filler apparatus has made it possible to monitor weight at the filler. Electronic filling operations tend to further reduce filling rates due to the inherent electronic operation such as auto tare and checkweight feedback to control weight accuracies. Thus, it will be apparent that recent advances in the respective arts of palletizing and filling apparatus have in effect, further exacerbated the difficulties confronted by the user in regard to inherent incompatibilities between the bag placing and filling machinery on the one hand and the bag palletizing machinery on the other.

As a result, there has been a long-felt need in the marketplace for a fully automatic integrated packaging machine capable of filling bags to close weight tolerances and palletizing such bags at substantially the same rates at which they are filled. Furthermore, there has been a concurrent need for such a device which minimizes the cost of labor and which minimizes the facility space requirements to accommodate such a packing machine. There has also been a long-felt need for a packing machine which accepts empty open mouth bags or valve bags and produces fully and appropriately palletized filled bags and which is portable and thus can be transported to one or more of a user's locations as a unitary, integral unit requiring little or no special assembly at the user's location and which entirely obviates the aforementioned prior art requirement for unique transport mechanisms to integrate separate bag filling and bag palletizing machines.

With the recent demand for weight accuracy, the problems of proper product supply have also become vital to the successful filing operation. Unfortunately, this area also has been left to the user's discretion with only vague recommendation by the equipment supplier. The result is often non-existent or hapazard interlocks, feed controls and other devices between the infeed hopper and the filler and this often results in poor packer performance and difficulty in product changes, clean-out and the like irrespective of the capabilities of the filler and palletizer portions of the system. Thus, the aforementioned long-felt needs not adequately addressed by the prior art extend to the need to overcome the traditional barrier that has long existed between the packer product inlet and the user's supply bin outlet.

SUMMARY OF THE INVENTION

The bag packing center of the present invention provides a novel and unique approach to solving the aforementioned problems by providing the end user with a single machine which can utilize three ingredients, namely, particulate product, open mouth or valve bags and pallets and automatically properly mix the three ingredients in a sensible and systemized manner to provide a filled pallet of accurately filled bags with a minimum of user installation cost and floor space. More importantly, the present invention combines total system integration, engineering and unitary structure without requiring the user to contribute any of these. The concept of the bag packing center of the present invention is based upon the need to solve the problems outlined above.

Essentially, the packing center of the present invention performs the following principal tasks: It properly controls the incoming product and conditions the product as required to gain maximum packer performance; it properly dispenses and places the opening of the bags onto a filler spout automatically, taking precaution not to allow the filler to start if a bag is not properly placed on the filling spout; it properly fills the bag to the best attainable accuracy, settling product if necessary and transferring the filled bags from the filler in such a manner as to adequately close the bag valve; it properly flattens and shapes the bag to de-aerate the bag and distribute the product in the bag for optimum palletizing; and it then properly stacks the filled bags on a pallet in an interlocking pattern to enable the filled pallets to be transported and stored effectively. These tasks are accomplished in the present invention in a manner to allow the user to minimize manpower, floor space, utilizes, services and plant engineering and to enable him to maximize the efficiency of the operation.

The invention comprises an integrated system of basic elements including structural framework, mechanical apparatus, electrical equipment, electronic control, fluid power and vacuum systems. These basic systems are integrated so that the fully assembled machine may be tested and operated as an integral unit by the manufacturer to check out system function capability and then shipped on a commercial carrier with no significant dismantling or disassembly. Economy of structure, wiring, fluid power and controls are built into the machine without significant duplication or overlap thereby substantially reducing the costs of manufacture and assembly as compared to the closest functional capability in the separate units of the prior art. Furthermore, the components of the invention are homogeneous and properly integrated rendering it easier for the user to become familiar with the system and making it less expensive to service and maintain.

One of the principal advantageous features of the present invention is the common machine structure which is designed to properly support and house all major elements of the invention in a rectangularly shaped volume capable of being loaded and transported by truck or rail without any substantial disassembly. The structure is designed to provide structural support of all major elements including products infeed hopper, bag placer, bag flattener, conveyors, and palletizing functions such as turning, pushing, layer forming and elevating. This integral structure greatly simplifies installation as only the common unitary structure need be properly positioned in the user's selected location. The proper relationship of all major components is built into the common structure and fixed at the time of manufacture thereby eliminating field installation and alignment problems. The frame of the invention is sufficiently rigid to be lifted onto or from a truck or rail car in one single unit without disconnection of piping or wiring. With suitable wheels the invention may be easily configured for portability after installation.

OBJECTS OF THE INVENTION

It is therefore a principal object of the present invention to provide a novel integral packing center which substantially reduces or entirely overcomes the noted disadvantages of the prior art.

It is an additional object of the present invention to provide a bag packing center which combines a placing and packaging system, a flattening system, a layer forming system, and a palletizing system in a common, unitary frame capable of being loaded and transported by truck or rail without any substantial disassembly.

It is still an additional object of the present invention to provide an integrated unitary frame bag packing center which controls and conditions a particulate material product to be packed, which dispenses and places the opening of bags onto a filler automatically, which fills the bag to a preselected weight with a substantial degree of accuracy, which transfers the filled bag from the filler, which flattens and shapes the bag to de-aerate the bag and distribute the product in the bag for optimum palletizing, and which stacks the filled bags on a pallet in an interlocking pattern to enable the filled pallets to be transported and stored effectively.

It is still an additional object of the present invention to provide an integrated valve bag placer, filler and palletizer in which the transportation of the filled bags from the filling section to the palletizing section of the apparatus is done with a minimum of required space and which properly seals the valve, flattens and shpaes the bag, check weighs the bag and orients the bag for interlock stacking on the pallet.

It is still an additional object of the present invention to provide an integrated valve bag placer, filler and palletizer in which electrical and fluid power control for the entire machine are completely and fully integrated to properly monitor and sequence all operations of the unit including required interlocks, overrides and safety functions.

BRIEF DESCRIPTION OF THE DRAWINGS

The aforementioned objects and advantages of the present invention as well as additional objects and advantages thereof will be more fully understood hereinafter as a result of a detailed description of a preferred embodiment when taken in conjunction with the following drawings in which.

DETAILED DESCRIPTION OF A PREFERRED EMBODIMENT

Figure 1:
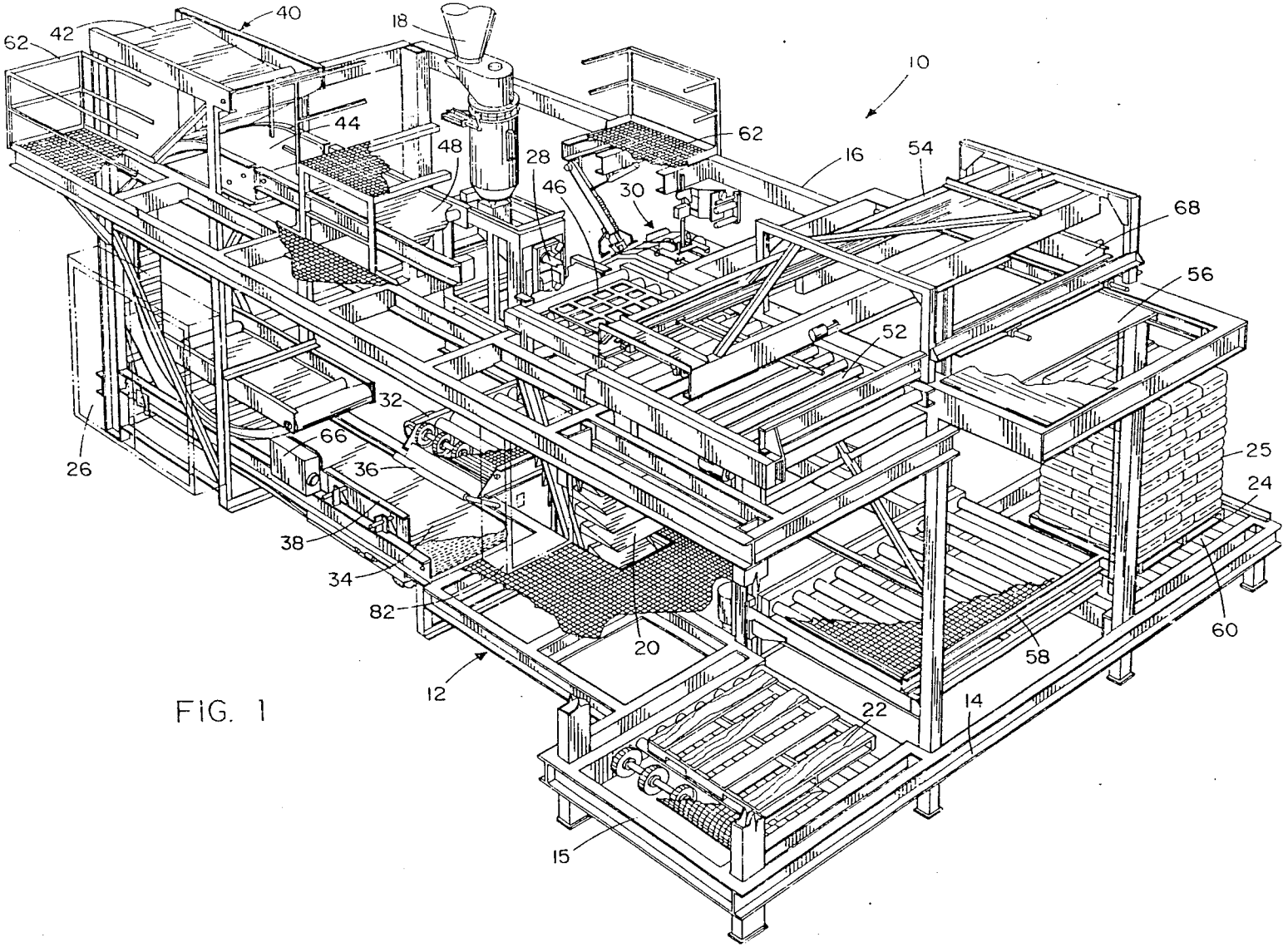
FIG. 1 is a first three dimensional view of the packing center of the present invention.

Referring simultaneously to FIGS. 1 through 5, it will be seen that the packing center 10 of the present invention is comprised of a substantially unitary structure 12 which for purposes of discussion only may be viewed as having a lower section 14 and an upper section 16, keeping in mind that those two sections are integrally connected to one another. This common machine structure is designed to properly support and house all of the major components in a substantially rectangular shaped packing center system and of being loaded and transported by truck or rail without any substantial disassembly. This structure is designed to incorporate the support of all major elements of the present invention to be described hereinafter. This is a particularly important feature of the present invention which is believed to be entirely novel and unobvious over the prior art and which greatly simplifies installation as only the common structure need be properly positioned at the user's facilities. The proper physical relationship of all major components is built into the common structure thus eliminating field installation and alignment problems.

The frame is sufficiently rigid to be lifted onto or from a truck or rail car in one single unit without disconnection of piping or wiring. The basic frame is designed to maintain the overall structure of the machine within dimensions of 12 feet in width, 12 feet in height and 25 feet in length. This size enables the total machine to be transported in one piece on a common carrier. Of the various components subsystems and assemblies of the present invention illustrated herein, only the pallet infeed device and pallet exit conveyor to be described hereinafter, are considered to be beyond the basic perimeters of the aforementioned frame structure dimensions and each of these devices is readily assembled to the unit with a minimum of inconvenience after the unit has been delivered to the user's facility. Although the present invention may be configured for use with either open mouth bags or valve bags, the description herein concentrates on a typical valve bag center configuration for purposes of explanation only.

The overall automated characteristics of the packing center of the present invention results in a system which may be thought of as having three basic input materials which are combined by the packing center described herein in a unique way to result in a single output product of these materials. More specifically, the present invention may be deemed to be a unitary structure which accepts a particulate material to be bagged and palletized, a plurality of empty valve bags used to contain the aforementioned particulate material and a plurality of empty pallets upon which filled valve bags are to be stacked in a predetermined efficient pattern. It is in fact such filled pallets upon which a plurality of valve bags filled with the aforementioned particulate matter are stacked in a predetermined pattern that constitutes the output of the packing center of the present invention.

The principle components of the packing center 10 of the present invention which function for receiving the above-noted input commodities comprise the product infeed hopper 18 which receives the particulate material, the bag magazine apparatus 20 which receives empty valve bags and the pallet infeed device 15 which receives empty pallets 22 (although empty pallets could be positioned directly on pallet elevator 58).

Various types of infeed hoppers may be employed in the packing center of the present invention. Typically, such infeed hoppers include offset venting hoppers, vibratory feed hoppers and screw-type feed hoppers. The basic function of any such feed hopper is to adequately and consistently feed product to the filling device. The proper selection of feed hopper is made once the proper filling device is selected. The selection of feed hopper and filling device is a function of the type of products to be packaged. Products may range from extremely fine powders to coarse granulated materials with variations in characteristic within this category range. Feed hopper 18 is connected to a filling machine 28.

The filling machine may also be any of a number of alternative configurations depending upon the characteristics of the particulate material. By way of example, the filling machine may be an impeller-type, an air-type, an auger-type or a hybrid configuration which utilizes characteristics of two or more of the aforementioned types.

The impeller-type feed unit is a bag filling machine utilizing a rotary vane-type impeller feed pump. The feed pump pumps dry products through a tube onto which the valve bag has been placed. The product is delivered from the product infeed hopper 18 to an impeller hopper and when the impeller feed unit is started, the impeller rotates and drives the product tangentially from the perimeter of the impeller casing. The product is accelerated and driven through a circular tube into a valve bag at rates of flow up to 15–20 pounds per second.

An air pressure feed unit consists of a pressure tank and fluidizing pad and a low pressure air pump in order to provide high volume, low pressure air to drive the product into a valve bag. The product is admitted through a butterfly-type valve located at the top of an air pressure tank. When the packer is started the butterfly valve closes and the blower pressure air is admitted into the product chamber. The flow tube device is opened, enabling product to be driven into the bag through a flow tube extending from the pressure chamber to a filling spout of the machine. The product flows into the bag at rates of up to 20 pounds per second.

An auger-type feed system employs a feed auter mounted in an agitator-type hopper. The product is admitted to the agitator hopper from a surge bin located just above the hopper and mounted to the packing center frame. The auger is motor driven through a V-belt drive. The auger packer typically is capable of feeding products at rates of up to 10 pounds per second depending primarily upon product bulk density and valve size.

Each of the aforemention alternative filling machines is compatible with the packing center 10 of the present invention, each may be used with the same bag chair and bag spouting sensor and each is capable of being equipped with an electronic weight scale for detecting the weight of the bag as it is being filled. The weigh scale incorporates a standard cut-off device which may be in the form of a magnetic reed switch or load cell. Signals from the cut-off device are transmitted to the packing center controller contained within an electrical control consolke 82 shown in phantom in FIG. 1. Console 82 also includes the control logic of the entire packing center. Console 26 house the three-hase motor starters and fusing required to operate the motors of the invention.

Empty valve bags used for containing the particulate material are placed in respective stacks on a plurality of magazine shelves 70 of a bag magazine apparatus 20. Bag magazine apparatus 20 is one component of a bag spouting apparatus 30 the components of which are seen best in FIGS. 2 and 3. Bag spouting apparatus 30 comprises, in addition to the bag magazine 20, a bag transfer carriage 72, a bag presenter table 74, and a picker-spouter apparatus 76. A plurality of empty valve bags is placed on each of the plurality of magazine shelves 70 comprising the bag magazine apparatus 20. One such bag is transferred by a bag transfer carriage 72 from a respective magazine shelf 70 to the bag presenter table 74 where it is properly positioned for the picker-spouter apparatus 76. The latter apparatus picks up each such individual valve bag while simultaneously opening the valve and places the valve portion of the bag onto a spout 84 of the filling machine 28.

Comparable valve bag spouting apparatus are disclosed in U.S. Pat. Nos. 4,334,558, issued June 15, 1982, and 4,411,296, issued Oct. 25, 1983. Even more relevant is the bag spouting apparatus disclosed in U.S. patent application Ser. Nos. 661,900, filed Oct. 17, 1984, and that disclosed in Ser. No. 824,801, filed Jan. 31, 1986, both of which applications are hereby incorporated herein by reference thereby obviating the requirement for a more detailed description of the bag spouting apparatus 30 of the present invention.

For the purposes of completeness it should be understood that the valve bag spouting apparatus is mounted in the packing center framework above and slightly in front of the filling machine apparatus 28. The bag spouting apparatus is capable of picking bags from the presentation area of the bag presenter table and withdrawing the bags while opening the valves simultaneously. Picker spouter apparatus 76 spouts a new bag onto the filler spout 84 of filling machine 28 each time the filler discharges a filled bag.

In the event of a mis-spout as detected by the bag spouting or clamp sensor, the picker spouter apparatus 76 is capable of withdrawing the improperly spouted bag from the filling spout 84 and rotating it 90 degrees to deposit the unsatisfactory bag along side the filling machine. Upon successfully depositing the improperly spouted bag into a container or designated area, the spouter rotates back to its original position and continues to pick up new bags and spout the bags on the filler spout. This process may be continued until the bag is properly spouted or an alarm within the central controller console 26 shuts the machine down due to a bag mis-spout. A bag takeaway conveyor 32 can be used as an alternative for withdrawing mis-spouted empty bags by simply reversing its normal conveyor direction, thus clearing a mis-spouted bag.

The bag presenter table 74 receives a bag from the bag magazine 20 and properly positions the bag and registers the top of the bag to enable the picker spouter apparatus 76 to pick up the bag and open the valve in a precise manner during each cycle. Bag transfer carriage 72 moves cyclically between the bag presenter table 74 and the bag magazine 20. It moves to the magazine side and extends down and lifts one bag per cycle from the top magazine shelf 70. The bag transfer carriage 72 then transfers back and deposits the bag on a set of vacuum cups protruding upward through slots 75 on the bag presenter table 74. These vacuum cups grab the bag from beneath and transfer the bag from essentially a horizontal position down to a 45 degree tilted position where the bag is released. The bag comes to rest against a selectively deployable fence plate squaring the bag along its leading edge. The bag is also pushed laterally by an index push bar located at the base of the presenter table. The index push bar pushes the head of the bag over to the exact center line of the picker spouter apparatus 76 and of the filling machine spout 84. By virtue of these two actions the bags are properly positioned for the spouting mechanism 76 to pick up the bag and open the valve ready for spouting. Once the bag is picked and retained by the caliper grippers of the picker-spouter, the indexer push bar retracts and the deployable fence rotates to clear the path for spouting the bag.

As each bag is spouted, the bag transfer carriage 72 transfers a new bag from the magazine and positions it ready for spouting on the bag presenter table 74. The magazine shelves 70 are located within the basic packing machine structure 12. The trays are mounted on two continuous chains located within the structure. Ten usable trays are loaded with valve bags to be spouted. Bags are conveyed to the uppermost level where a microswitch stops the top tray in proper position. Bags are removed one at a time from the uppermost tray. When the uppermost tray is empty the main controller signals the magazine 20 to advance to the next shelf. The preceding shelf moves upward and over the top of sprockets to begin a return path down the back side of the magazine while another tray, properly loaded, is brought into position for the bag transfer carriage to continue its function. Bags are loaded onto the lower shelves by the machine operator as required. Alarm signals are provided in the main machine control or console 82 to signal the machine operator of a low bag condition and also of a no bag condition. A no bag condition will automatically halt further fillings.

The third fundamental input component of the packing center of the present invention consists of empty pallets 22. In its most basic and austere configuration, the packing center of the present invention may be configured to receive the empty pallets by their manual placement directly on a pallet elevator 58, the detailed structure and operation of which will be discussed hereinafter. However, in the configuration of the present invention illustrated in FIGS. 1 through 5, a pallet infeed conveyor device 15 is included in the configuration. Pallet infeed conveyor device 15 is adapted to transfer an empty pallet 22 onto the elevator 58 whenever the system is in operation and the elevator is otherwise not unoccupied by another empty pallet or partially filled pallet such as when a filled pallet 24 loaded with a plurality of filled bags 25 in a predetermined pattern to be described hereinafter has been off loaded onto a full pallet exit conveyor 60.

Figure 2:
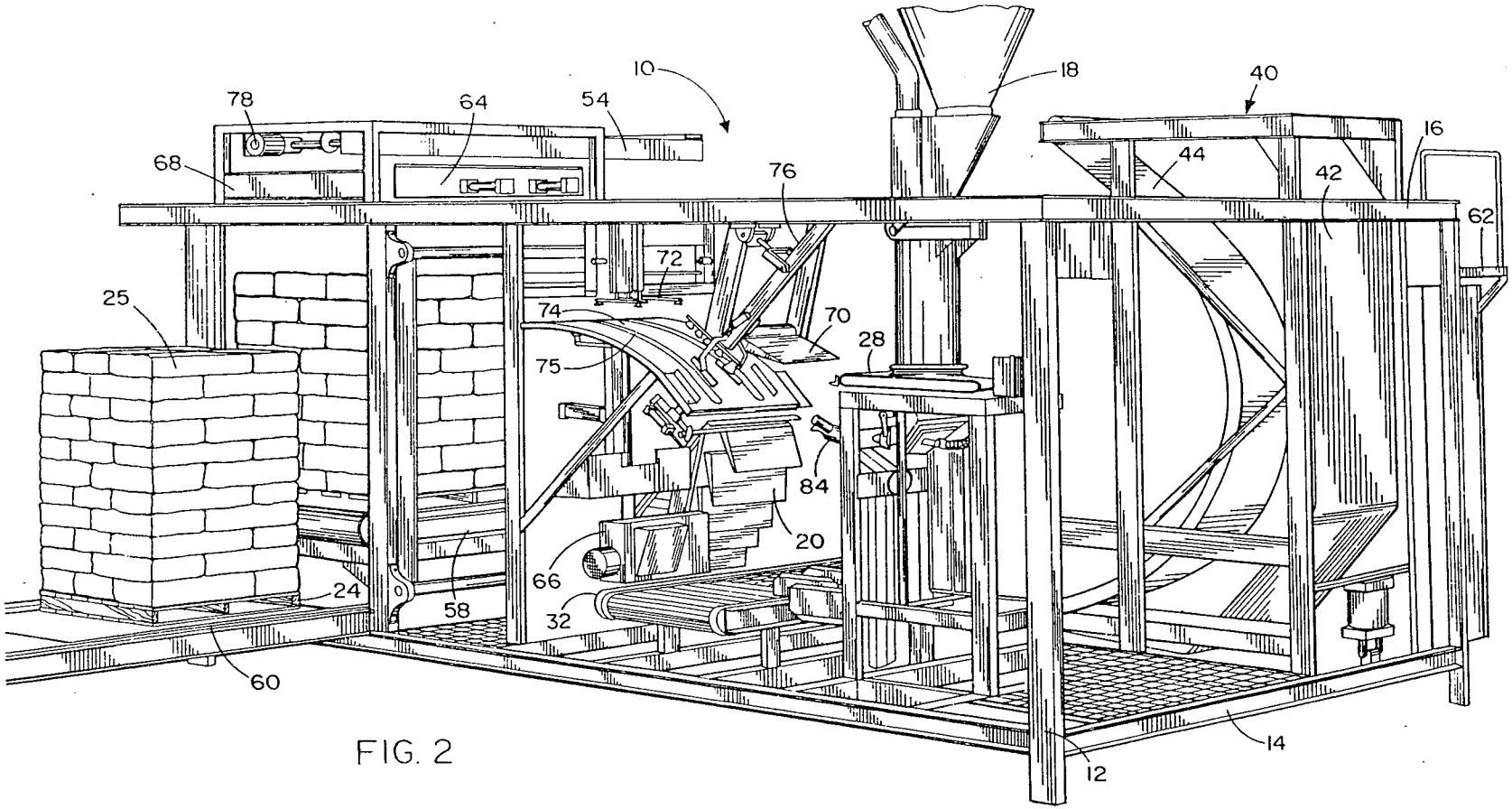
FIG. 2 is second three dimensional view of the packing center of the present invention.
Figure 4:
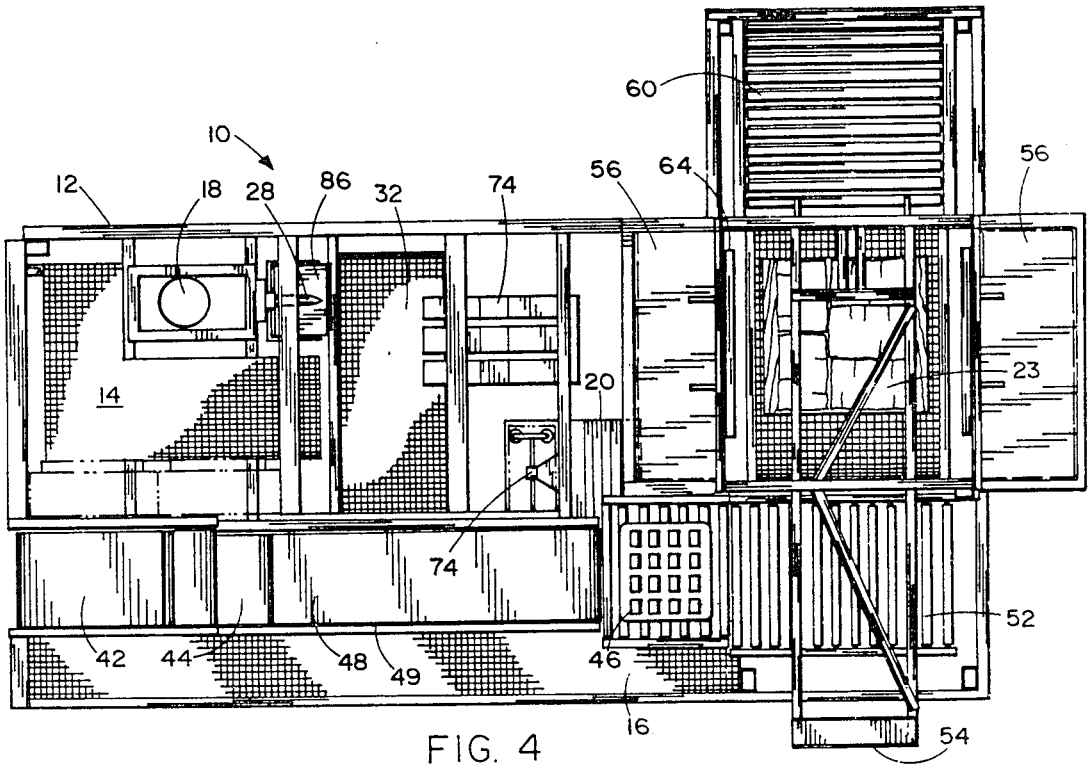
FIG. 4 is a top view of the packing center of the present invention.

The ultimate output product of the present invention is the fully loaded pallet 24 seen best in FIGS. 1 and 2. In its most basic and austere configuration the present invention can readily be operated by utilizing manual removal means such as a fork lift truck to remove the filled pallets 24 directly from the elevator 58 after the last layer of filled bags has been stacked onto the pallet. However, in the optional configuration of FIGS. 1 and 2, the packing center 10 of the present invention is shown with a full pallet exit conveyor 60 which is designed to receive the filled pallets 24 from the conveyor means of elevator 58 after the desired number of bags has been placed on the pallet.

As each bag is being filled, it sits on a bag chair 86 which is provided with a pneumatically actuated air cylinder designed to deposit the filled bag onto a take away conveyor 32 when the contents of the bag have reached the desired weight. Take away conveyor 32 transports the filled bags away from the bag filling portion of the packing center and towards the perimeter of the packing center where the bag is flipped by a flip roller 36 onto a lower lift belt 34 of a bag lift apparatus 40. A flipover stop 38 is provided to prevent the bag from landing anywhere other than on the lower lift belt 34.

A bag lift apparatus 40 is designed to transport each filled bag from the lower section 14 of the packing center to the upper section 16. It accomplishes this by utilizing an outside lift belt 42 and an inside lift belt 44 which frictionally engage the bag on both sides while flattening the bag and conveying it through a 180 degree turn up onto the upper section 16 as will be described hereinafter in more detail. Each filled bag brought up to the upper section 16 by the bag lift apparatus 40 is transported to a bag turner apparatus 46 by means of a bridge conveyor 48. Every bag exiting the flattener apparatus to be brought up to the bag turner apparatus 46, is in the same configuration with the valve of each bag located at approximately the same relative position. Guides 49 on the bridge conveyor 48 more accurately position the bag prior to its entering the turning device.

The function of the bag turner apparatus is to reorient each bag so that a selected pattern of bag orientation for each layer of bags may be obtained in conjunction with a layer forming conveyor 52. The bag turner apparatus utilizes a bag turner grid 50 to accomplish this. It will be seen hereinafter that bag turner grid 50 is capable of combined vertical linear and rotational motion whereby to turn each bag up to 270 degrees in 90 degrees increments to form each layer as hereinafter described. After the bag turner apparatus 46 has reoriented each bag, each such bag is conveyed to the layer forming conveyor 52.

Typically, each layer of bags placed on a pallet comprises five bags. Each such layer may be deemed to be formed of two halves. The first half comprises three bags in parallel contiguous relationship, three abreast and the second half comprises two bags in sequential serial relationship, two abreast. After each such half of a layer is formed on the layer forming conveyor 52, a bag pusher apparatus 54 moves the respective layer halves onto a pair of load plates 56. Many other patterns such as 3, 4, 6, 7, and 9 bags are also possible.

In addition to orienting the bags as described with respect to the layer halves, it is also typically considered advantageous to orient the bags individually so that the valve opening faces another bag as opposed to facing an exterior perimeter of the layer whereby to provide secure closing of the valves while the filled pallets are in storage or transport.

After each full layer of bags is formed on the load plates 56, the load plates are laterally displaced from one another to provide an opening much like bombay doors whereby the respective bag layers may be deposited on an elevator 58 which is positioned by the packing center immediately below the load plates. The bag pusher apparatus 54 cooperates with a layer squaring apparatus 64, including a bag stop 68, in order to hold the layers in an appropriate position during the opening of the load plates and to keep the bag layers properly formed while layers are deposited onto the pallet positioned on the elevator 58.

Figure 3:
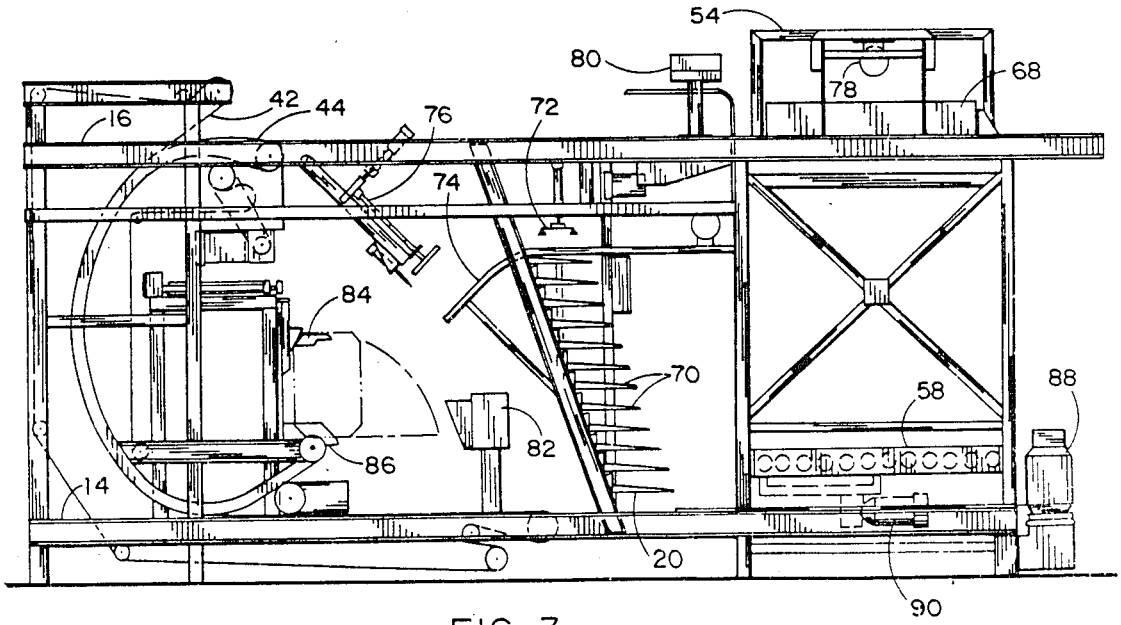
FIG. 3 is a front plan view of the packing center of the present invention.
Figure 27:
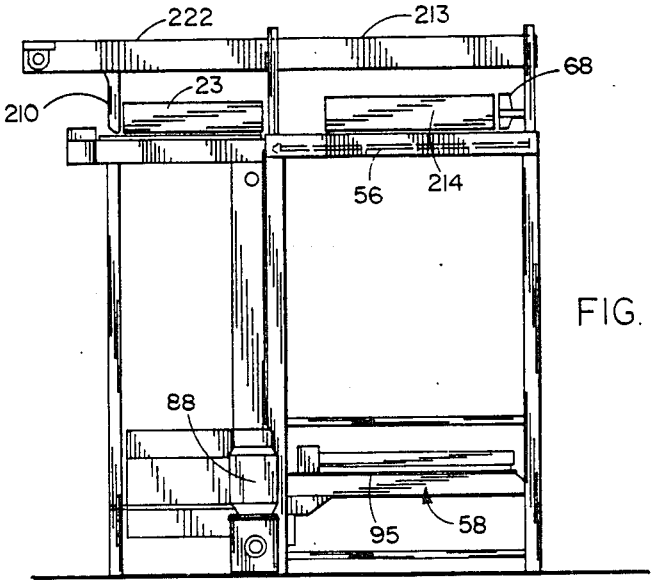
FIG. 27 is a side view of the packing center illustrating the respective positions of the bag pusher apparatus, the layer squaring apparatus and the pallet elevator.

As seen best in FIG. 3 the packing center 10 of the present invention is provided with a plurality of control consoles including an upper section control console 80 and a lower section control console 82, both of which are provided with status indicators and control switches to permit manual initiation and termination of packing center operation as well as allowing an operator to monitor the status of the entire packing center from one location. In the event of a problem which requires manual intervention, the packing center 10 provides a plurality of walkways on both the lower section 14 and upper section 16, such walkways comprising an access structure 62 which in combination provide an operator access to virturally every moving part of the invention. It will also be noted in FIGS. 1 and 2 that the packing center 10 is provided with a plurality of dust collector devices 66 which comprise conventional suction devices and which are provided at critical locations throughout the packing center where the full bags are most likely to generate dust as they are dropped from one belt onto another or from a device onto a belt. For example, one such dust collector 66 is positioned adjacent the takeaway conveyor 32 in front of the filling machine 28 whereby to collect dust generated when the bag chair dumps the filled bag onto the takeaway conveyor. Another such dust collector 66 seen in FIG. 1 is positioned adjacent the lower lift belt 34 where the bag is flipped from the takeaway conveyor 32 onto the lower lift belt 34 and is therefore likely to generate some level of dust.

Figure 7:
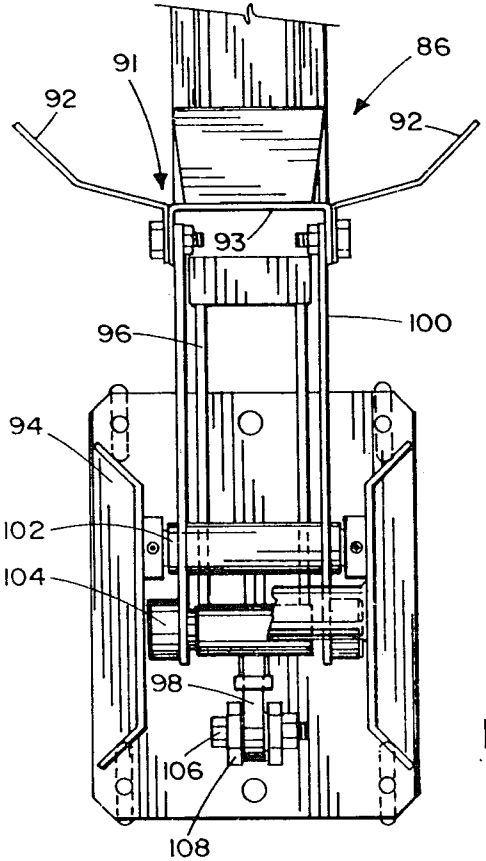
FIGS. 6 and 7 are front and side views, respectively, of the bag chair portion of the present invention.
Figure 6:
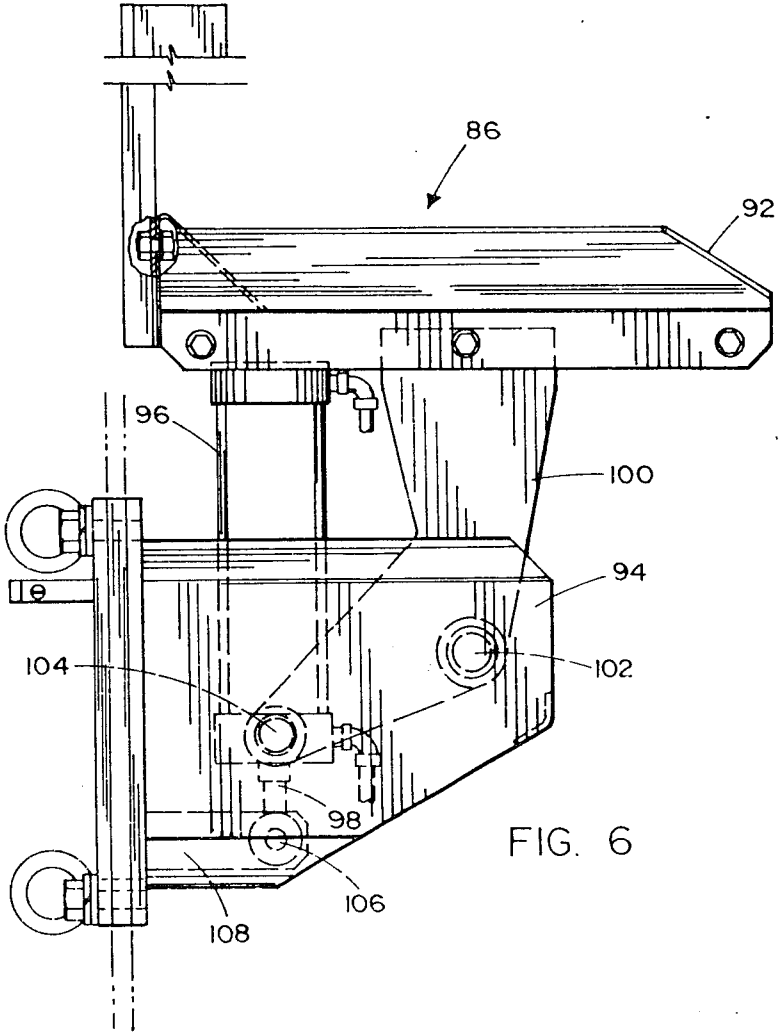

Reference will now be made to FIGS. 6 through 34 as the individual components and subsystems of the present invention are described in sufficient detail to enable those having skill in the relevant art to make and use the present invention. More specifically, referring first to FIGS. 6 and 7, it will be seen that the bag chair 86 of the present invention preferably comprises a bag support member or cradle 91 formed of a pair of side panels 92 and a bottom panel 93. Bag support member 91 is rotatably connected to an enclosure 94 by means of a tilt member 100 which is affixed to the enclosure 94 along the swing axis 102. Bag chair 86 is provided with a pneumatic actuator 96, the extendable rod 98 of which is affixed at an actuator attachment point 106 to an actuator attachment member 108. The lower end of tilt member 100 is secured to the body of the pneumatic actuator 96 along an actuator yoke axis 104. When the actuator 96 is activated extending the rod 98, the actuator body moves upwardly, pulling the lower end of tilt member 100 along with it at the actuator yoke axis 104 thereby rotating the tilt member 100 and the cradle 91 around the swing axis 102. Clearly a filled bag, vertically positioned within the bag support member 91, would upon rotation of the bag chair 86 as described above, be dumped from the bag chair in the desired manner in order to withdraw the filled bag from the spout 84 of the filling machine 28 and deposit same onto the take-away conveyor 32 as previously described. More specifically, upon completion of the filling operation, each filled bag is automatically ejected from the filling spout onto the bag take-away conveyor as a result of the tilting of bag support member or cradle 91 which tips to a 45 degree forward incline position upon receipt of a proper signal from the machine controller contained within console 26. A time delay signal returns the bag chair 86 to its normal position. Returning bag chair 86 to its normal position signals the automatic valve bag placer to place the ensuing bag onto the filling spout of the filling machine.

Figure 8:
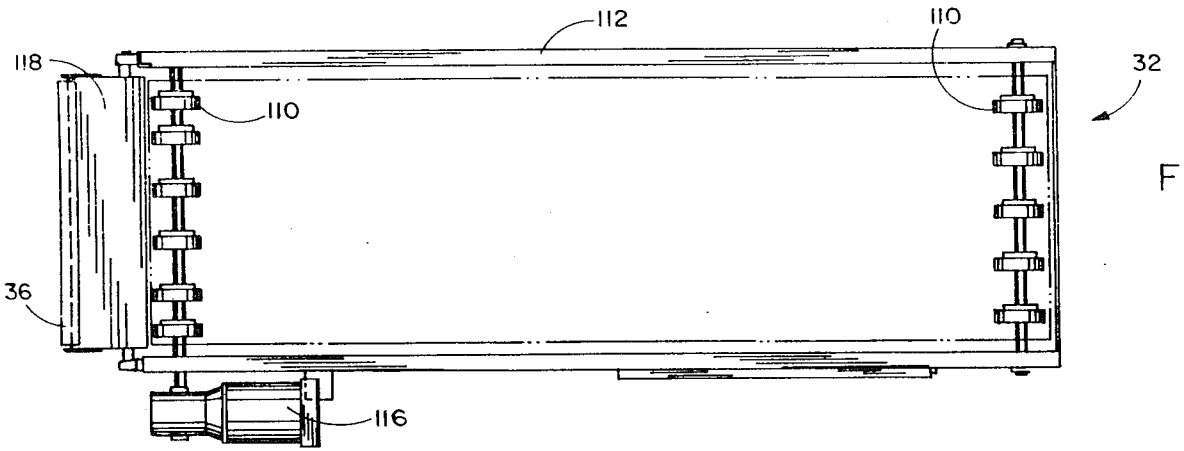
FIGS. 8, 9 and 10 are top front and sides views, respectively, of the take-away conveyor portion of the present invention.
Figure 9:
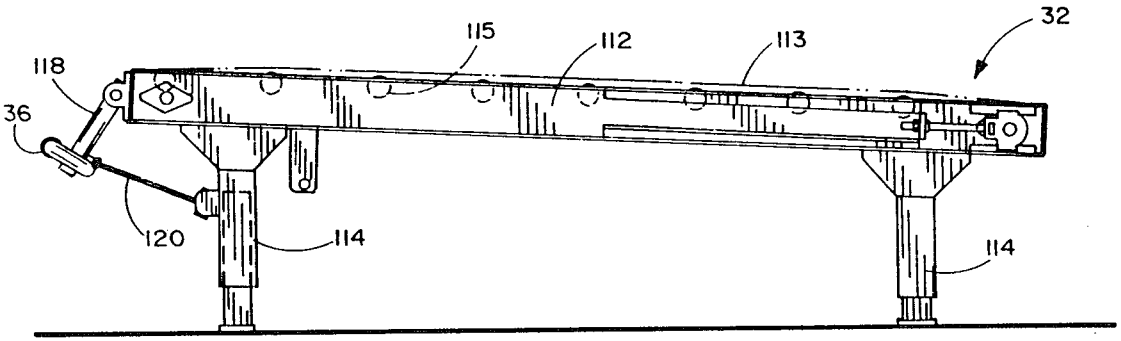
Figure 10:
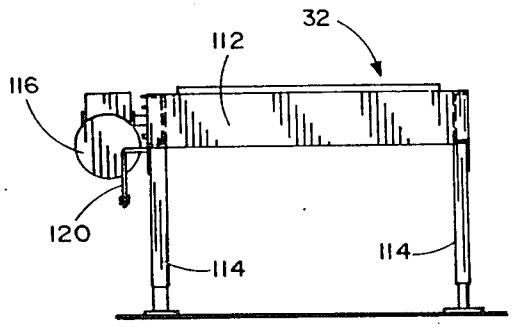

Reference will now be made to FIGS. 8, 9 and 10 which illustrate the detailed structure of the bag take-away conveyor 32. This conveyor consists of a wire mesh belt conveyor running transversely in front of the filling machine 28. The purpose of the bag take-away conveyor is to transfer the filled bags from the discharge area of the filling apparatus to the lower lift belt 34 of the bag lift apparatus 40. Thus, take-away conveyor 32 comprises a rectangular frame 112 having a plurality of roller bars 115, the first and last of which include a plurality of wire mesh sprocket wheels 110. Wire mesh sprocket wheels are designed to mate with and propel a wire mesh belt conveyor 113 in response to a motor drive and gear box 116 in a conventional manner. Frame 112 is supported by four adjustable legs 114 to permit variation in the height and angular position of the take-away conveyor to accommodate bags of various lengths and still provide the proper discharge fall distance required for proper discharge of the filled bag. The end of the take-away conveyor closest to the motor drive and gear box 116 is provided with a flip extender member 118 held in adjustable position relative to the conveyor by an extended rod 120 and provided with a flip transfer roll 36 which is designed to force each filled bag to make a 180 degree flip over as well as a 90 degree line direction change to enter the lower lift belt 34 with the valve end of the bag trailing and the bag entering in its relatively flat orientation.

Figure 12:
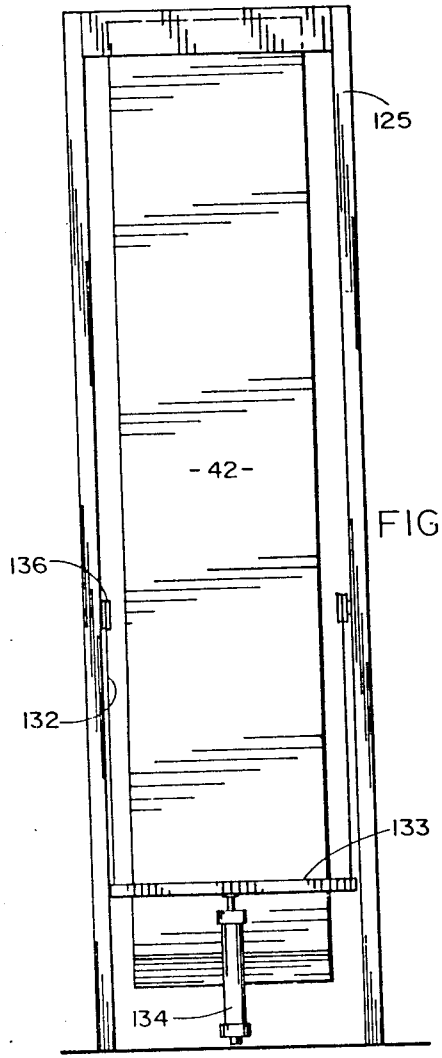
FIGS. 11 and 12 are front and side views, respectively, of the bag lift portion of the present invention.
Figure 11:
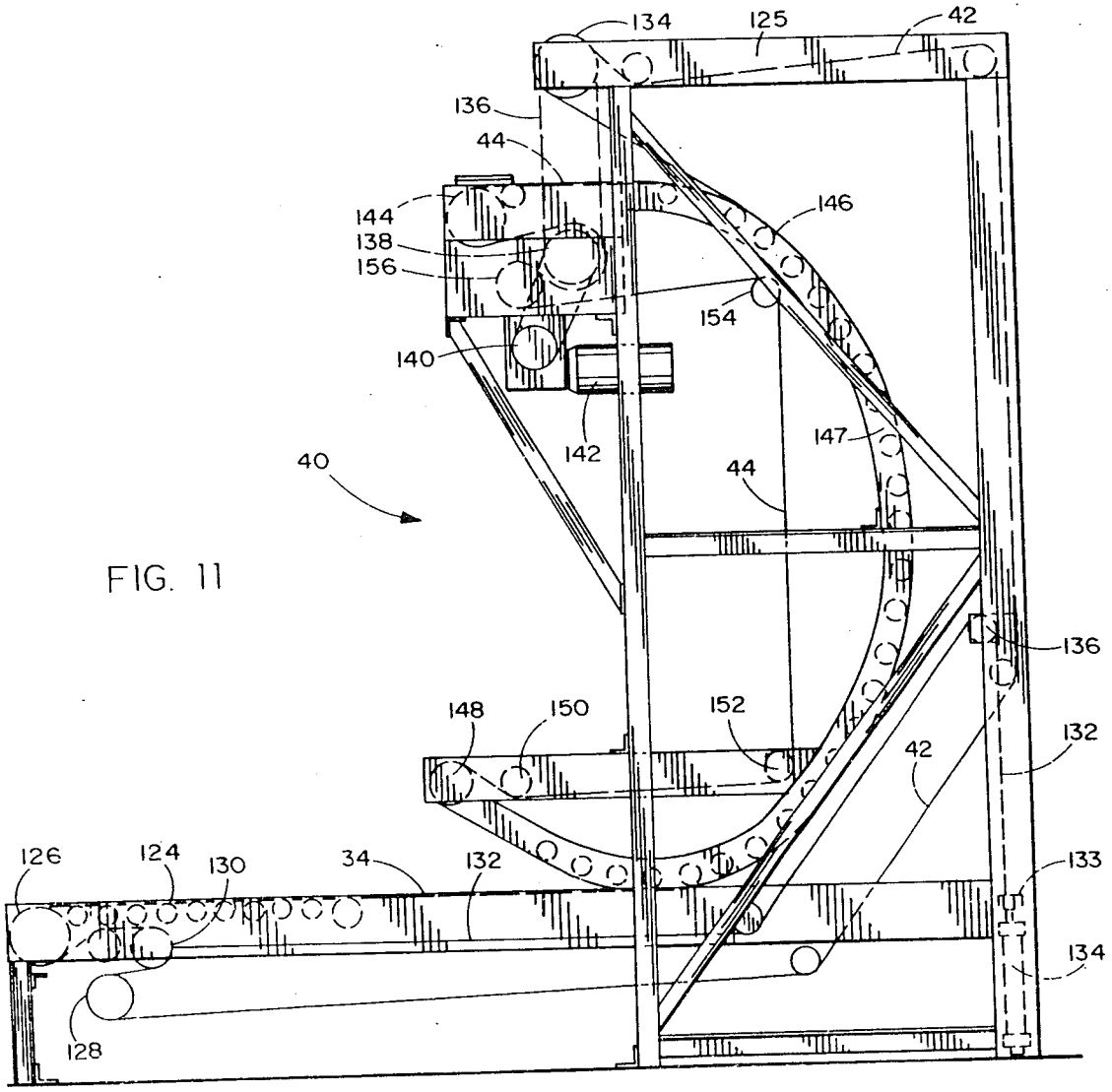
Figure 15:
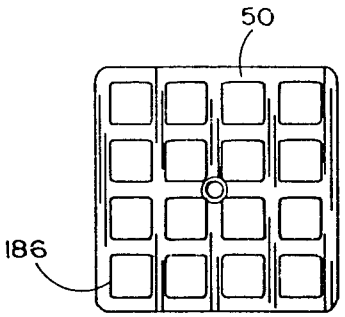
FIGS. 13 through 18 illustrate various views of the bag turning apparatus of the present invention as well as components thereof.
Figure 17:
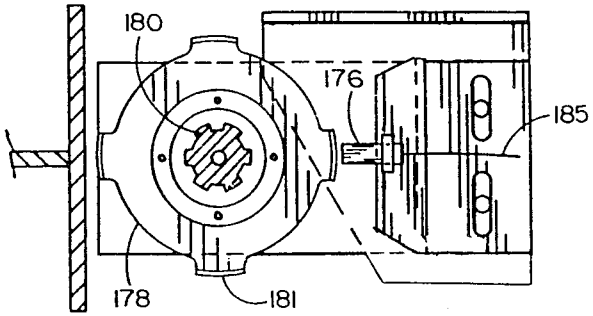
Figure 18:
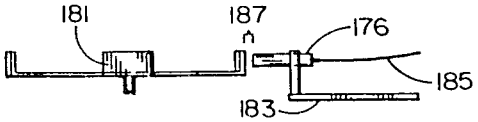
Figure 13:
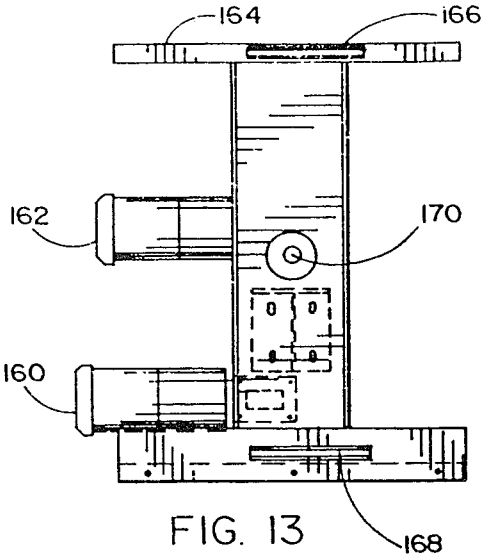
Figure 14:
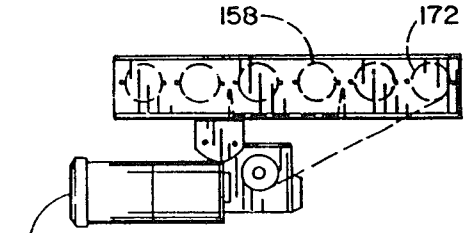
Figure 16:
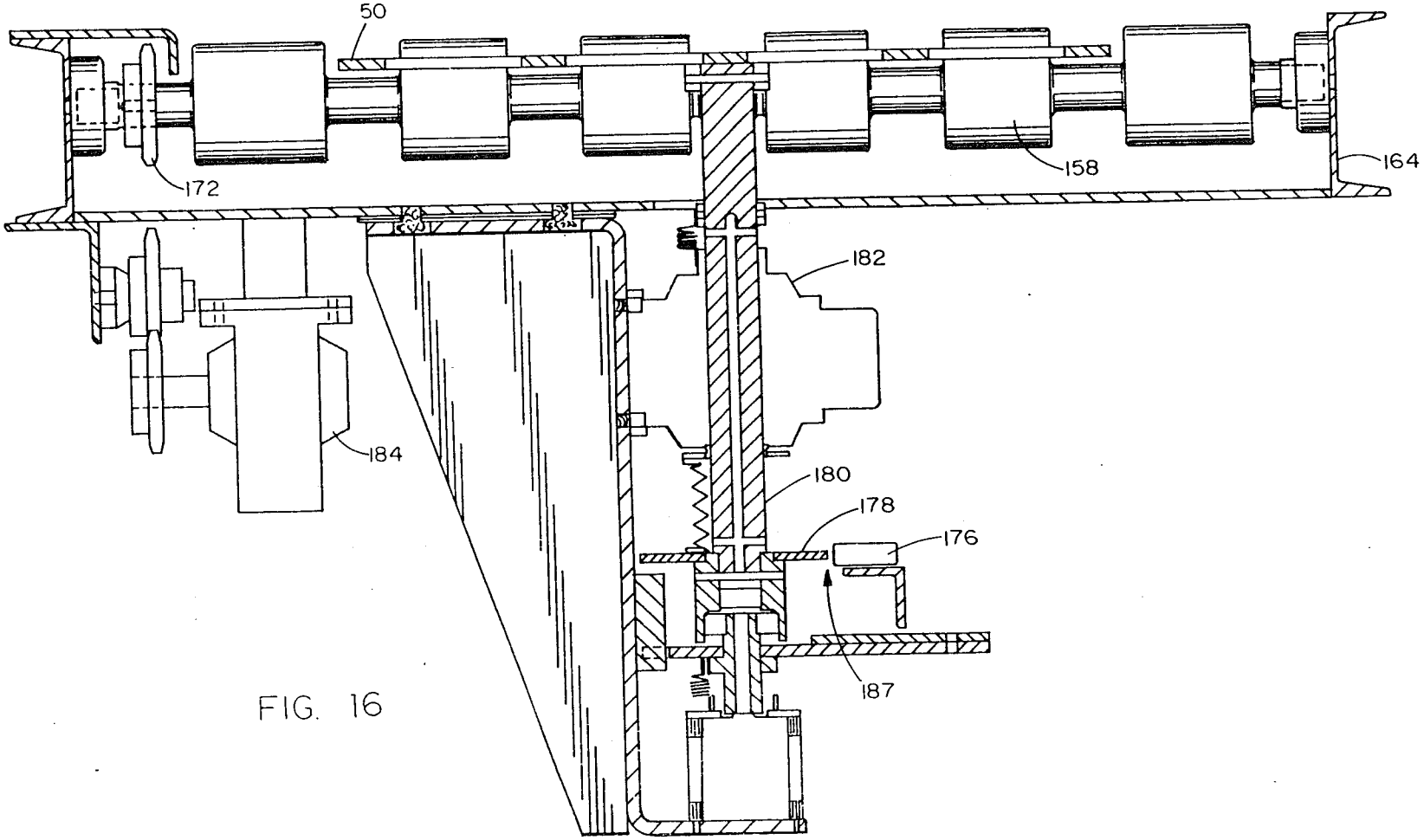

Reference will now be made to FIGS. 11 and 12 which illustrate the detailed structure of the bag lift apparatus 40. Bag lift apparatus 40 acutally provides two functions, namely, transporting and reorienting each filled bag from the lower section 14 to the upper section 16 of the packing center. However, it also provides compression or flattening of each bagy which depletes each bag of any residual air remaining in the bag during the filling process. This has a tendency to both de-aerate and flatten the bags into a more rectangular shape for proper palletizing as each bag enters the upper section of the packing center.

The bags enter the belt section of the bag lift apparatus 40 and are trapped between the outside lift belt 42 and the inside lift belt 44 by virture of the fact that the outer belt can move away to accommodate the bag thicknesses as the bag enters the conveyor. The pressure of the outer belt traps the bag against the inner belt enabling the bag to be elevated and turned 180 degrees in directions simultaneously. The outer belt is counterweighted through a series of cables and a counterweight cylinder located at the rear of the elevator. By adjusting the pressure on the cylinder the tension of the outer belt against bags may be regulated. The bags continously enter at the lower end and exit at the upper end while their transport direction changes 180 degrees in the process.

Bag lift apparatus 40 comprises a frame 125 of appropriate height and length to accomplish the aforementioned bag transport and flattening operation while enabling lower section to upper section bag transport in a confined space which is compatible with the limited rectangular dimensions of the packing center previously described. Contained within the confines of frame 125, the major elements of the bag lift apparatus 40 comprise conveyor rollers 124, friction rollers 126, pulleys 128 and 130, tension cables 132, tension control actuator 134, tie bar 133, drive chain 136, friction rollers 138, drive shaft 140, motor 142, friction rollers 144, conveyor rollers 146, friction rollers 148, 150, 152, 154 and 156. Geared motor drive 142 operating through drive shaft 140 drives the inner belt at head pulley 138 of the inner belt.

The inner belt shape is defined by an inner frame 147 and a plurality of appropriately spaced and positioned conveyor rollers 146. The inner belt return path is dictated by rollers 148, 150, 152 and 154 along with friction roller 144 and head roller 138. The outer belt is driven by friction against the bags as the bags are elevated between the outer and inner belts or by friction between the respective belts when there are no bags between the two belts. The lower lift belt portion 34 of the outer belt is provided with a plurality of standard conveyor rollers 124. The relative tension of the outer belt against the inner belt may be kept relatively constant irrespective of the number of bags in the lift. Compensation for movement of the outer belt away from the inner belt when a bag lies between those belts is provided by a sliding takeup bearing 128 located at the entry section of the outer belt. The outer belt is counterweighted through a series of cables and a counterweight cylinder 134 located at the rear of the elevator and connected to the cables by a tie bar 133. The pressure on the cylinder may be adjusted to vary the tension of the outer belt against the bags.

After the bags have been lifted to the upper section and flattened by the bag lift apparatus 40, the bags are transported to the bag turner apparatus 46 by the bridge conveyor 48. The combined effect of the relatively long, smooth surface of the bridge conveyor and of the lateral force of alignment guides 49, fine tunes the position of each bag before it reaches the bag turner.

Reference will now be made to FIGS. 13 through 18 for a more detailed description of the bag turner apparatus 46 of the packing center. The bag turner apparatus comprises a section of powered roll conveyor with especially designed rollers 158 designed to allow a grid plate 50 to nestle within the rollers and maintain a lower profile than the top surface of the rollers. The turner incorporates an electric photo eye 166 and a reflector 168 which detects the presence of a bag in the middle of the grid plate 50. Upon commands from the machine control center in console 26, the grid plate 50 is allowed to "pop up" and rotate 90 degrees, 180 degrees or 270 degrees to properly orient each filled bag for both orientation on the layer and location of the bag valve to maintain the valve in an inward position within the layer.

The conveyor section of the turner is powered by an electric motor 160 which chain drives live rollers 172 through a conventional chain drive system. The lift device is air cylinder operated and the turning is accomplished by virtue of a splined shaft 180 running through a hollow shaft reducer which is driven by motor 162. The splined shaft 180 enables the grid plate 50 to turn while allowing the air cylinder to lift the grid plate up and down vertically without affecting the turning motion. A switch target plate 178 of substantially circular design is incorporated onto the splined shaft 180. This turning plate is designed to generate a proximity switch signal to detect the positions as required. Target plate 178 utilizes four metal flags 181 located at 90 degree intervals along the rim of the plate. Flags 181 pass by proximity switch 176 which senses the proximity of each flag across an air gap 187. A bracket 183 supports the proximity switch and a wire 185 transmits the switch closure signal to the system logic in console 81. Additional proximity switches are also located in the apparatus to detect both the up and down positions of the cylinder to properly integrate the lifting motion with the conveyor motion of the turning device. The entire turning device is mounted into the main frame just prior to the layer forming area.

The turner grid 50 utilizes a relatively square-shaped grid configuration having a plurality of grid openings 186 each adapted to pass a bag turner roller 158 so that when the grid is in its non-extended configuration, the bag contacts the rollers and when the grid is in its extended configuration, the bag is raised above the rollers whereby the grid can turn the bag free of the rollers. The grid 50 turns around an axis 170 which is coaxially oriented relative to the splined shaft 180. Raising of grid 50 above rollers 158 is accomplished by means of the lift actuator 174 as previously described. Each of the two motors used in the turner, namely, the conveyor motor 160 and the turner motor 162, uses an associated gear box including turner gear box 182 and conveyor drive gear box 184. The photo detector and reflector are mounted to the outside perimeter of the frame 164.

Figure 19:
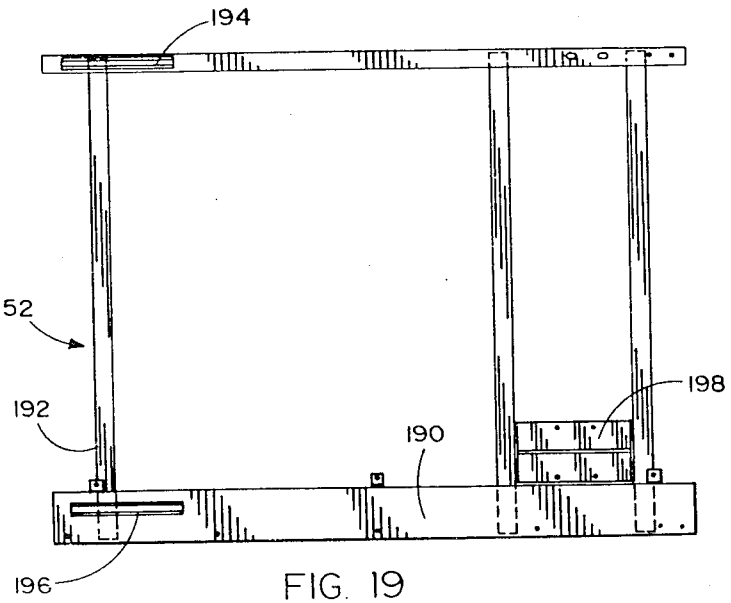
FIGS. 19 through 21 are top, front and side views, respectively, of the layer forming conveyor portion of the present invention.
Figure 20:
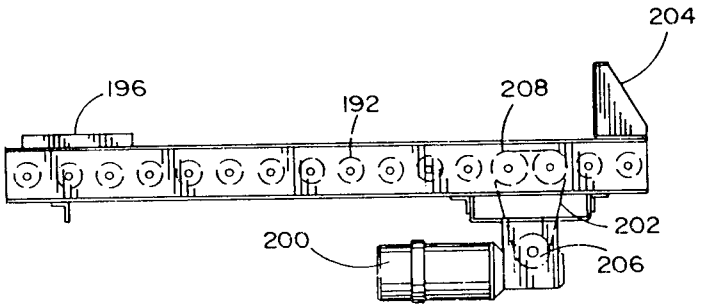
Figure 21:
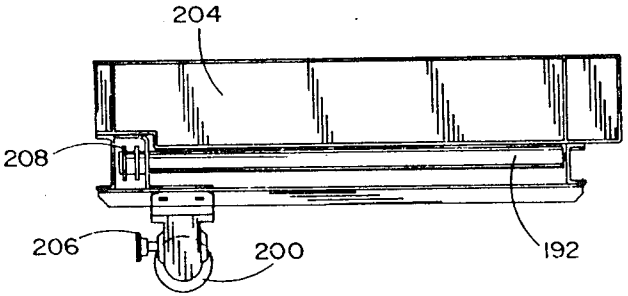

Reference will now be made to FIGS. 19, 20 and 21 for a more detailed description of the layer forming conveyor 52 of the present invention. The layer forming conveyor is a powered live roller driven conveyor with closely spaced rollers to enable the bags to be conveyed in from the turning device and then pushed transversely by the pushing device onto the load plates, the latter to be discussed hereinafter. The layer forming conveyor is of conventional power roller conveyor design and is gear motor driven fron one end by a chain drive. Each roller drives the adjoining roller through a short coupled chain and sprockets at the end of the rollers. The rollers run continuously during normal operation and when the proper number of bags to form a half layer are accumulated on the live roller conveyor, each half layer of bags is then pushed onto the load plate area by a pusher assembly hereinafter to be discussed.

The structure of the layer forming conveyor comprises a substantially rectangular frame 190 which holds a plurality of parallel closely spaced conveyor rollers 192. A photodetector and reflector 194 and 196, respectively, are mounted to the frame along the top surface thereof to monitor the passage of filled valve bags onto the layer forming conveyor. The conveyor is operated by a drive motor 200 supported by a drive support bracket 198. The drive motor shaft is connected to drive rollers by a drive chain 208. A bag stop bracket 204 is provided to stop the bags at the end of the conveyor. The drive chain 202 is connected to special roller sprockets 208 through a drive sprocket 206 which is connected to the motor shaft.

Reference will now be made to FIGS. 22 through 26 for a more detailed discussion of the bag pusher apparatus 54 and layer squaring apparatus 64 of the present invention. The pusher and layer squaring devices mount on top of the main frame to push half layers of bags onto the load plate section of the pallet elevator to be discussed hereinafter. When the proper number of bags have accumulated on the layer forming area, the pusher is activated through the machine controller and a chain driven pusher plate pushes the bags laterally from the forming conveyor onto the load plates.

Upon completion of the push operation the push plate retracts to its original position. Through a series of cam devices located inside the main channels of the pusher structure, the pusher maintains a vertical orientation as it pushes the bags onto the load plate. However, during return to its original starting position the push plate is repositioned to a more horizontal configuration to clear the top of the bags which have accumulated on the layer forming conveyor during the time the preceding bags were being pushed onto the load plates. The cam roller device operates through a series of switch bars located within channels of the pusher structure. The pusher is driven by an electric motor and a series of chain drives. Proximity switches are located to sense the return position and full push position of the pusher assembly.

Figure 22:
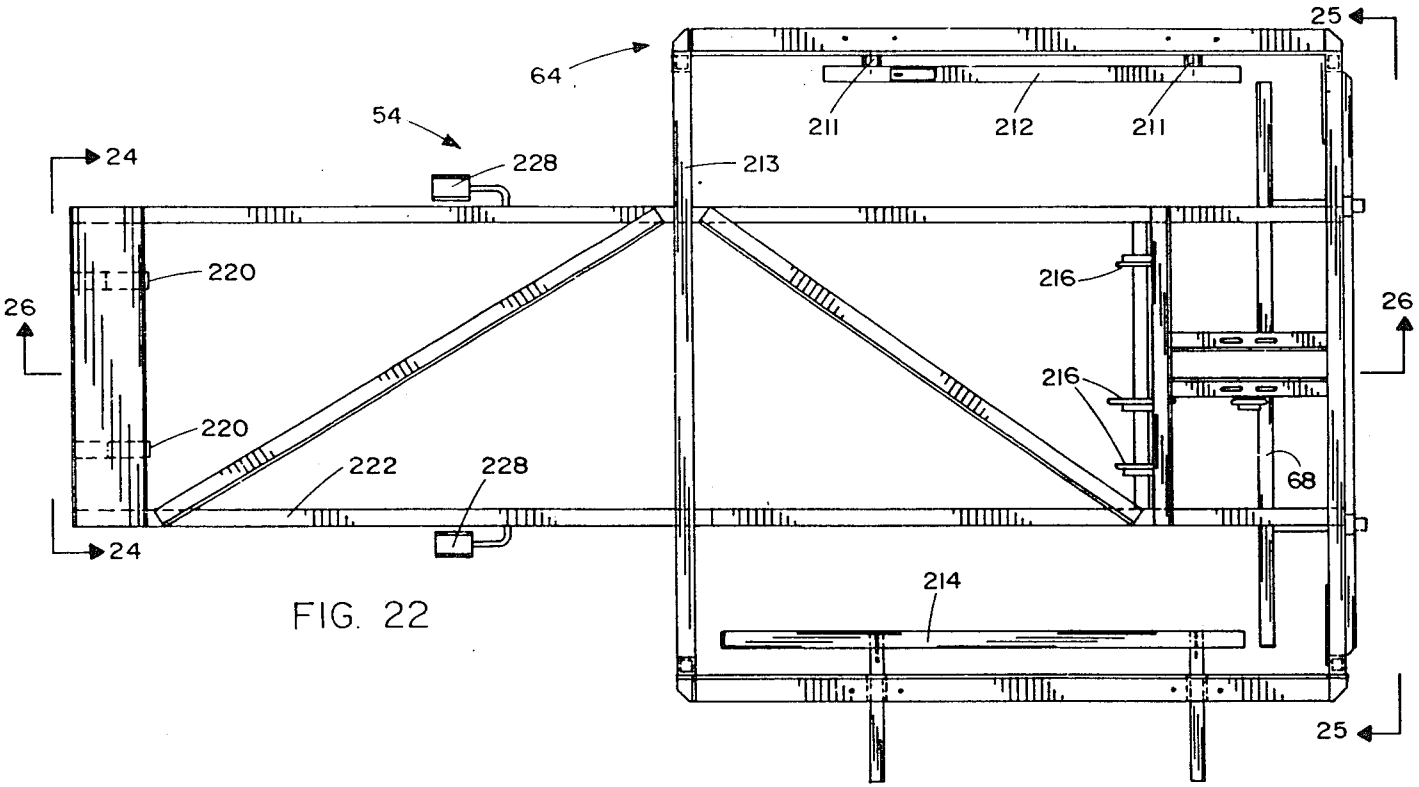
FIGS. 22 through 26 are top, front, left side, right side and cross-sectional views of the bag pusher apparatus and layer squaring apparatus of the present invention.
Figure 23:
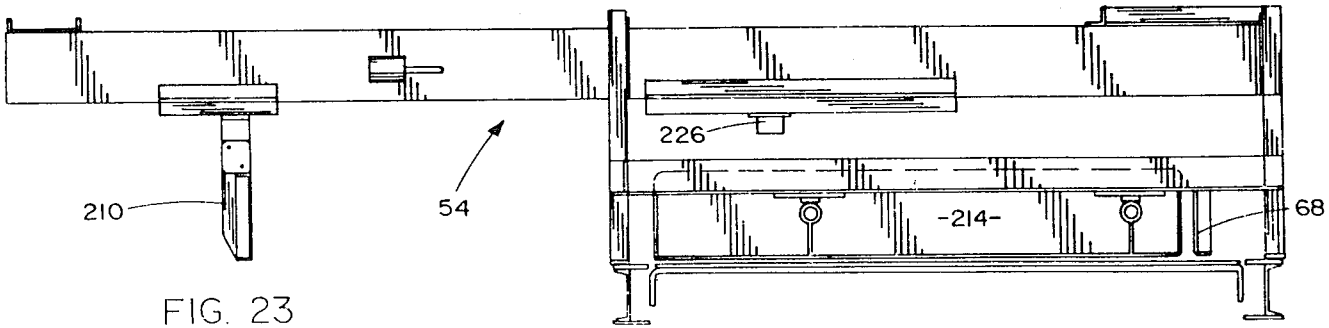
Figure 25:
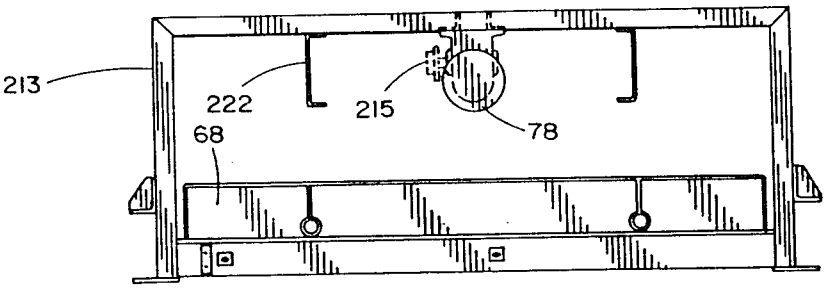
Figure 24:
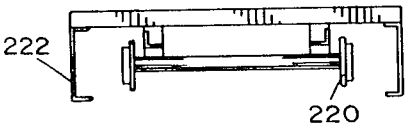
Figure 26:
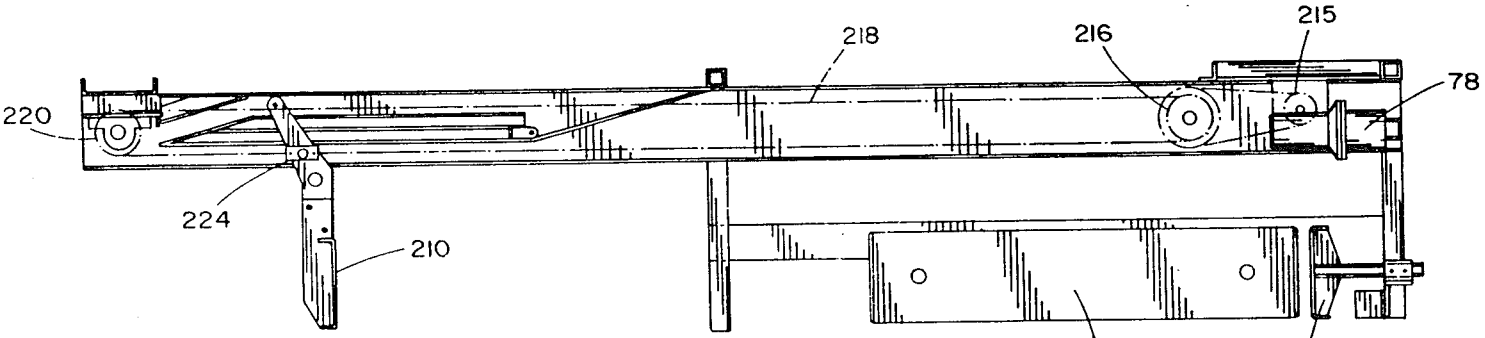

As seen best in FIG. 22, the bag pusher apparatus comprises a substantially rectangular pusher frame 22. The pusher drive motor 78 is attached to the load plate end of the pusher frame 222 and is connected by means of a drive wheel 215 and chain drive 216 to the push plate 210 by virtue of a pair of chains 218. The chain loop is completed by a chain sprocket 220 at the push plate end of the pusher frame 222. The push plate is attached by a pair of pusher/chain attachments 224 to the chain. A microswitch sensor 226 is affixed to the pusher frame 222 adjacent the load plate area to sense when each half layer of bags has been pushed over the load plates.

The layer squaring apparatus 64 comprises a substantially square-shaped squaring frame 213 which sits below the pusher frame 222 just above the load plates 56. The squaring area is defined by a bag stop 68 against which the bags are pushed by the pusher plate 210 when they have been fully positioned over the load plate area. The lateral position of the bags is defined by a second bag stop 214 which is substantially perpendicular to the first bag stop 68. On the opposite side of the frame 213 from bag stop 214 there resides a squaring arm 212 which is connected to a pair of air cylinders 211 and which is movable towards the center of the squaring frame 213 for pushing the bags towards the second bag stop 214.

When a full layer of bags has been assembled over the load plates, that layer of bags is held in place by the combined cooperative action of the squaring arm 212 pushing against the bags which in turn push against second bag stop 214 and also the pushing effect of the push plate 210 against the bags which are held in place at the opposite end by the bag stop 68. Thus it can be seen that the full layer of bags is fully supported by these lateral compression forces during the time that load plates 56 are opened exposing the lower surface of the bag layer to the underlying bag pallet elevator. The elevator will have been raised by the control logic to the appropriate level to receive the newly formed bag layer as the load plates 56 are separated thereby enabling passage of the bag layer onto the pallet elevator. Thus, as each layer is formed the squaring arm pushes the layer in one direction while the push plate of the pusher holds the bags in the opposed perpendicular direction. Both the squaring arm and the push plate hold the bags as the load plates open to deposit the formed layer onto the pallet. In this manner the full pattern layer is maintained in a compact shape during deposit onto the pallet.

Reference will now be made to FIGS. 28 through 32 for a more detailed description of the load plates and elevator frame. The load plates 56 are large steel plates mounted on V-track rollers 252 in the main elevator framework. These load plates operate much like bombay doors to allow the layer to be deposited from the forming area onto the pallet. The load plates 56 are activated by an air cylinder (not shown) mounted on the framework 244 and driving one of the load plates. This cylinder driven load plate, in turn, drives the other load plate in an opposite direction through a chain drive 246, sprockets 250 and blocks 248.

The load plates open and close simultaneously to deposit the formed layer onto the pallet. Microswitches are located at both ends of the stroke of the load plates to send the proper signal for a full open or full closed position to the machine controller at console 82.

A shaft 253 is connected to both elevator drive motor 88 and a pony motor 255. Motor 88 is a high power high speed motor relied upon to lift elevator carriage 95. Pony motor 255 is used solely as a means for compressing filled bags already deposited on the pallet to further flatten and vent air from the bags. More specifically, after a layer of bags has been deposited on a pallet and the load plates closed to receive another layer, pony motor 255 is used to force the uppermost layer of bags on the pallet against the bottom surface of the load plates. This compressive force is maintained until the load plates are lifted slightly against the compression resistance of spring 257 activating switches 259 above the load plates. This bag compression technique is superior to prior art techniques because it does not rely on sensing motor current which would otherwise make the bag flattening force vary inversely with pallet weight. The compression is maintained until a new layer of bags has been formed on the top surface of the load plates when the elevator is lowered to receive the next layer.

The main elevator frame for the full pallets incorporates a pair of vertically positioned roller guides built integrally into the mainframe of the machine and the elevator is supported on the driven side by chains running over shafts located at the top and bottom of the elevator frame. The lower shaft is extended to accept the large two speed gear reducer/motor/brake combination to operate the elevator at both high and low speeds.

A pair of fixed chains run from the base of the driven side upward and then horizontally across the elevator frame to the opposite side where again the chains resume a vertical orientation and extend up to the top of the elevator where they are fixed. This pair of affixed chains enables the elevator platform to be maintained in an exact horizontal position as it travels from the low position to the high position without regard to weight placed on the elevator conveyor itself. These chains eliminate the possibility of a cantilever load and enable the cam roller wheels to operate without strain from the load.

Figure 30:
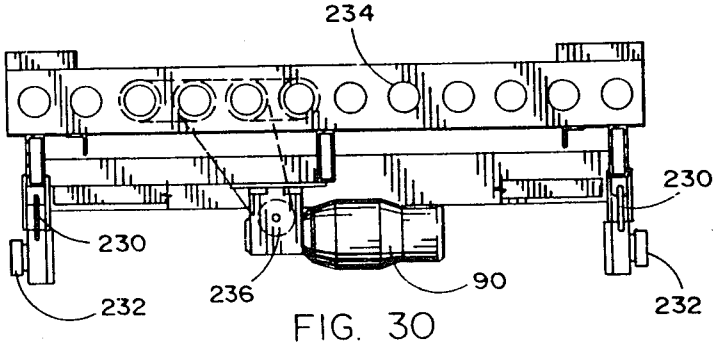
FIGS. 28 through 30 are top, front and side views, respectively, of the pallet elevator carriage.
Figure 29:
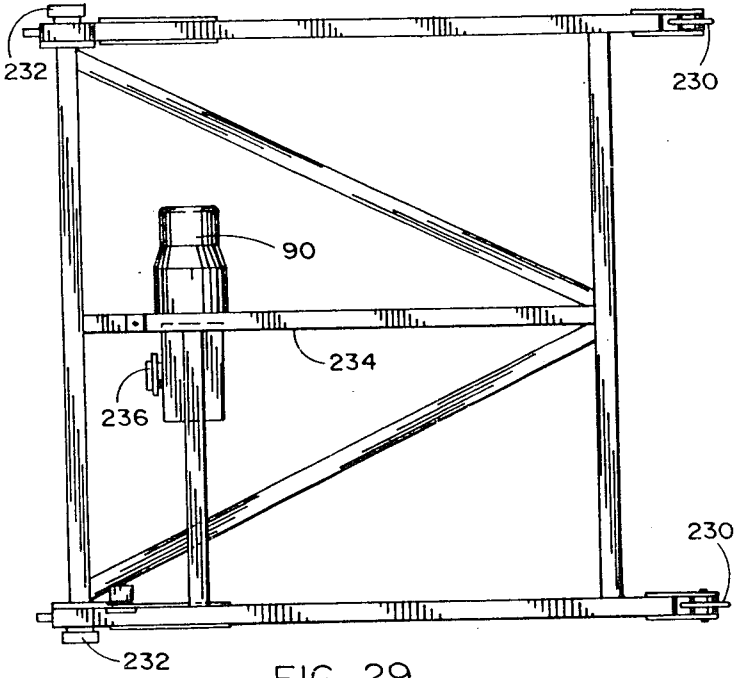
Figure 28:
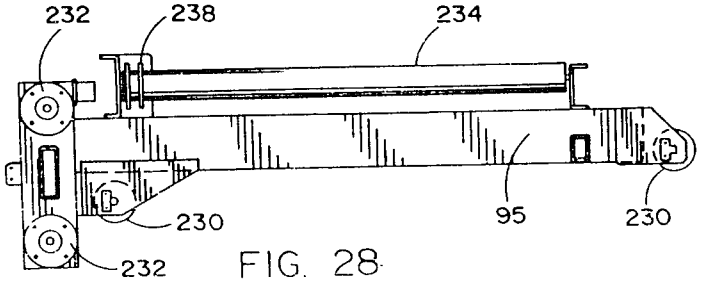
Figure 31:
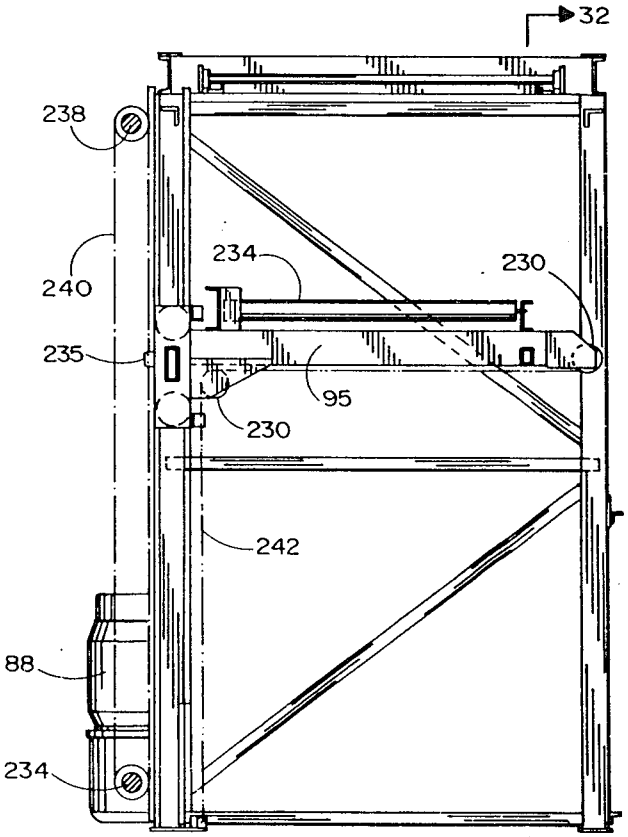
FIG. 31 is an enlarged view of the pallet elevator.
Figure 32:
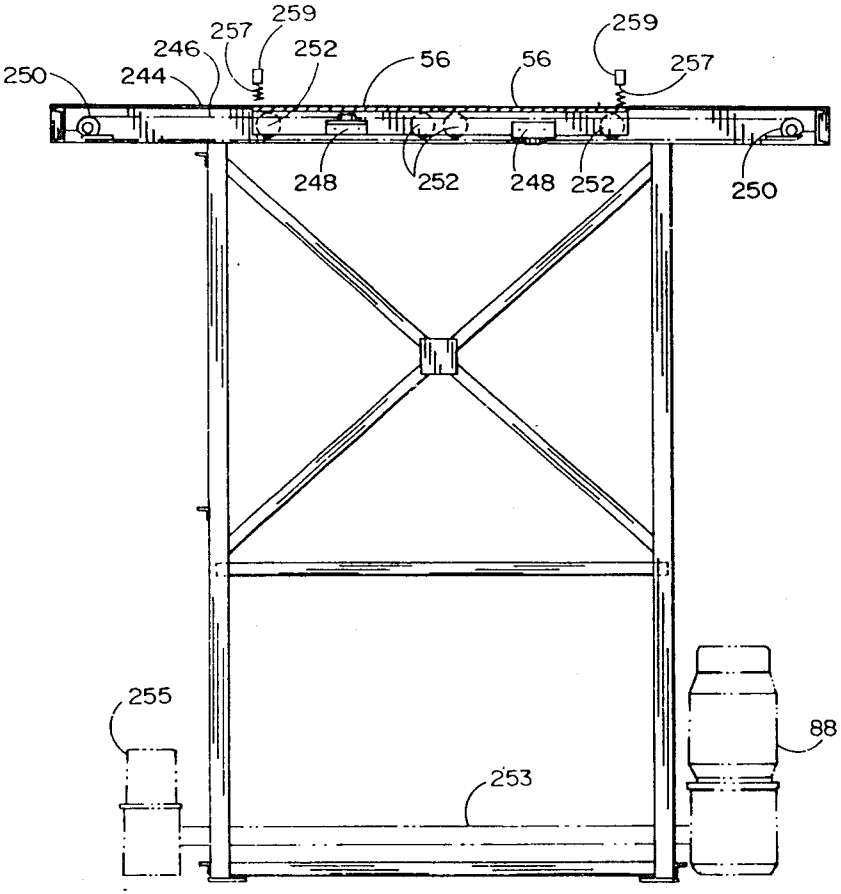
FIG. 32 is a cross-sectional view taken along lines 32—32 of FIG. 31.

The principle component of the elevator 58 is the elevator carriage 95 illustrated in detail in FIGS. 28, 29 and 30. Elevator carriage 95 utilizes an elevator carriage conveyor drive motor 90 to drive a plurality of interconnected rollers 234 through a roller drive pulley 236 connected to the motor 90. As seen best in FIG. 31, the carriage 95 is placed in a cantilevered position within the elevator framework riding on a pair of track wheels 232 on each side of the carriage. The elevator carriage is controlled by an elevator drive motor 88 through elevator drive wheels 234 and 238 around which an elevator drive chain 240 rotates. Chain 240 is connected to the carriage through a chain interconnection member 235.

Although the elevator carriage is lifted from one side, its weight is supported and its horizontal position maintained by an elevator support chain 242 which is affixed to the elevator frame at its upper and lowermost end points but which supports the carriage by means of chain sprocket wheels 230 which continually ride on the chain 242 to support the weight of the carriage opposite the track wheels 232.

Figure 33:
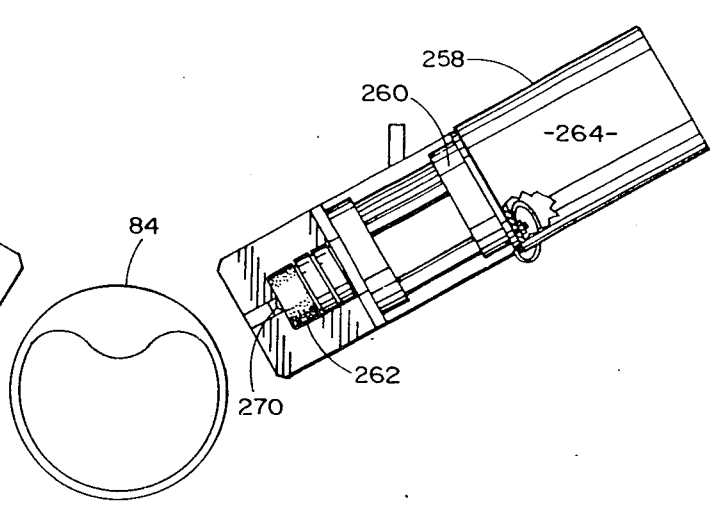
FIGS. 33 and 34 are front and partially sectioned side views, respectively, of a bag filling sensor used in the invention.
Figure 34:
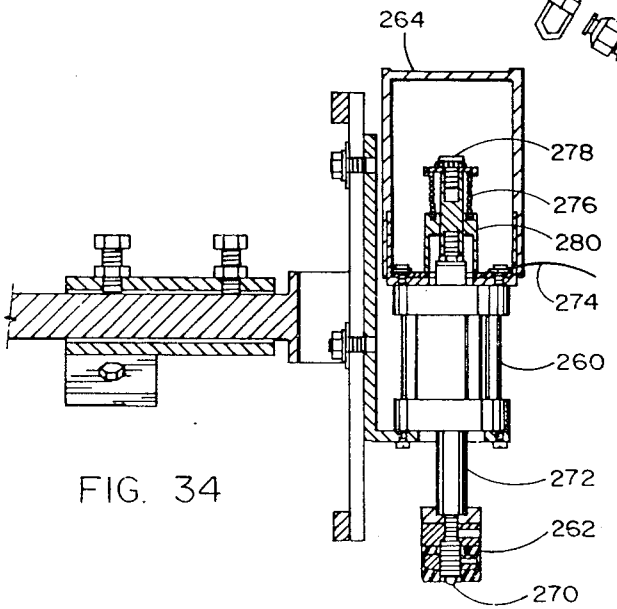

As previously indicated the present invention utilizes a bag spouting sensor as a means for assuring that each empty valve bag has been placed properly on the spout 84 before particulate material is allowed to flow into the bag. Furthermore, as previously indicated, in the event of a mis-spout detected by the bag spouting sensor, the improperly spouted empty bag is removed from the spout either by rotation of the picker spouter apparatus arm or by reversal of the direction of the takeaway conveyor permitting proper placement of a subsequent bag onto spout 84. FIGS. 33 and 34 illustrate the details of the bag spouting sensor. More specifically, as shown in FIG. 33 the bag spouting sensor comprises a pair of sensor actuators 260 positioned on opposite sides of the spout 84. Actuator 260 provides an extendable sensor probe 262 the tip of which is provided with a metal head 270. After the valve bag has been placed on the spout 84, the sensor probes 262 of the respective actuators 260 are extended to come in contact with the bag. If the bag has been properly placed on the spout 84, the metal surface of the spout will be covered by the bag and the metal head 270 of each of the actuators will come in contact with the bag surfaces opposed to the metal surface of the spout. On the other hand, if the bag has not been properly placed on the spout 84, one or both of the two metal heads 270 of the respective actuators 260 will touch the metal surface of the spout which is electrically grounded. Such contact therefore causes a switch closure signaling a mis-spouted bag.

In view of the fact that the actuator 260 is made of metal and further in view of the fact that it is undesirable to have an electrical circuit or electrical wire moving with the sensor probe 262 each time a bag is spouted, the bag spouting sensor is configured as shown in FIG. 34 to electrically insulate the metal head 270 from the electrically grounded metal structure of the actuator 260. More specifically, as seen in FIG. 34 the metal head 270 extends into and through the rod 272 and the body of actuator 260 where it makes contact with a cap 278 contained within housing 264. The cap is connected to a spring 276 which is, in turn, connected to a contact plunger 280. Consequently, when sensor probe 262 is extended by the actuator 260 to come in contact with either the spout 84 or the bag residing on the spout, a direct electrical connection is made between the metal head 270 and the contact plunger 280 which in turn contacts the wire 274. However, because of the configuration of FIG. 34, this electrical connection is isolated from ground unless the metal head 270 contacts the metal surface of spout 84. Thus, only if the wire 274 is grounded by means of the contact between the metal head and the bare spout metal surface is a signal generated which is indicative of a mis-spout condition due to the improper placement of a valve bag on the spout 84. Wire 274 is connected to the system control logic at console 82. This logic for the entire packing center system is now be described by means of FIGS. 35 through 53.

FIGS. 35 through 53 provide schematic representations of the control signal flow associated with the present invention. Each such schematic representation includes a plurality of signal flow paths which are comparable to relay diagrams and which are readily understood as being analogus to boolean logic equations. For the most part, the schematic representations in each flow path are various types of switch closure components which act in concert to produce an output. Each such output controls or has some effect upon a portion of the packing center system. The left vertical line of each of FIGS. 35 through 53 may be deemed to be a source of AC power. The various outputs identified along the right vertical line of each of FIGS. 35 through 53 are the specific outputs generated by the logic of the present invention and utilized to drive the various components of the packing center.

The various switch closure-type elements positioned between the left and right vertical lines of FIGS. 35 through 53 represent, primarily, inputs in the form of contact closure conditions from switches, push buttons, relay contacts, counters and timers. The outputs represent signals applied to motor starters, lights and solenoids. Each such input and each such output has an address code associated with it. The various input and output devices represented in FIGS. 35 through 53 along with their respective address codes, their locations and functions, are indicated below in Tables I through XX. The corresponding addresses for each component are listed alongside the representation of that component in FIGS. 35 through 53. Generally speaking, each input component has an address corresponding to a five digit number the first two digits of which are 11 and each output has a corresponding address of five digits the first two digits of which are 02. Those symbols in FIGS. 35 through 53 that are identified by a five digit address beginning with the digits 03 correspond to addresses of storage locations internal to the console 82.

TABLE I

| | | LIMIT SWITCHES | | |
|---|---|---|---|---|
| NO. | DESCRIPTION | LOCATION | ADDRESS | TYPE |
| LS-1 | BAG CHAIR LS | PACKER CHAIR | 11101 | PROX. SW. |
| LS-2 | SHELF POS. | MAGAZINE | 11113 | LIMIT ROLLER |
| LS-3 | DESTACKER | PRESENTER | 11114 | MAGNO |
| LS-4 | CARRIAGE PRES. | PRESENTER | 11115 | MAGNO |
| LS-5 | MAG. | PRESENTER | 11116 | MAGNO |
| LS-6 | TILT ARM RETR. | PRESENTER | 11201 | MAGNO |
| LS-7 | TILT ARM EXT. | PRESENTER | 11202 | MAGNO |
| LS-8 | PICKER RETR. | SPOUTER | 11203 | MAGNO |
| LS-9 | OPENER RETR. | SPOUTER | 11204 | MAGNO |
| LS-10 | FULL SW. UP | SPOUTER | 11205 | MAGNO |
| LS-11 | FULL SW. DN. | SPOUTER | 11206 | MAGNO |
| LS-12 | PARTIAL SW. | SPOUTER | 11207 | MAGNO |
| LS-13 | BAG TURNER | TURNER | 11315 | PROX. |
| LS-14 | BAG PUSHER EXT. | PUSHER | 11316 | PROX. |
| LS-15 | BAG PUSHER RETR. | PUSHER | 11317 | PROX. |
| LS-16 | ELEVATOR DN. | ELEVATOR | 11400 | PROX. |
| LS-17 | ELEVATOR UP | ELEVATOR | 11401 | PROX. |
| LS-18 | L.P. OPEN | LOAD PLATE | 11416 | PROX. |
| LS-19 | L.P. CLOSED | LOAD PLATE | 11417 | PROX. |
| LS-20 | PUSHER PLATE CLEAR | LOAD PLATE | 11510 | PROX. |
| LS-21 | BAG SENSOR | FILLER | — | INTR. SAFE |
| LS-22 | BAG SENSOR | FILLER | — | INTR. SAFE |
| LS-23 | PACKER SCALE SW | FILLER | 11507 | REED |
| LS-24 | TURNER UP | TURNER | 11511 | PROX. |
| LS-25 | TURNER DN. | TURNER | 11512 | PROX. |
| LS-26 | FULL PUSH | LOAD PLATE | 11403 | PLUNGER |
| LS-27 | DISPENSER DOWN | DISPENSER | 11600 | PROX. |
| LS-28 | LAYER COMPRESSION | LOAD PLATE | 11517 | PLUNGER |

TABLE II

PHOTO-ELECTRIC CELLS

| NO. | DESCRIPTION | LOCATION | ADDRESS | TYPE |
|---|---|---|---|---|
| PE-1 | TOP SHELF EYE | PRESENTER | 11117 | RETRO. REFL. |
| PE-2 | 2ND SHELF EYE | MAGAZINE | 11200 | RETRO. REFL. |
| PE-3 | PACKING CONTROL 1 | BAG T.A. CONV. | 11310 | RETRO. REFL. |
| PE-4 | PACKING CONTROL 2 | LIFT FLATT. | 11311 | RETRO. REFL. |
| PE-5 | PACKING CONTROL 3 | BRIDGE CONV. | 11312 | RETRO. REFL. |
| PE-6 | SAFETY | LAYER FORMING | 11313 | RETRO. REFL. |
| PE-7 | TURNER-COUNT | TURNER | 11314 | RETRO. REFL. |
| PE-8 | LAYER SENSE | ELEVATOR | 11402 | OPPOSED |
| PE-10 | NEW PALLET IN POSITION | ELEVATOR | 11404 | OPPOSED |
| PE-11 | FULL PALLET CLEAR | ELEVATOR | 11405 | OPPOSED |
| PE-12 | PALLET IN DISPENSER POSITION | DISPENSER | 11512 | RETRO. REFL. |

TABLE III

SELECTOR SWITCHES

| NO. | DESCRIPTION | LOCATION | ADDRESS | TYPE |
|---|---|---|---|---|
| SS-1 | LEVEL PROBE O/R | J12 | 11104 | MAINTAINED 2 POS. |
| SS-2 | VACUUM OFF-ON | J12 | 11216 | MAINTAINED 2 POS. |
| SS-3 | PLACER MAN.-AUTO. | J12 | 11304 | MAINTAINED 2 POS. |
| SS-3a | PLACER MAN.-AUTO. | J11 | 11304 | MAINTAINED 2 POS. |
| SS-4 | PLACER OFF-ON | J12 | 11305 | MAINTAINED 2 POS. |
| SS-4a | PLACER OFF-ON | J11 | 11305 | MAINTAINED 2 POS. |
| SS-5 | PALLETIZER MAN.-AUTO | J11 | 11502 | MAINTAINED 2 POS. |
| SS-6 | CONVEYOR O/R | J12 | 11102 | MAINTAINED 2 POS. |
| SS-7 | POWER OFF/ON | J13 | 11514 | MAINTAINED 2 POS. |

TABLE IV

RELAYS

| NO. | DESCRIPTION | LOCATION | ADDRESS |
|---|---|---|---|
| R-1-1 | HYAC CLAMP | J-13 | 11000 |
| R2-1 | PRESTART | J-13 | 11001 |
| R3-1 | BULK | J-13 | 11002 |
| R4-1 | TRIM | J-13 | 11003 |
| R5-1 | TOP-OFF | J-13 | 11004 |
| R6-1 | MID CYCLE | J-13 | 11005 |
| R7-1 | AUX. 1 | J-13 | 11006 |
| R8-1 | CHARG. VALVE | J-13 | 11007 |
| R9-1 | AIR 1 | J-13 | 11010 |
| R10-1 | AIR 2 | J-13 | 11011 |
| R11-1 | AIR RELIEF | J-13 | 11012 |
| R12-1 | POST FILL | J-13 | 11013 |
| R13-1 | DISCHARGE | J-13 | 11014 |
| R14-1 | BEAM LOCK | J-13 | 11015 |
| R15-1 | UNDER ALARM | J-13 | 11016 |
| R16-1 | OVERWT. ALARM | J-13 | 11017 |
| R17 | HYAC START | J-13 | 02012 |
| R18 | HYAC STOP | J-13 | 02013 |
| R19 | HYAC HOLD | J-13 | 02014 |
| R20 | TURNER CLUTCH | J-13 | H.W. |
| R21 | TURNER CONV. CLUTCH | J-13 | H.W. |
| R22-1 | BAG SENSOR | J-13 | 11306 |
| R23 | HYAC DISCHARGE | J-13 | 02015 |

TABLE V

PUSH BUTTONS

| NO. | DESCRIPTION | LOCATION | ADDRESS | TYPE |
|---|---|---|---|---|
| PB-1 | PACKER START | J-12 | 11105 | MOM. |
| PB-2 | PACKER STOP | J-12 | 11106 | MOM. |

TABLE V-continued

PUSH BUTTONS

| NO. | DESCRIPTION | LOCATION | ADDRESS | TYPE |
|---|---|---|---|---|
| PB-2a | PACKER STOP | J-11 | 11106 | MOM. |
| PB-3 | PACKER HOLD | J-12 | 11107 | MOM. |
| PB-3a | PACKER HOLD | J-11 | 11107 | MOM. |
| PB-4 | BAG DISCHARGE | J-12 | 11110 | MOM. |
| PB-5 | BAG TRANSFER | J-12 | 11210 | MOM. |
| PB-5a | BAG TRANSFER | J-11 | 11210 | MOM. |
| PB-6 | TILT ARM FRWD. | J-12 | 11211 | MOM. |
| PB-6a | TILT ARM FRWD. | J-11 | 11211 | MOM. |
| PB-7 | PICKER EXT. | J-12 | 11212 | MOM. |
| PB-7a | PICKER EXT. | J-11 | 11212 | MOM. |
| PB-8 | CAL. OPEN | J-12 | 11213 | MOM. |
| PB-8a | CAL. OPEN | J-11 | 11213 | MOM. |
| PB-9 | MANUAL SPOUT | J-12 | 11214 | MOM. |
| PB-9a | MANUAL SPOUT | J-11 | 11214 | MOM. |
| PB-10 | MAGAZINE JOG | J-13 | 11215 | MOM. |
| PB-11 | COUNTER RESET | J-12 | 11300 | MOM. |
| PB-11a | COUNTER RESET | J-11 | 11300 | MOM. |
| PB-12 | VACUUM PUMP START | J-13 | 11301 | MOM. |
| PB-13 | VACUUM PUMP STOP | J-13 | 11302 | MOM. |
| PB-14 | LAYER COUNT O/R | J-11 | 11407 | MOM. |
| PB-15 | LAYER COUNT RESET | J-11 | 11410 | MOM. |
| PB-16 | RAISE ELEVATOR | J-11 | 11411 | MOM. |
| PB-17 | LOWER ELEVATOR | J-11 | 11412 | MOM. |
| PB-18 | ALARM SILENCE | J-13 | 11415 | MOM. |
| PB-19 | BLOWER START | J-13 | 11500 | MOM. |
| PB-20 | BLOWER STOP | J-13 | 11501 | MOM. |
| PB-21 | HALF LAYER PUSH | J-11 | 11503 | MOM. |
| PB-22 | FULL LAYER PUSH | J-11 | 11504 | MOM. |
| PB-23 | CONV. START | J-13 | 11505 | MOM. |
| PB-23a | CONV. START | J-11 | 11505 | MOM. |
| PB-24 | CONV. STOP | J-11 | 11506 | MOM. |
| PB-25 | COUNTER ADVANCE | J-11 | 11513 | MOM. |
| PB-26 | TURN BAG | J-11 | 11515 | MOM. |

TABLE V-continued

PUSH BUTTONS

| NO. | DESCRIPTION | LOCATION | ADDRESS | TYPE |
|---|---|---|---|---|
| PB-27 | TAKEAWAY REVERSE | J-11 | 11516 | MOM. |
| PB-28 | DISPENSER CYCLE | DISPENSER | 11601 | MOM. |
| PB-29 | MANUAL INFEED | DISPENSER | 11602 | MOM. |

TABLE VI

ILLUMINATED PUSH BUTTONS

| NO. | DESCRIPTION | LOCATION | ADDRESS | TYPE |
|---|---|---|---|---|
| IPB-1 | CLEAR | J-11 | 11413 | MOM. |
| IPB-2 | LOAD | J-11 | 11414 | MOM. |

TABLE VII

PUSH-PULL BUTTONS

| NO. | DESCRIPTION | LOCATION | ADDRESS | TYPE |
|---|---|---|---|---|
| PP-1 | EMERGENCY STOP | J-13 | H.W. | MAINTAINED |
| PP-2 | EMERGENCY STOP | J-11 | H.W. | MAINTAINED |
| PP-3 | EMERGENCY STOP | J-12 | H.W. | MAINTAINED |

TABLE VIII

MASTER CONTROL

| NO. | DESCRIPTION | LOCATION | ADDRESS |
|---|---|---|---|
| MCR-1 | MASTER CONTROL | J-13 | 11100 |

TABLE VIIII

LEVEL SWITCHES

| NO. | DESCRIPTION | LOCATION | ADDRESS |
|---|---|---|---|
| LL-1 | PRODUCT LEVEL | HOPPER | 11103 |
| LL-2 | BIN LEVEL | HOPPER | 11112 |

TABLE X

VACUUM SWITCHES

| NO. | DESCRIPTION | LOCATION | ADDRESS |
|---|---|---|---|
| VS-1 | PLACER VACUUM | PRESENTER | 11303 |

TABLE XI

CLOCK FACE TIMER & COUNTER

| NO. | DESCRIPTION | LOCATION | ADDRESS |
|---|---|---|---|
| TD1-1 | FILL CYCLE LIMIT | J-12 | 11111 |
| CTR1-1 | SPOUT ATTEMPT | J-12 | 11217 |
| CTR2-1 | LAYER COUNT | J-11 | 11407 |

(Light - 02207)
(Light - 02117)

TABLE XII

VALVE MANIFOLDS

| NO. | DESCRIPTION |
|---|---|
| MAN-1 | BAG PACKER |
| MAN-2 | PRESENTER |
| MAN-3 | SPOUTER |
| MAN-4 | PALLETIZER |

TABLE XIII

ELECTRIC MOTOR STARTERS

| NO. | DESCRIPTION | ADDRESS | TYPE |
|---|---|---|---|
| M-1 | LIFT FLATTENER | 02307 | SIZE 1 |
| M-2-F | BAG TAKEAWAY CONV. | 02406 | SIZE 1 REV. |
| M-2-R | BAG TAKEAWAY CONV. | 02407 | SIZE 1 REV. |
| M-3 | BAG MAGAZINE | 02310 | SIZE 1 |
| M-4 | BAG-TURNER-ROTATE | 02311 | SIZE 1 |
| M-5 | BAG-TURNER-CONV. | 02312 | SIZE 1 |
| M-6 | LAYER FORMING CONV. | 02313 | SIZE 1 |
| M-9 | BRIDGE CONVEYOR | 02314 | SIZE 1 |
| M-7 | PALLET ELEVATOR H.S. | 02403 | SIZE 1 |
| M-8-F | PALLET ELEVATOR L.S. | 02404 | SIZE 1 REV. |
| M-8-R | PALLET ELEVATOR L.S. | 02405 | SIZE 1 REV. |
| M-10 | FULL PALLET CONVEYOR | 02315 | SIZE 1 |
| M-11 | BLOWER | 02316 | SIZE 1 |
| M-12 | VAC. PUMP | 02317 | SIZE 1 |
| M-13 | ELEVATOR BRAKE | H.W. | SIZE 1 |
| M-14-F | PUSHER FORWARD | 02400 | SIZE 1 REV. |
| M-14-R | PUSHER REVERSE | 02401 | SIZE 1 REV. |
| M-15 | DISPENSER | 02401 | SIZE 1 |

TABLE XIIII

SOLENOID VALVES

| NO. | TYPE | DIRECTION | NO. OF SOL. | LOCATION | ADDRESS | FUNCTION |
|---|---|---|---|---|---|---|
| SV-1 | SPOOL | 4-WAY | 1 | MAN. 1 | 02000 | BAG CLAMP |
| SV-2 | SPOOL | 4-WAY | 1 | MAN. 1 | 02001 | BAG CHAIR |
| SV-3 | SPOOL | 4-WAY | 1 | MAN. 1 | 02002 | PINCH GATE |
| SV-4 | SPOOL | 4-WAY | 1 | MAN. 1 | 02003 | PROC. AIR |
| SV-5 | SPOOL | 4-WAY | 1 | MAN. 1 | 02004 | CHARGING |
| SV-6 | SPOOL | 4-WAY | 1 | MAN. 1 | 02006 | VENT VALVE |
| SV-7 | SPOOL | 4-WAY | 1 | MAN. 1 | 02007 | BEAM LOCK |
| SV-8 | SPOOL | 3-WAY | 1 | J-5 | 02005 | SPOUT PURGE |
| SV-11 | SPOOL | 4-WAY | 1 | MAN. 2 | 02100 | DESTACKER |
| SV-12a | SPOOL | 4-WAY | 2 | MAN. 2 | 02101 | CARRIAGE TRANS. MAG |
| SV-12b | SPOOL | 4-WAY | 2 | MAN. 2 | 02102 | CARRIAGE TRANS. PRES. |
| SV-13 | SPOOL | 4-WAY | 1 | MAN. 2 | 02103 | TILT ARM LIFT |

TABLE XIIII-continued

SOLENOID VALVES

| NO. | TYPE | DIRECTION | NO. OF SOL. | LOCATION | ADDRESS | FUNCTION |
|---|---|---|---|---|---|---|
| SV-14 | SPOOL | 4-WAY | 1 | MAN. 2 | 02104 | TILT ARM SWING |
| SV-15 | SPOOL | 4-WAY | 1 | MAN. 2 | 02105 | INDEXER |
| SV-16 | SPOOL | 4-WAY | 1 | MAN. 2 | 02106 | FENCE |
| SV-17 | SPOOL | 3-WAY | 1 | JBOX | 02116 | DESTACK VAC. PILOT |
| SV-18 | SPOOL | 3-WAY | 1 | JBOX | 02103 | TILT ARM VACUUM |
| SV-19 | SPOOL | 3-WAY | 1 | JBOX | 02201 | DESTACK. PURGE |
| SV-20 | SPOOL | 3-WAY | 1 | JBOX | 02202 | TILT ARM PURGE |
| SV-21 | SPOOL | 4-WAY | 1 | MAN. 3 | 02107 | PICKER |
| SV-22 | SPOOL | 4-WAY | 1 | MAN. 3 | 02110 | CALIPERS |
| SV-23 | SPOOL | 4-WAY | 1 | MAN. 3 | 02111 | OPENER |
| SV-24 | SPOOL | 4-WAY | 1 | MAN. 3 | 02112 | SWING |
| SV-25 | POPPET | 3-WAY | 1 | J7 | 02115 | PICKER VAC. |
| SV-26 PURGE | POPPET | 3-WAY | 1 | J7 | 02200 | PICKER |
| SV-31a | SPOOL | 4-WAY | 2 | MAN. 4 | 02210 | TURNER LIFT UP |
| SV-31b | SPOOL | 4-WAY | 2 | MAN. 4 | 02211 | TURNER LIFT DOWN |
| SV-32a | SPOOL | 4-WAY | 2 | MAN. 4 | 02214 | STRIPPER PLATE OPEN |
| SV-32b | SPOOL | 4-WAY | 2 | MAN. 4 | 02215 | STRIPPER PLATE CLOSED |
| SV-34 | SPOOL | 4-WAY | 1 | MAN. 4 | 02217 | LAYER SQUARING |
| SV-35a | SPOOL | 4-WAY/3 POS. | 2 | DISPENSER | 02212 | DISPENSER UP |
| SV-35b | SPOOL | 4-WAY/3 POS. | 2 | MAN. 4 | 02213 | DISPENSER DOWN |
| SV-36 | SPOOL | | | MAN. 4 | | |

TABLE XV

ALARM HORN

| NO. | DESCRIPTION | ADDRESS |
|---|---|---|
| AH-1 | ALARM HORN | 02304 |

TABLE XVI

TIMERS AND COUNTERS

| NO. | DESCRIPTION | ADDRESS | LOCATION | FUNCTION |
|---|---|---|---|---|
| TD1-C | CLUTCH | 02010 | J-12 | FILL CYCLE LIMIT |
| TD1-M | MOTOR | 02011 | J-12 | FILL CYCLE LIMIT |
| CTR-1- | CLUTCH | 02113 | J-12 | MIS-SPOUT |
| CTR-1 | COUNT | 02114 | J-12 | MIS-SPOUT |
| CTR-2 | CLUTCH | 02205 | J-11 | LAYER COUNT |
| CTR-3 | COUNT | 02206 | J-11 | LAYER COUNT |

TABLE XVII

RELAY COILS

| NO. | DESCRIPTION | ADDRESS | LOCATION |
|---|---|---|---|
| R-17 | AUTO. START | 02012 | J-5 |
| R-18 | AUTO. STOP | 02013 | J-5 |
| R-19 | AUTO. HOLD | 02014 | J-5 |
| R-20 | TURNER CL. | 02412 | J-13 |
| R-21 | TURNER CL. | 02413 | J-13 |

TABLE XVIII

BAG COUNT DISPLAYS (TTL)

| NO. | DESCRIPTION | ADDRESS | LOCATION |
|---|---|---|---|
| BCD-1 | ONES | 02600 | J-11 |
| BCD-2 | TWOS | 02601 | J-11 |
| BCD-3- | FOURS | 02602 | J-11 |
| BCD-4 | EIGHTS | 02603 | J-11 |
| BCD-5 | TEN | 02604 | J-11 |
| BCD-6 | TWENTY | 02605 | J-11 |
| BCD-7 | FOURTY | 02606 | J-11 |
| BCD-8 | EIGHTY | 02607 | J-11 |
| BCD-9 | STROBE-UNIT | 02700 | J-11 |
| BCD-10 | STROBE-TENS | 02701 | J-11 |

TABLE XVIIII

PILOT LIGHTS

| NO. | TYPE | COLOR | ADDRESS | LOCATION | FUNCTION |
|---|---|---|---|---|---|
| PL-1 | ILLUM. | AMBER | 02203 | J-12 | LOW BAGS |
| PL-2 | ILLUM. | AMBER | 02204 | J-12 | NO BAGS |
| PL-3 | ILLUM. | AMBER | 02300 | J-11 | PALLETIZER MALFUNCTION |

TABLE XVIIII-continued

| PILOT LIGHTS | | | | | |
|---|---|---|---|---|---|
| NO. | TYPE | COLOR | ADDRESS | LOCATION | FUNCTION |
| PL-4 | ILLUM. | RED | 02301 | J-11 | BAG ACCUM. FULL |
| PL-5 | ILLUM. | AMBER | 02302 | J-11 | LAST LAYER FORMED |
| PL-6 | ILLUM. | AMBER | 02303 | J-11 | PALLET INFEED EMPTY |
| PL-7 | ILLUM. | RED | 02410 | J-11 | PLACER SHUT-DOWN |
| PL-8 | ILLUM. | RED | 02411 | J-11 | PACKER SHUT-DOWN |
| IPB-1 | ILLUM. PB | AMBER | 02207 | J-11 | CLEAR |
| IPB-2 | ILLUM. PB | AMBER | 02117 | J-11 | LOAD |
| IPP-1 | ILLUM. PP | RED | H.W. | J-13 | EMERGENCY STOP |
| IPP-2 | ILLUM. PP | RED | H.W. | J-11 | EMERGENCY STOP |
| IPP-3 | ILLUM. PP | RED | H.W. | J-12 | EMERGENCY STOP |
| PL-9 | ILLUM. | GREEN | H.W. | J-13 | POWER ON |
| PL-10 | ILLUM. | GREEN | H.W. | J-11 | POWER ON |
| PL-11 | ILLUM. | GREEN | H.W. | J-12 | POWER ON |

TABLE XX

| THUMBWHEEL SWITCH INPUTS | | |
|---|---|---|
| DESCRIPTION | FUNCTION | ADDRESS |
| BCD THUMBWHEEL | BAG COUNT 1 | 12500 |
| BCD THUMBWHEEL | BAG COUNT 2 | 12501 |
| BCD THUMBWHEEL | BAG COUNT 4 | 12502 |
| BCD THUMBWHEEL | BAG COUNT 8 | 12503 |
| BCD THUMBWHEEL | BAG COUNT 10 | 12504 |
| BCD THUMBWHEEL | BAG COUNT 20 | 12505 |
| BCD THUMBWHEEL | BAG COUNT 40 | 12506 |
| BCD THUMBWHEEL | BAG COUNT 80 | 12507 |

Figure 35:
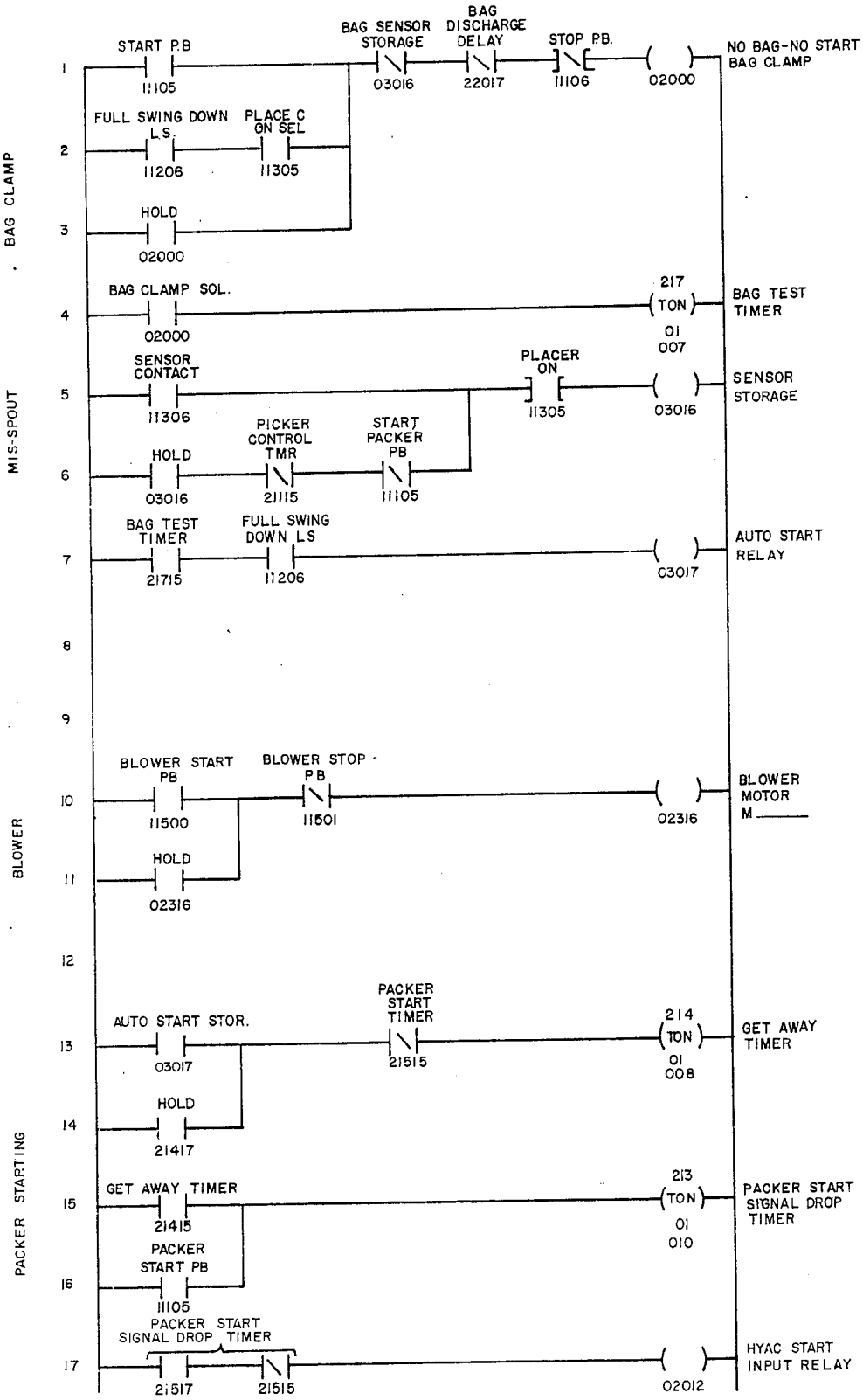
FIGS. 35 through 55 are schematic representations of the operating logic of the invention.
Figure 36:
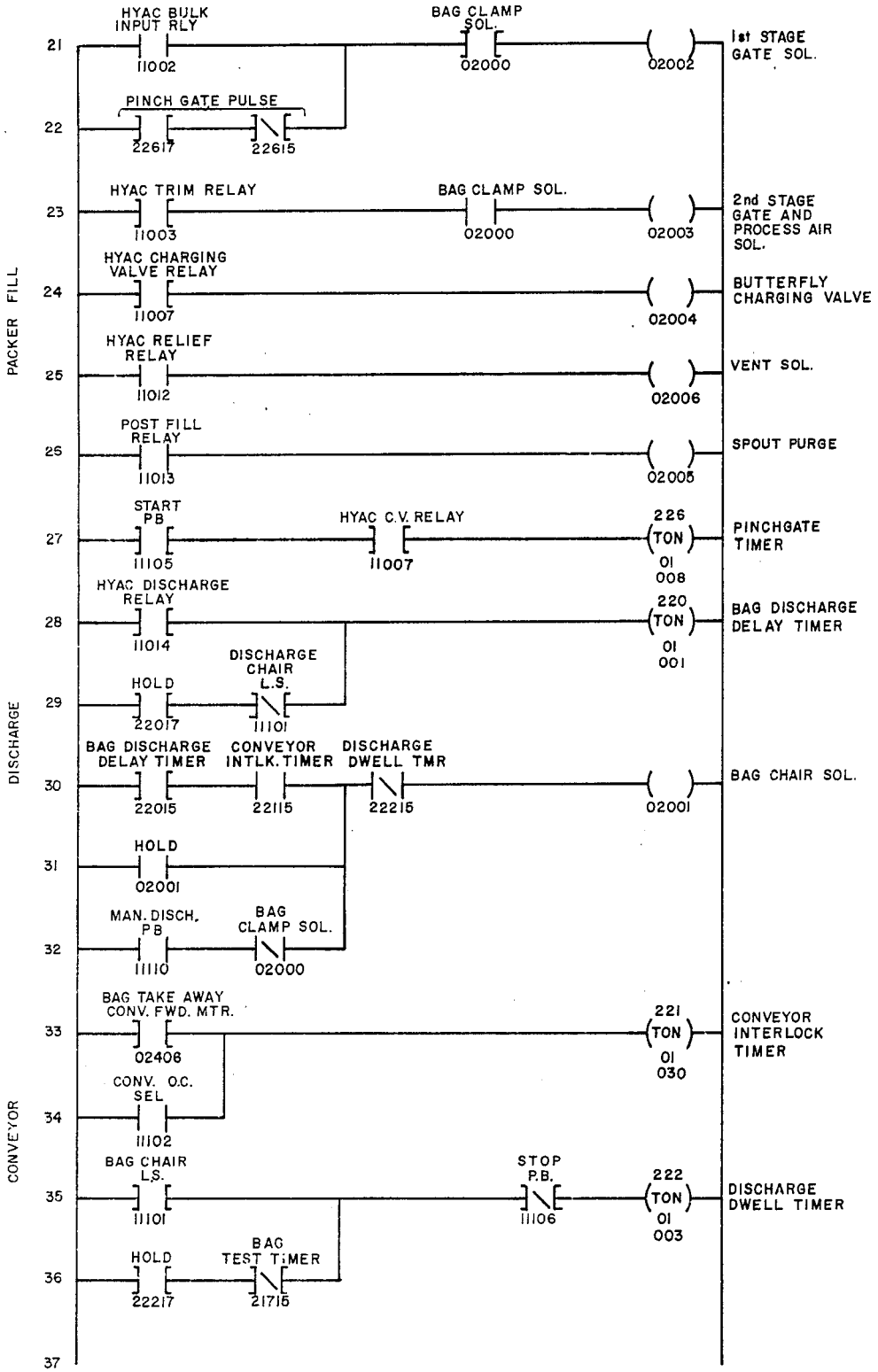

By way of example, referring first to the top portion of FIG. 35 and specifically at the flow paths labelled 1, 2 and 3 along the left vertical column of the logic diagram of FIG. 35, it will be seen that these paths relate specifically to the operation of the bag clamp or bag sensor discussed above. Although most of the devices illustrated in a logic flow path normally constitute input devices, that is, switch closures of various kinds, the passage of signal from the left side to right side of a logic diagram in a particular path may in fact also include the condition of output devices. For example, the output of one path may be one of the component conditions for the signal flow through another path. This is illustrated in flow path No. 1 which relates to the bag clamp or bag sensor apparatus. More specifically, at path No. 1 of FIG. 35 it will be seen that the flow path includes the following components; the packer start push-button having input address 11105, a storage location entitled bag sensor and having the address 03016, an output referred to as the bag discharge delay and having an address 22017 and a stop push-button input having an address 11106. The output of this particular path has an address of 02000 and is labelled NO BAG, NO START BAG CLAMP along the right vertical line at the termination of flow path 1.

It will be observed that unlike the representation of the packer start push button input address 11105 at the leftmost portion of path No. 1, the other signal conditions represented in path No. 1 each has a "/" which represents the logical NOT condition. From a logic standpoint the serial representation of component conditions in a flow path represents a Boolean logic equation in which each of the serial conditions must exist simultaneously. Thus serial flow represents an AND gate.

Path No. 1 at the top of FIG. 35 may be deemed to represent a Boolean logic statement of conditions required to produce output 02000 which corresponds to a no bag, no start status. These conditions are that the packer start button be depressed, that the bag sensor storage location store a logic zero at that location, that the bag discharge delay output be in a zero condition and that the stop push-button be in a 0 condition. If the status of these various conditions satisfies the equation represented by path No. 1 of FIG. 35, then the output 02000 will be a logical one corresponding to a no bag, no start condition. It will also be observed at the topmost portion of FIG. 35 that paths 2 and 3 are shown in parallel with a portion of path No. 1, more specifically, in parallel with the start push-button input of path No. 1.

Path No. 2 includes two input conditions. One such condition is that the appropriate limit switch, namely, LS11 as seen in Table I, representing a full swing down condition of the picker spouter apparatus, is and another condition is that the selector switch for activating the placer, namely, SS4 as seen in Table III, is also in the positive or activated condition. Since these two inputs, namely input address 11206 and 11305 are in series, they constitute an AND statement. However, because they are in parallel with the start packer push-button condition, address 11105 of path 1, they are in fact OR'd with activation of the start packer push-button. Thus, if the input conditions corresponding to address 11206 and 11305 are simultaneously in a one state, then the logic condition of the push-button starter address 11105 is not relevant. The same OR relationship exists with respect to the input condition represented by flow path 3. More specifically, as seen in FIG. 35, path 3 has the single condition represented by the output 02000 in a hold configuration. This will be understood to mean that once the 02000 output of path No. 1 is in a logical one state, that logic state is held and constitutes an OR function with respect to the push-button start condition of path 1 and the conditions of path 2.

Thus reviewing the status of signal flow represented by paths 1, 2 and 3, it will be seen that the no bag, no start output remains or becomes a logic one in the event that the packer start push-button is depressed or alternatively, the limit switch for the picker spouter apparatus indicates a full swing down condition and the placer on selector switch is on, or the no bag, no start output has been held from a previous positive condition and the bag sensor storage is zero, the bag discharge delay is zero and the packer stop push-button is zero.

Figure 5:
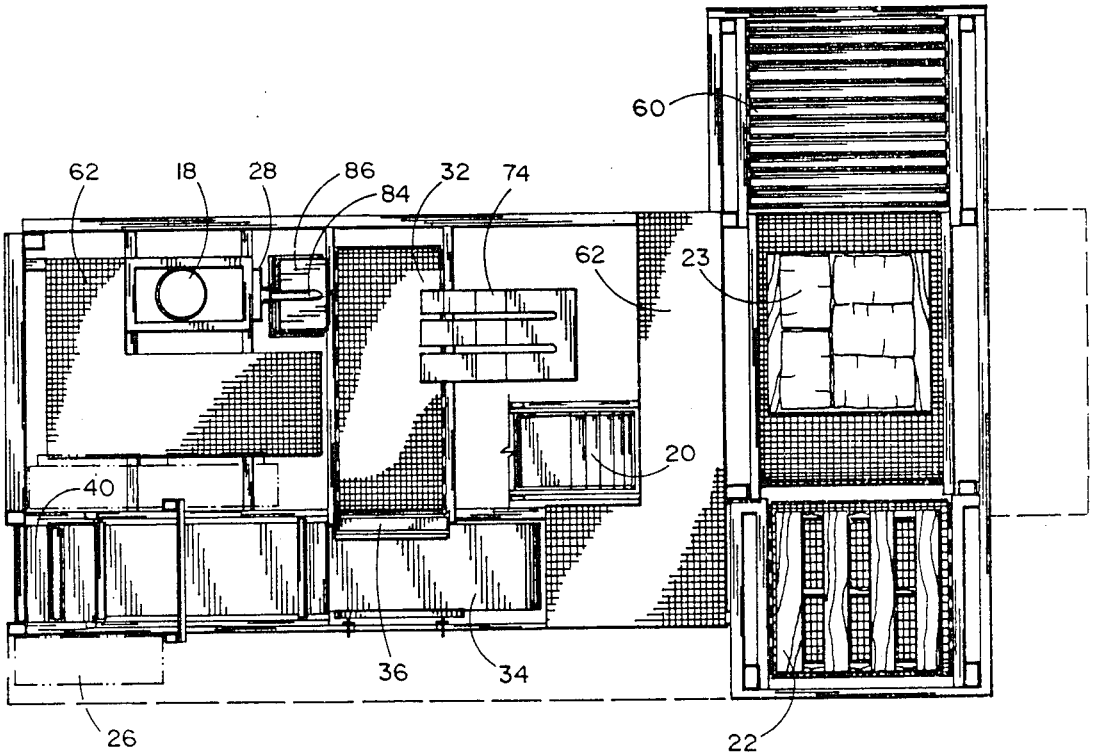
FIG. 5 is a top view of the present invention with the upper section thereof removed.

Referring next to path No. 4 at the top of FIGS. 3 and 5, it will be seen that the output of this path is a bag test timer. More specifically, if the output 02000 of data path 1 is one, then a timer is initiated and that timer is represented by the symbol TON shown in rightmost portion of path 4 of FIG. 35. The number above the timer symbol is the number of the timer. Each timer has an address or number associated with it. There are two sets of numbers below the timer representation, a two digit number and a three digit number. The two digit number represents the timing rate of the timer. Thus for example, in the specific illustration of data path 4, the two digit number 01 represents a rate of tenths of seconds. If the number were instead 10 that would represent a rate of seconds. The three digit number represents the timing period. Thus for example, 007 corresponds to a total period of 7, indicating that the total timing period of this timer is 0.7 seconds in tenths of a second increments.

It will be seen in the logic diagrams of FIGS. 35 through 53 that there are two types of timers, those labelled TON such as the timer shown in path 4 of FIG. 35 and those labelled TOF. A TON timer is a timer having ON display. In other words, the timing begins upon coil activation and is reset upon coil deactivation for a subsequent timing period. THus, as an example in path 4 of FIG. 35, as soon as the output 02000 corresponding to the bag clamp solenoid becomes positive, timer 217 begins timing through a period of 0.7 seconds in tenths of a second increments. On the other hand, the TOF timer is a "time off delay", that is, a timer which starts at coil deactivation and is reset at coil activation. Thus for example, in path No. 4 of FIG. 35, if timer 217 had been a timer off delay instead of a timer on delay, as long as the output 02000 was positive and the bag clamp solenoid was activated, the timer would remain ready to time but not yet into its timing cycle. However, as soon as the 02000 output went to zero and the bag clamp solenoid was deactivated, the timer would then activate for a period of 0.7 seconds in tenths of a second increments assuming the digits below the timer symbol were the same as that shown in FIG. 35.

The output of a data path which includes a timer, of either the TON or TOF type, is a timer signal which is then used in other paths in the logic circuitry. There are a number of different ways in which the output of a path including a timer may be used in the other paths of the logic circuitry. More specifically, a contact closure or equivalent thereof can be based upon the beginning of a timer timing period, the end of a timer timing period or a specific timer "time" between the beginning and the end of a timer period. Furthermore, each of these timer representations, beginning, end and intermediate time, can be used to constitute the equivalent of a switch closure or switch opening. Thus for example, it will be observed that path 17 at the bottom of FIG. 35 utilizes two logic closure conditions, one with an address of 21517 and one with the address 21515. The first three digits of each of those addresses, namely the 215, corresponds to a particular timer. In this instance, timer 215 is shown in the path 15 of FIG. 35. The remaining two digits, 17 and 15, respectively, indicate the nature of the closure with respect to the timer. More specifically, the digits 17 comprising the last two digits of the switch closure on the left of path 18, indicate an immediate switch closure at the beginning of the timing sequence of timer 217. On the other hand, the two digits 15 comprising the last two digits of the address of the second closure element of path 17, indicate a logic operation that takes place at the termination of the timing sequence of timer 215. In this instance, the timing period is one second because timer 215 increments in tenths of seconds through ten increments. Furthermore, because the symbol having the address 21515 in path 17 is a NOT function, the representation corresponds to a switch opening occuring at the termination of the timing sequence 215. As a result, it can be seen that the combination of the two switch functions represented by address 21517 and 21515 in series in the path 17 of FIG. 35, produces a pulsed output of one second in length beginning at the beginning of the timing sequence for timer 215 and terminating at the termination of the timing sequence for timer 215.

Figure 37:
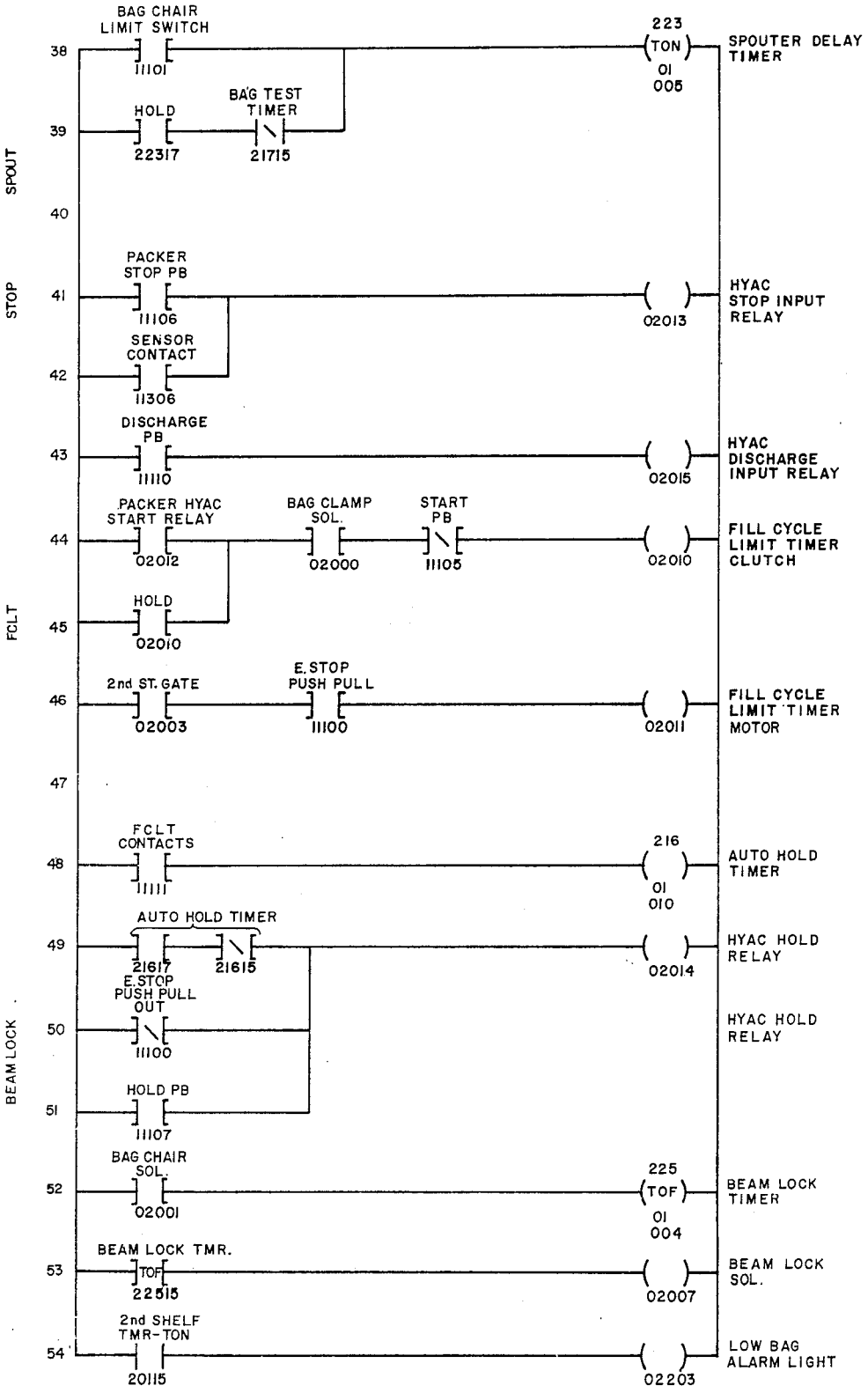
Figure 38:
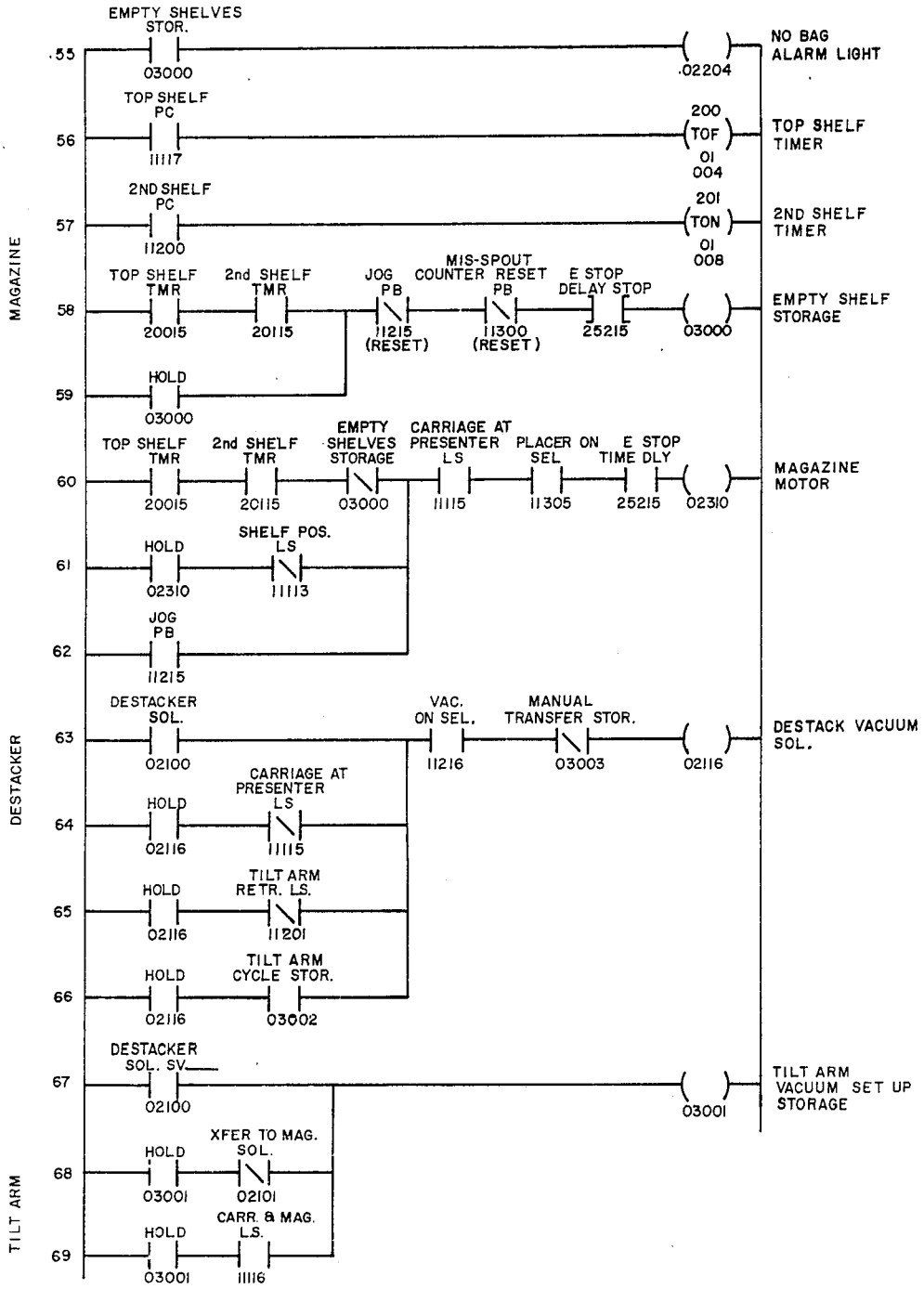
Figure 39:
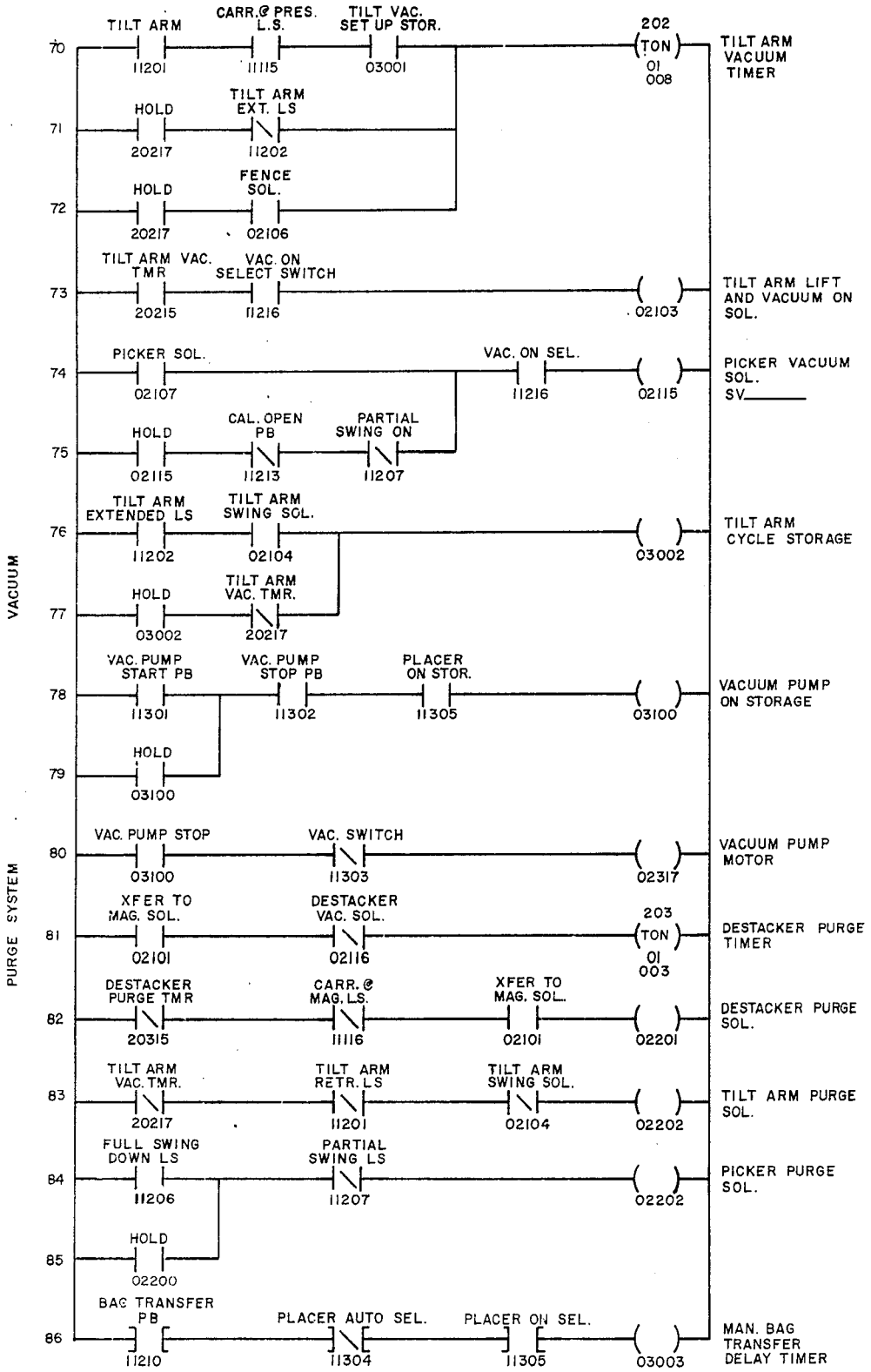
Figure 40:
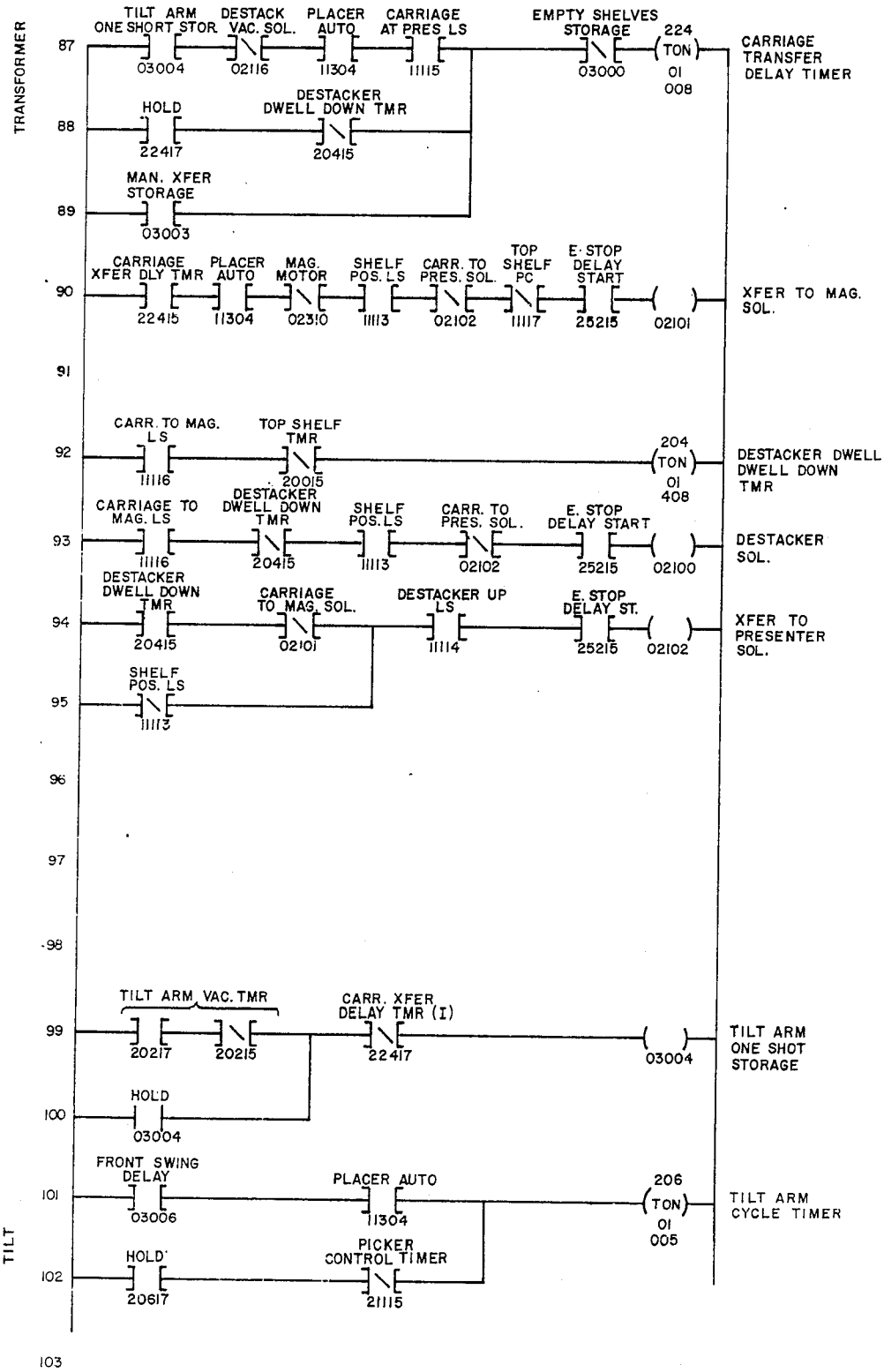
Figure 41:
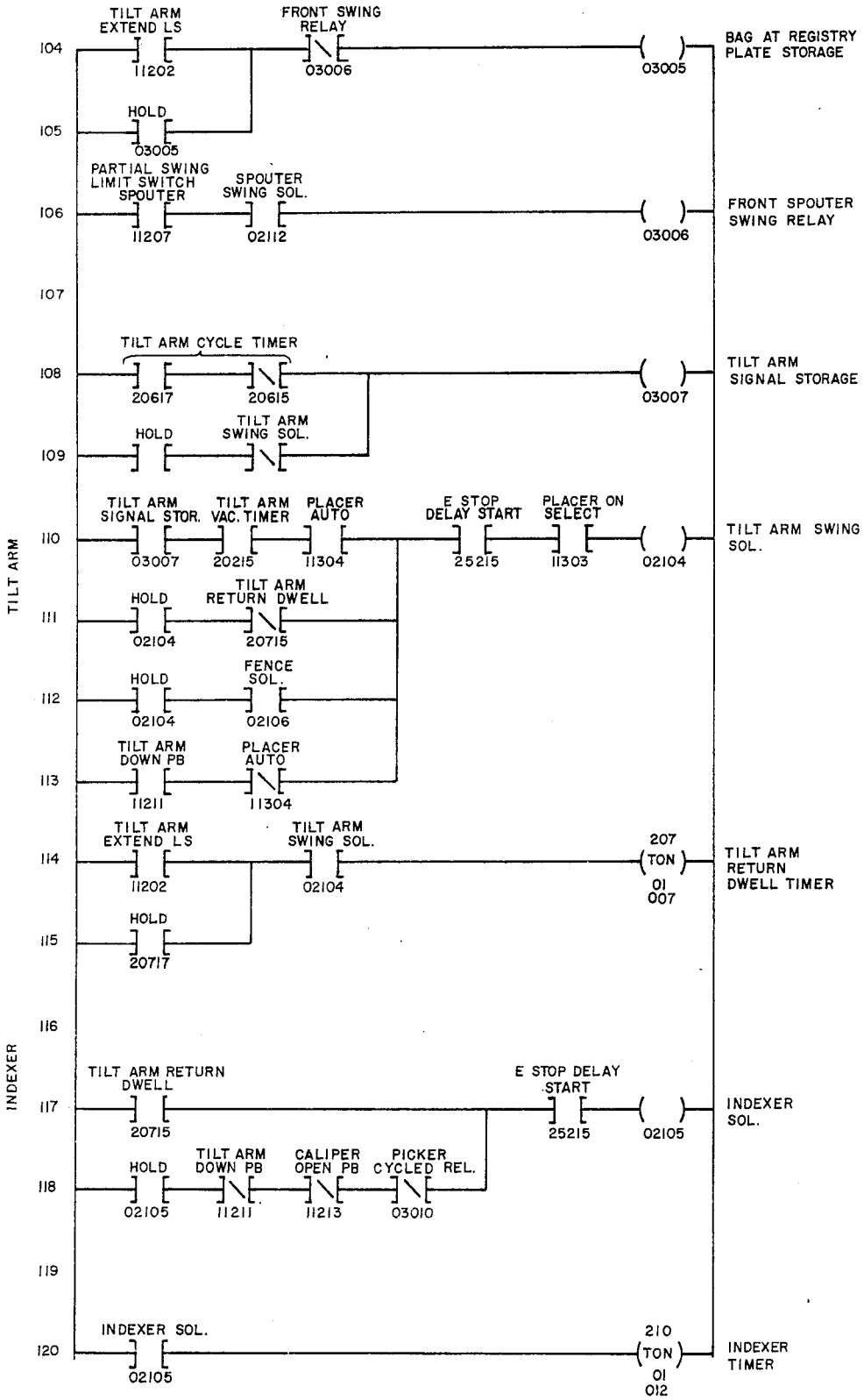
Figure 42:
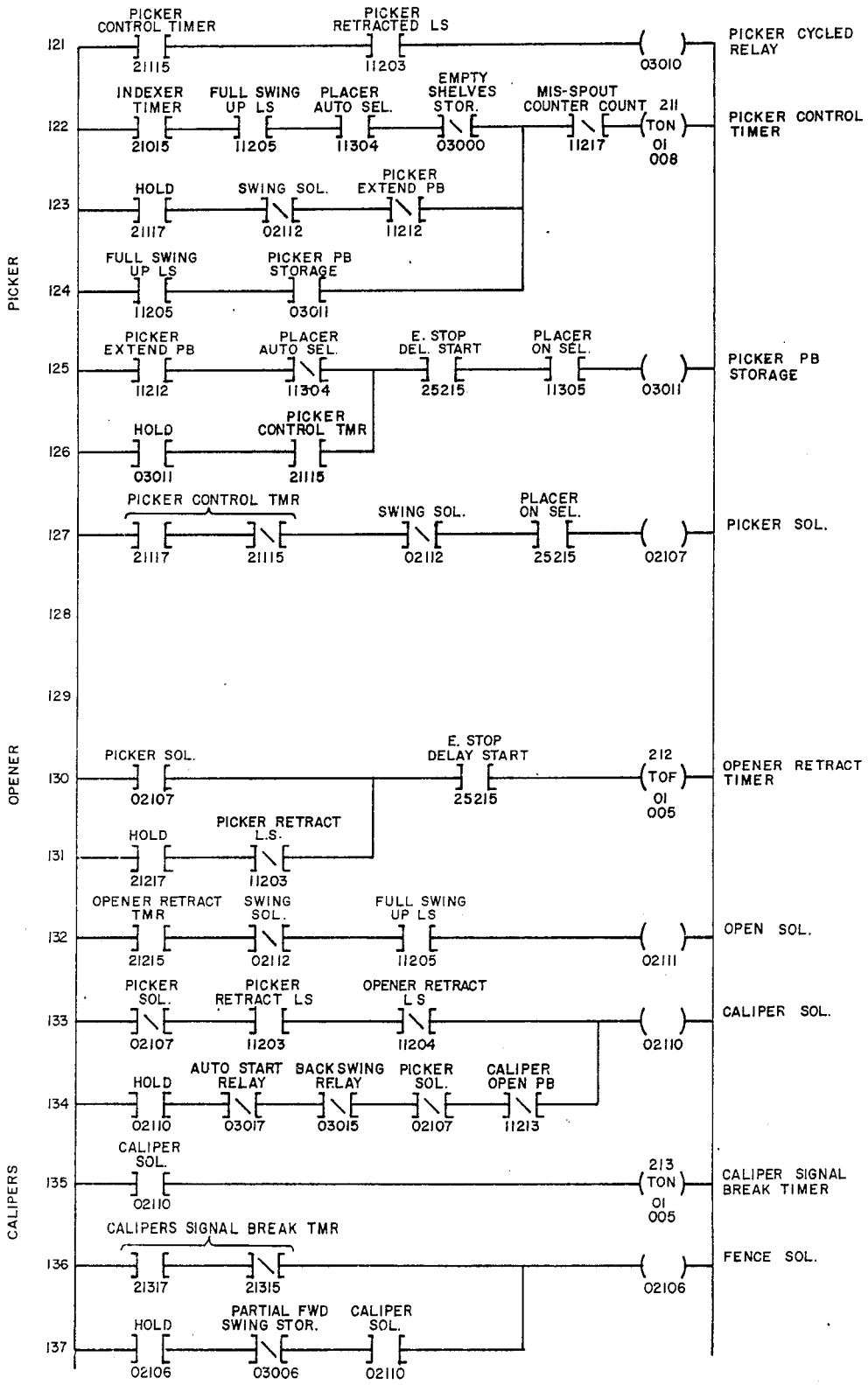
Figure 43:
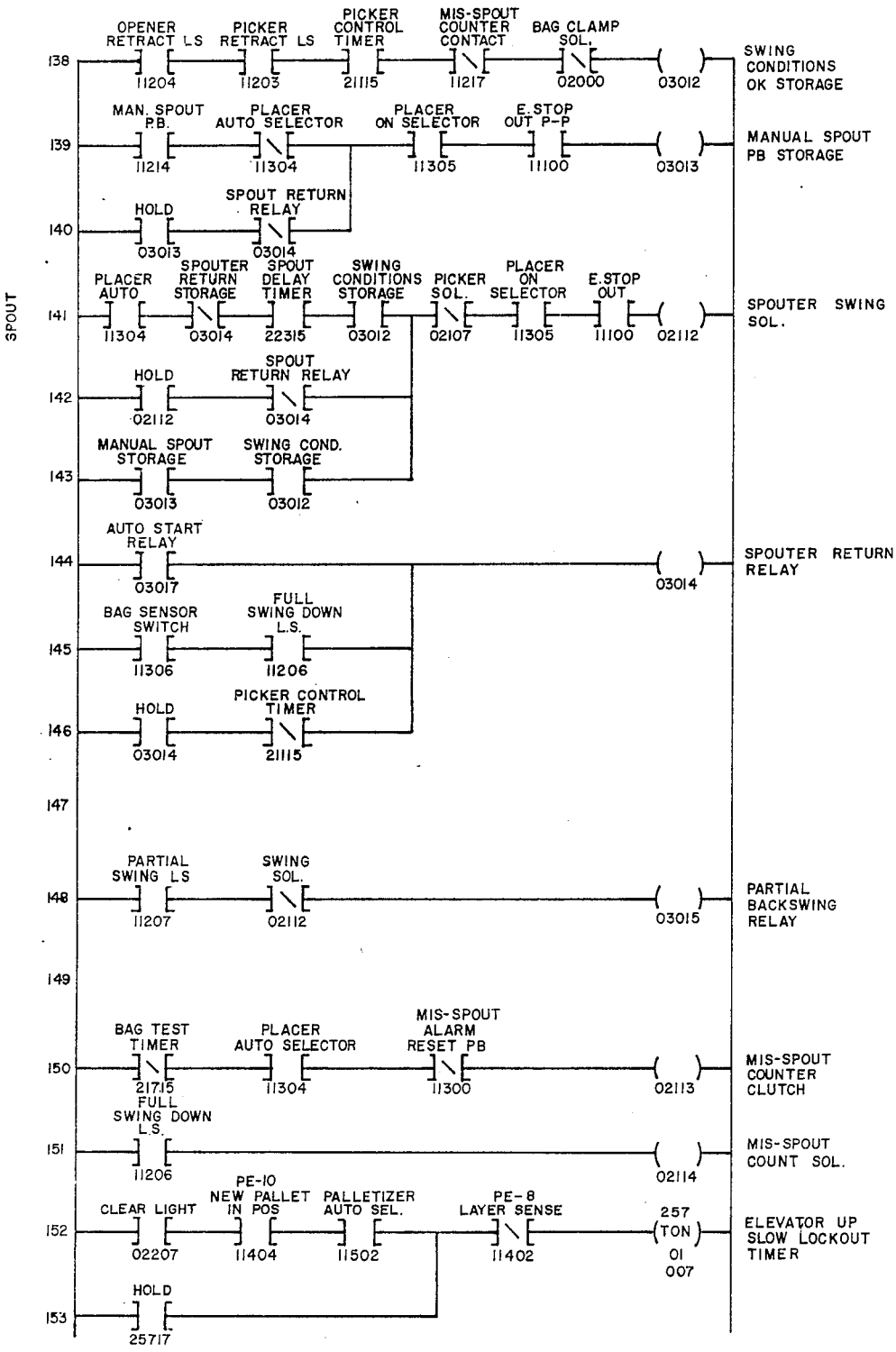
Figure 44:
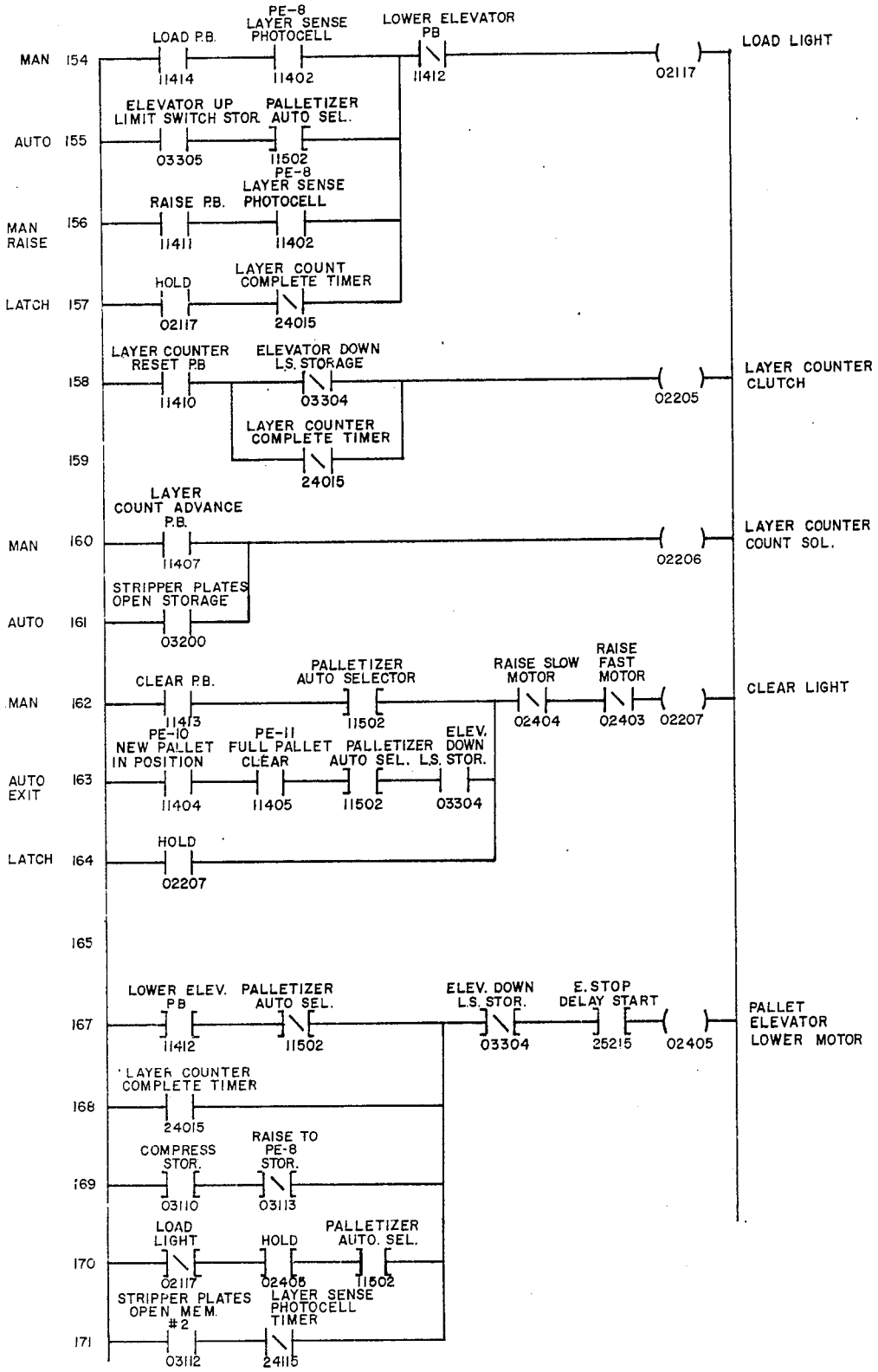
Figure 45:
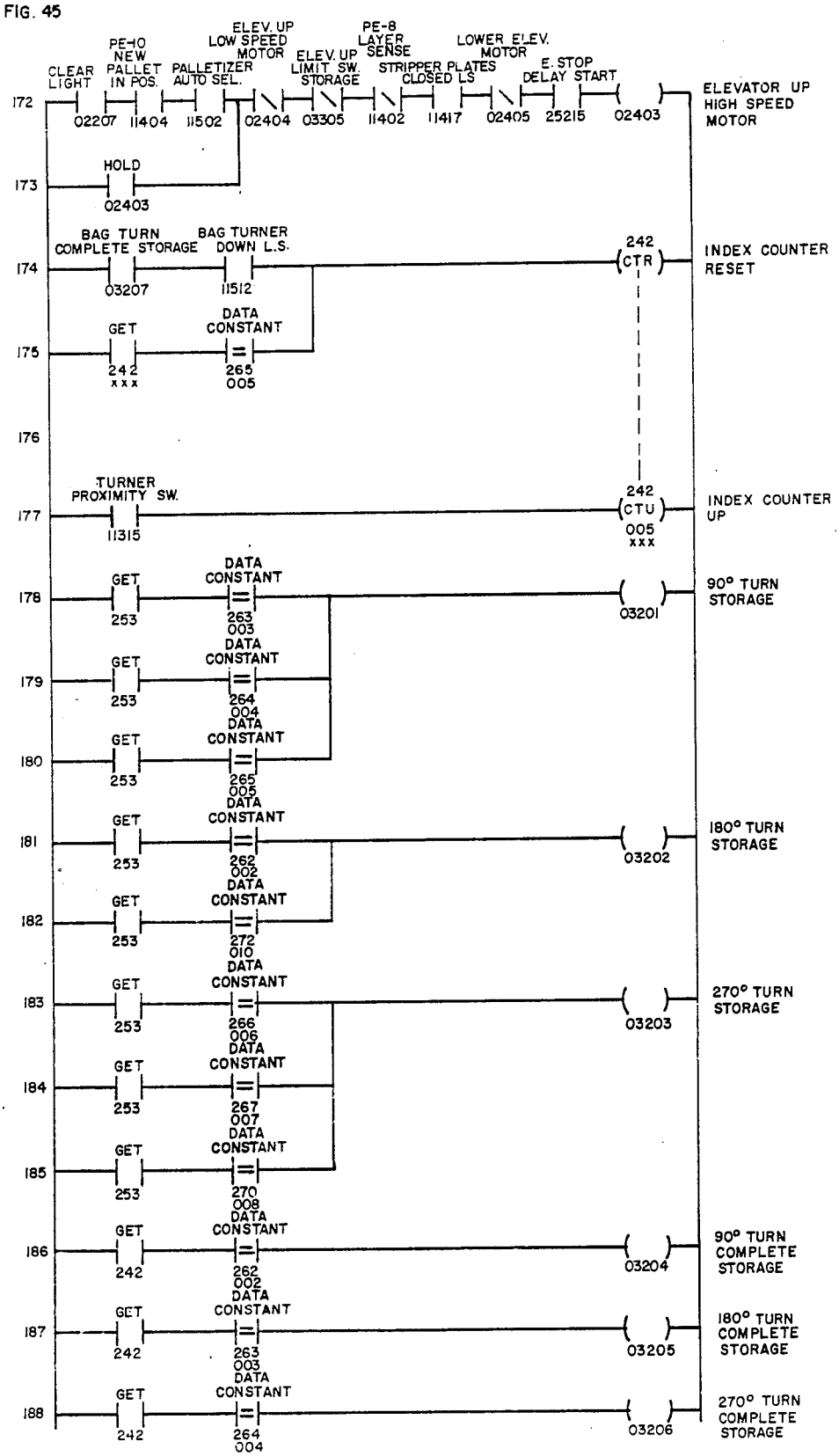
Figure 46:
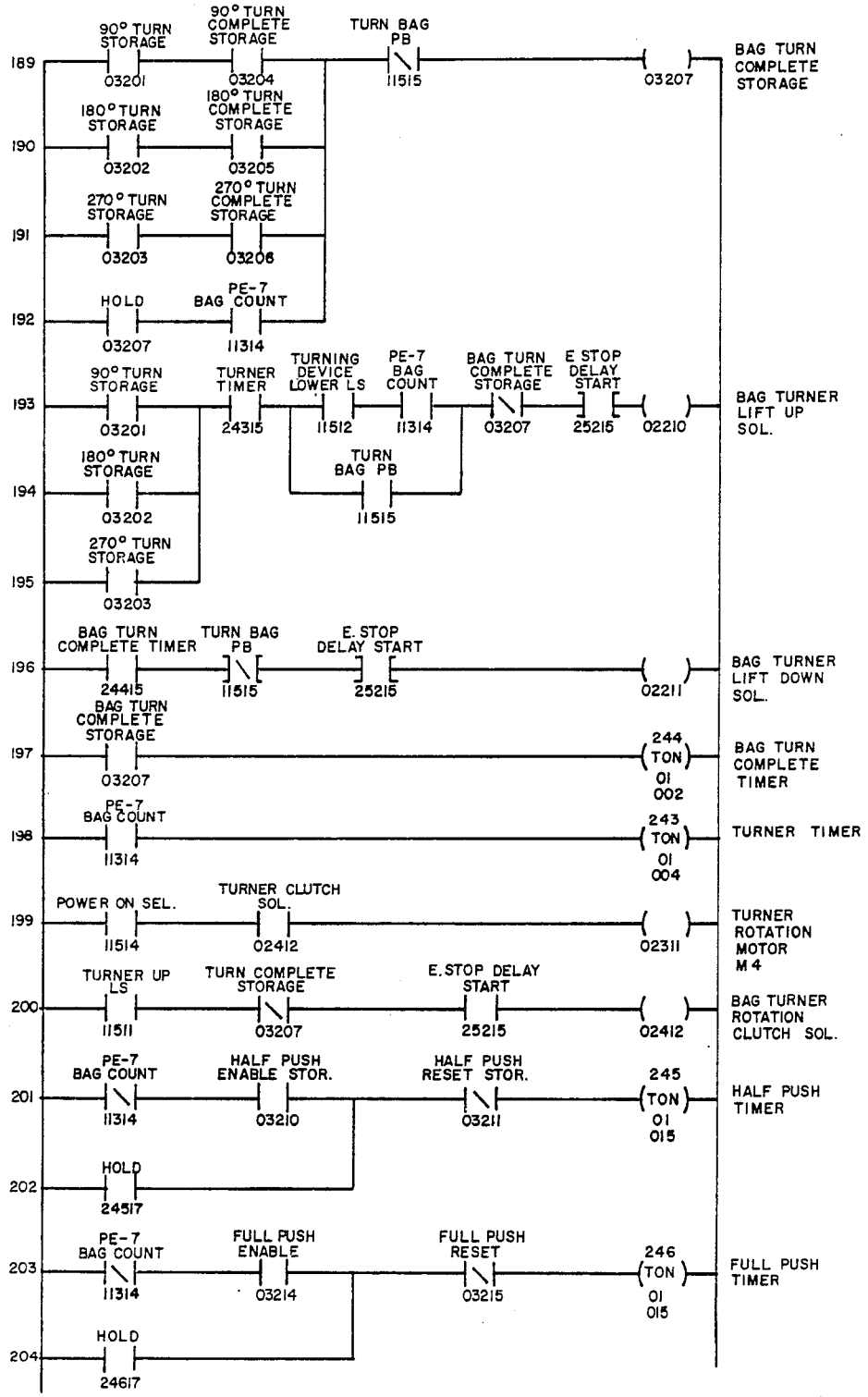
Figure 47:
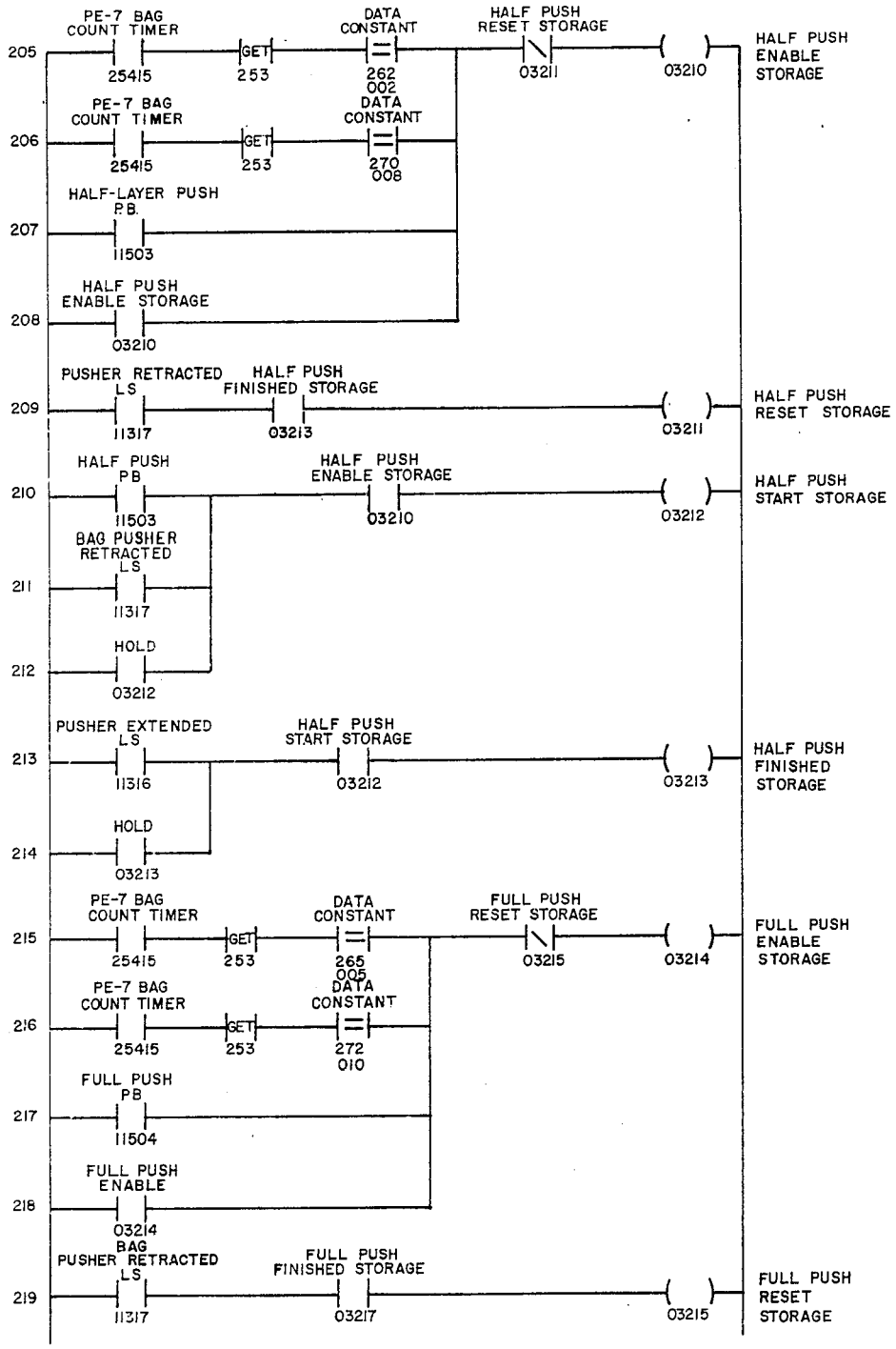
Figure 48:
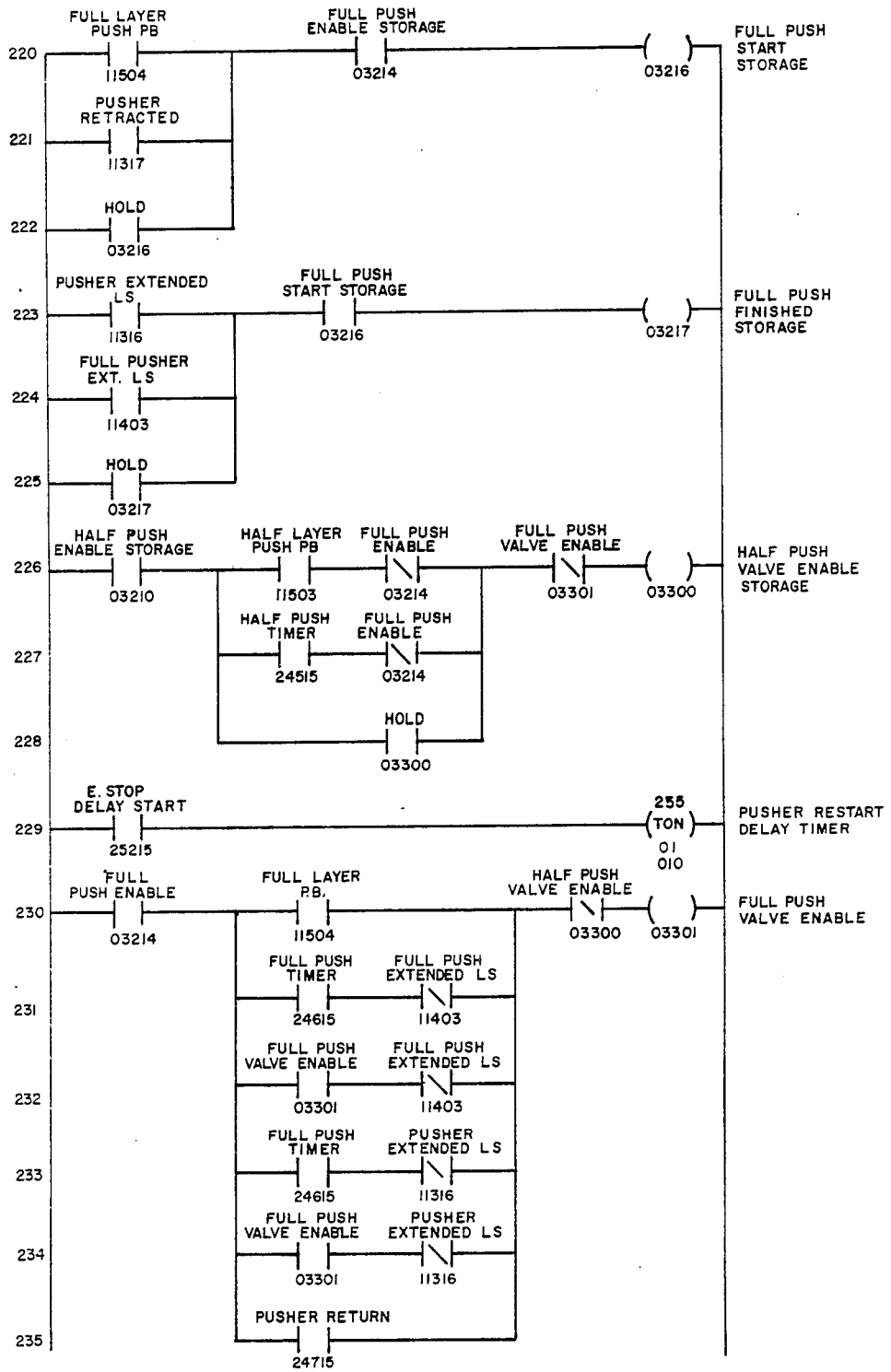
Figure 49:
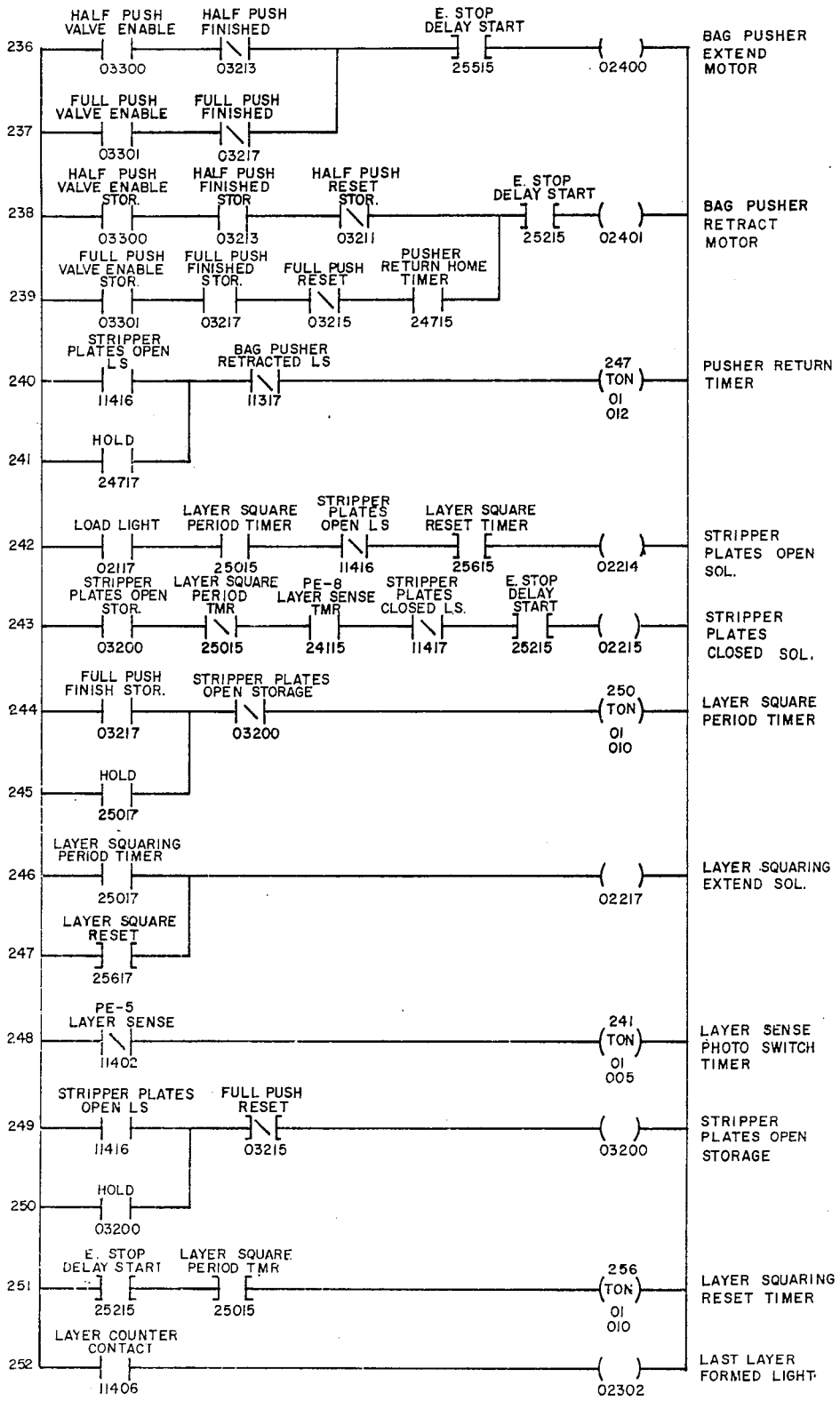
Figure 50:
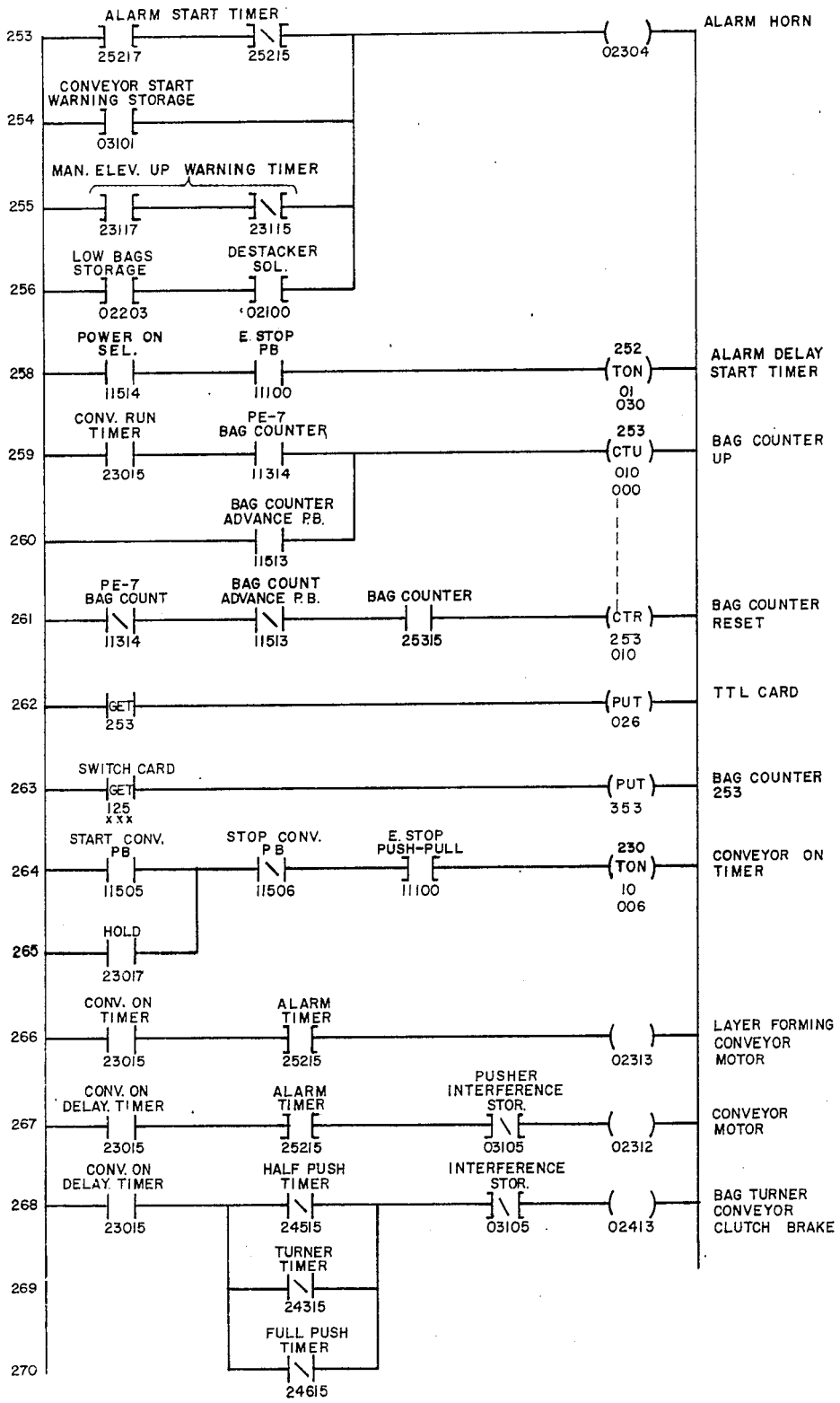

Of course the symbols corresponding to a contact closure occuring at the beginning or ending of a timing sequence of an addressed timer do not have to be used in series to create a pulse. They can instead be used independently of one another to simply initiate a contact closure or a comparable switch operation at the beginning of or end of a timing sequence. One example is illustrated in FIG. 37 along paths 52 and 53. More specifically, as seen in path 52, a timer off delay, that is a TOF timer having the number 225 is shown in path 52 in series with the switch closure corresponding to the bag chair solenoid address 02001. As previously indicated, the nature of a TOF timer is to begin the timing sequence at coil deactivation. Thus, after the bag chair solenoid switch closure has been activated and then subsequently deactivated, timer 225 will begin timing for 0.4 seconds at 0.1 second increments. In path 53 there is a logic operation having the address 22515. This corresponds to a switch closure responsive to timer 225 of logic path 52. Because the last two digits of this device are 15, a logic one condition is generated after timer 225 has completed its timing sequence. Thus an output is generated at logic path 53, that output having the address 02004 0.4 seconds after the bag chair solenoid has been reset.

Still another timer-related function that is used throughout the logic diagram of FIGS. 35 through 53 is the GET function. This is the equivalent of a switch closure which occurs when a timer has reached a particular timing interval or a counter has reached a particular count interval. The GET function thus creates an equivalent momentary switch closure or alternatively a logical one when either of these two conditions occurs in a timer or counter, respectively, with which the GET function is associated as indicated in the logic diagrams. By way of example, paths 297, 298 and 299 of FIG. 51 each includes a GET function associates with timer 230 which is the conveyor ON timer identified in logic path 268 of FIG. 49. As seen in path 268 of FIG. 49, timer 230 counts in second increments up to a total elapsed timer of six seconds.

Figure 51:
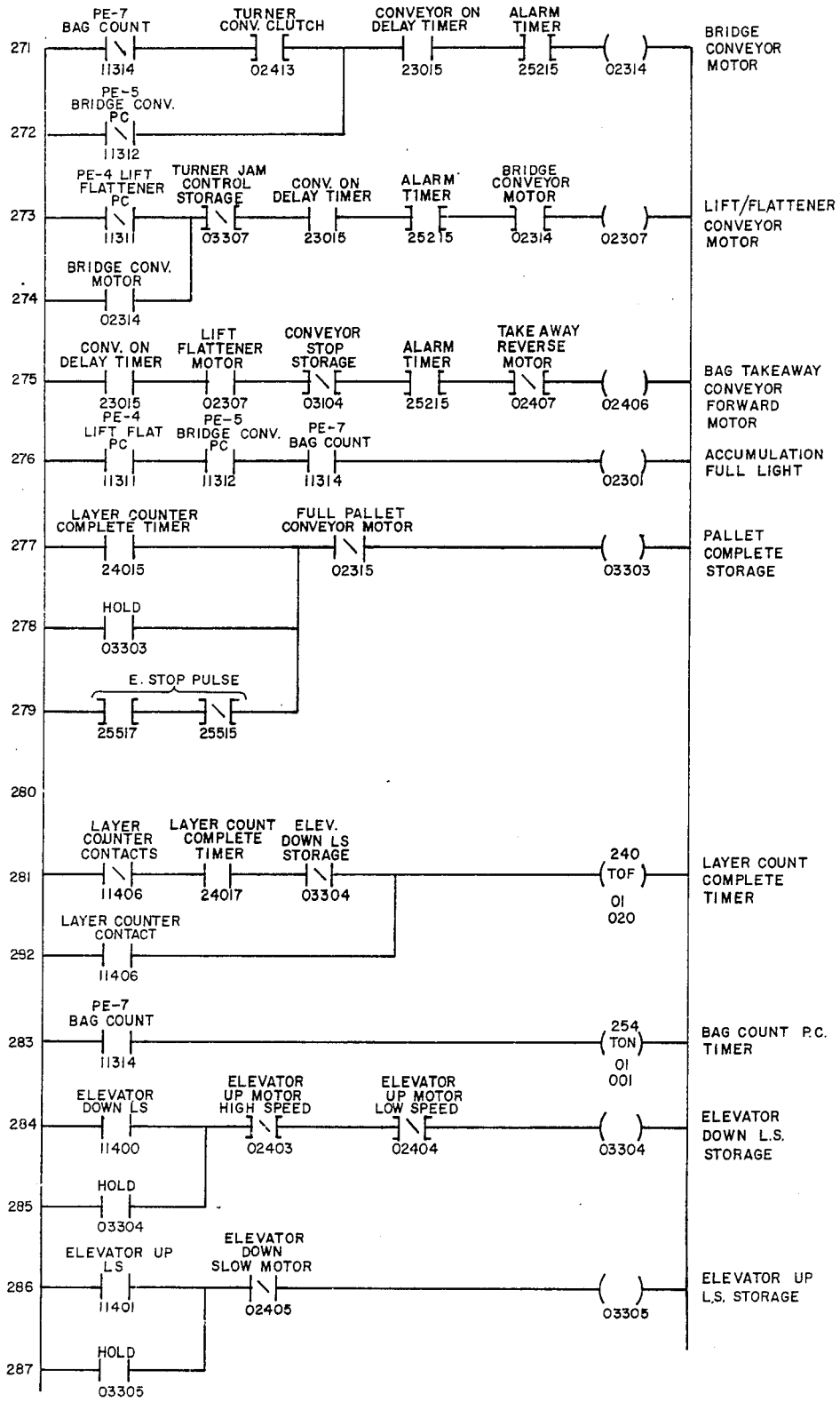
Figure 52:
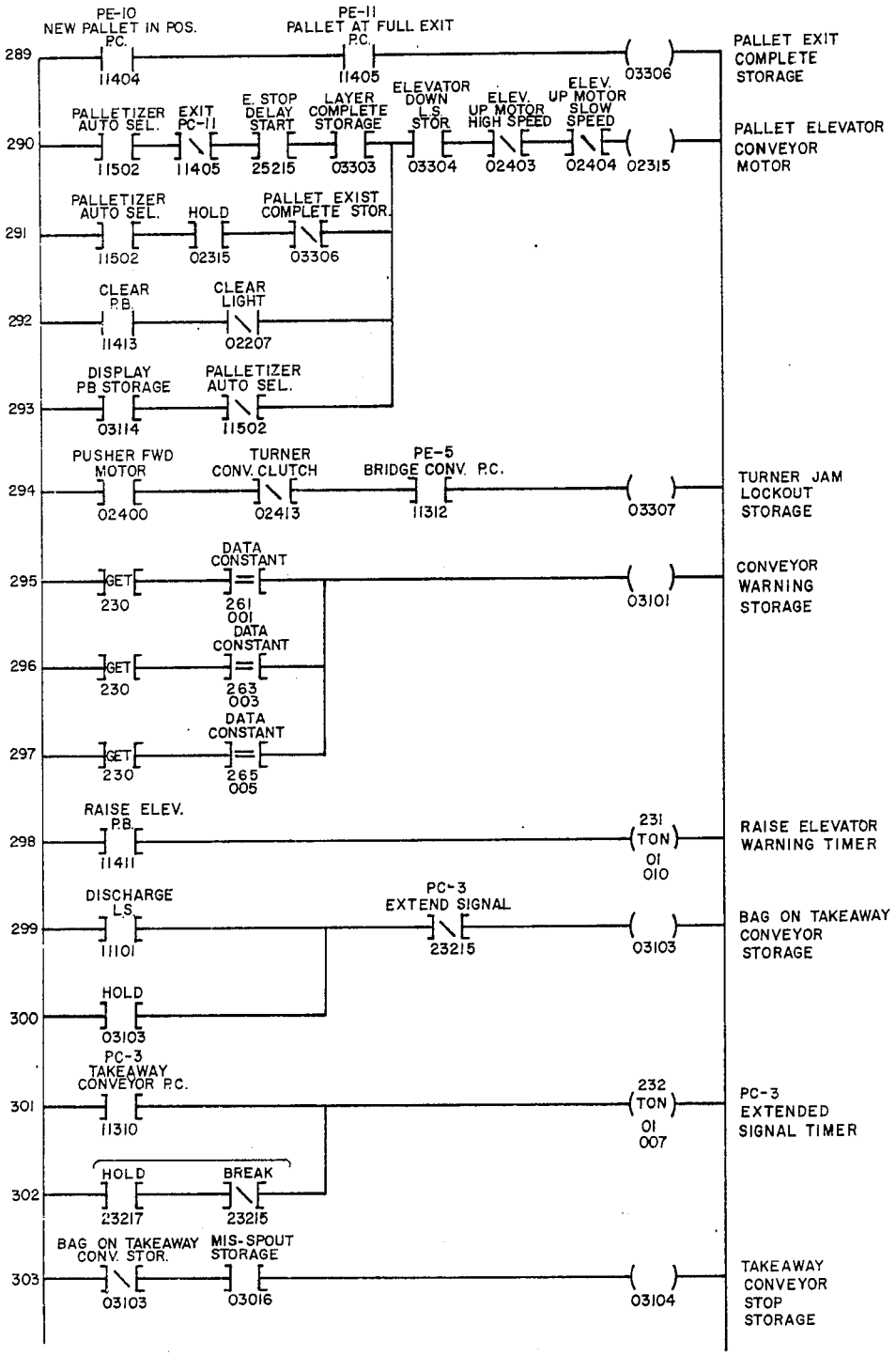
Figure 53:
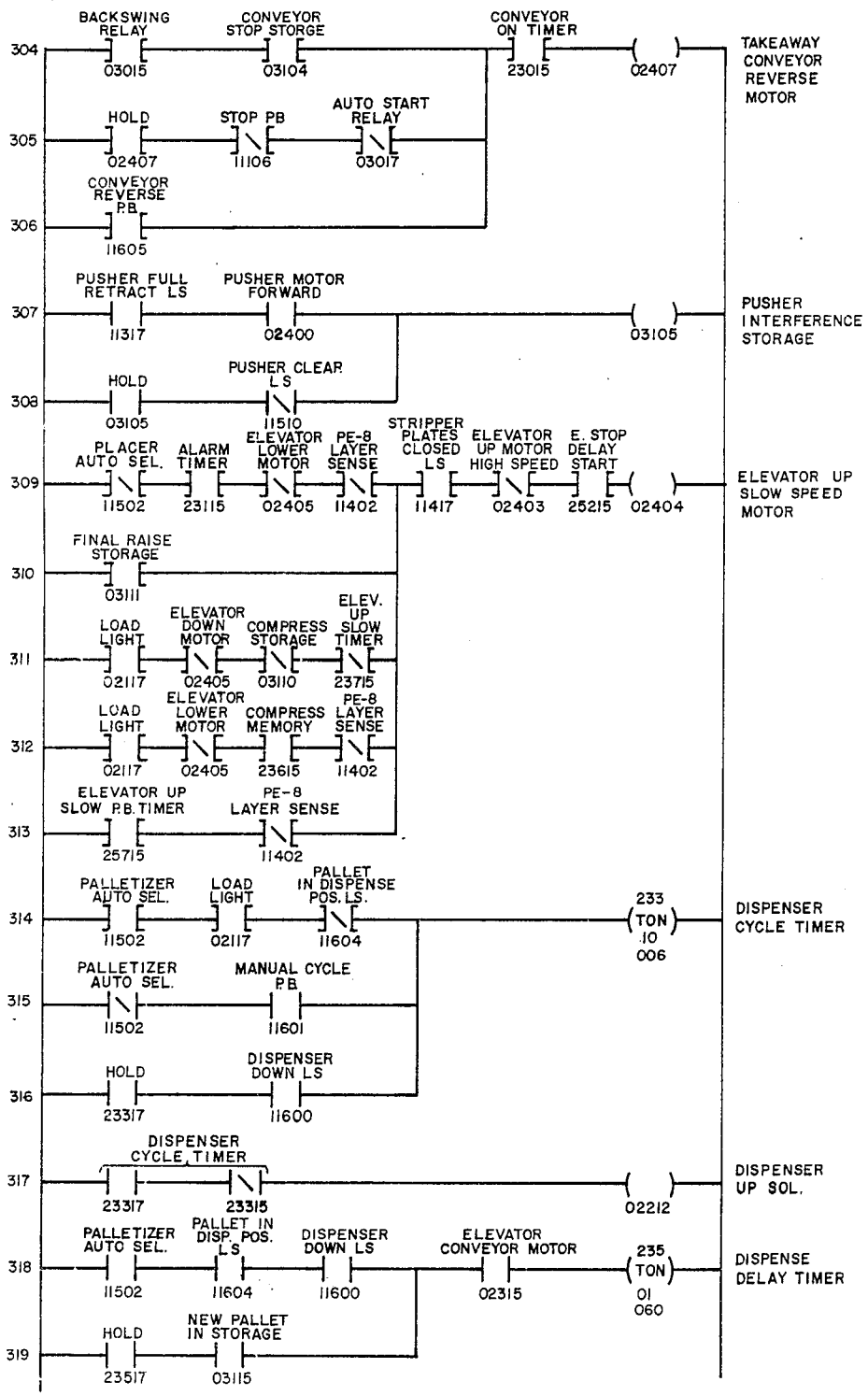
Figure 54:
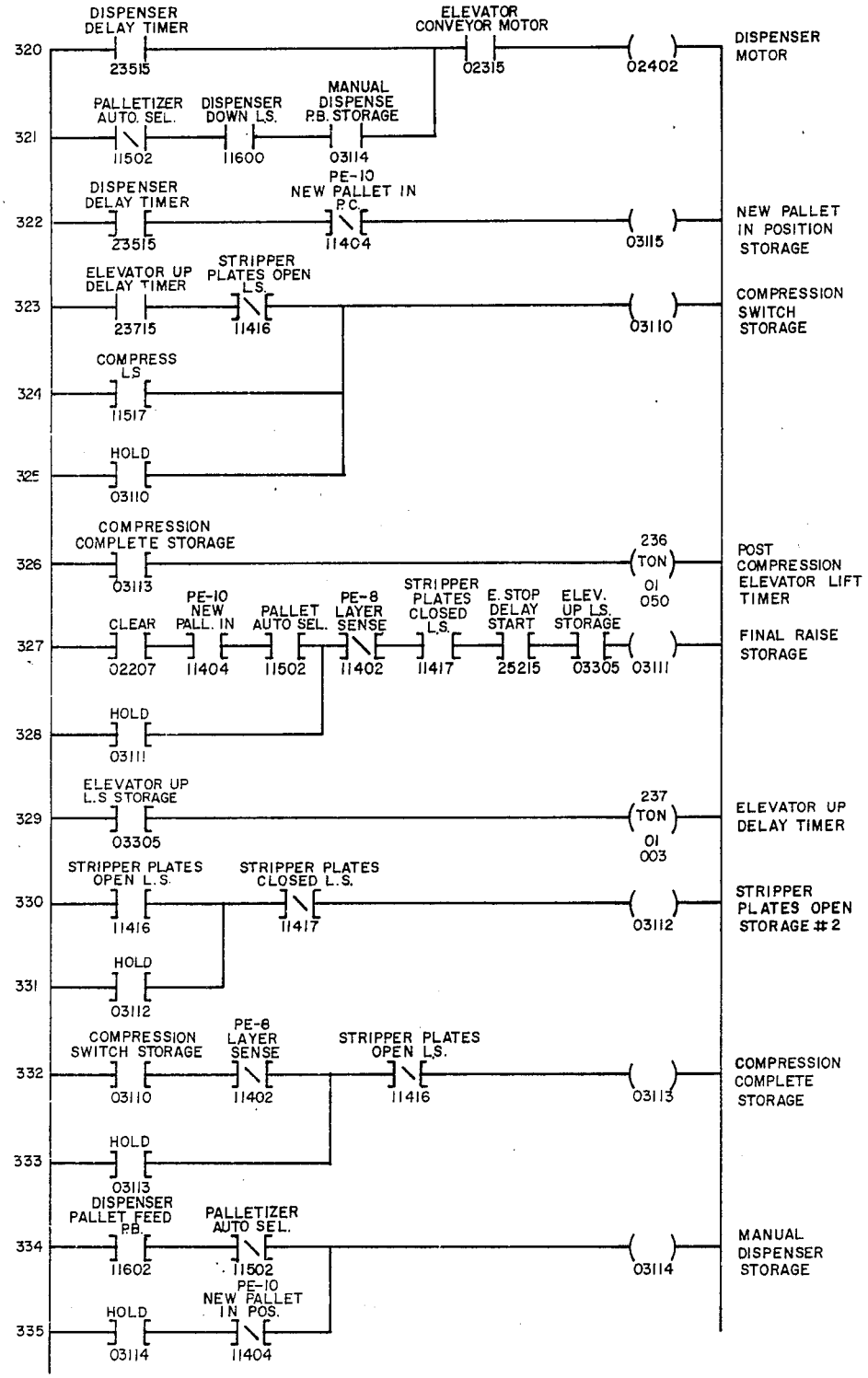
Figure 55:
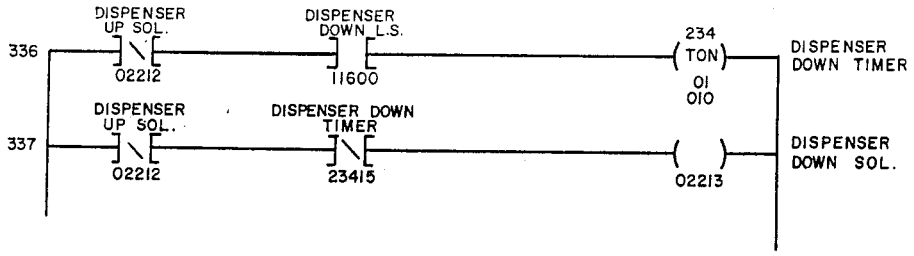

The GET function shown in data path 297 of FIG. 51 comprises the equivalent of a switch closure or logic one function which responds to the first increment of timer 230 as indicated by the 001 three digit data constant under the equal sign of the second logic symbol to the right of the left vertical line of FIG. 51. Similarly, logic path 298 is a GET function associated with timer 230 which responds to the third second count of the timer and logic path 299 is a GET function associated with timer 230 which responds to the five second output of the timer. Each such GET function produces a logic one only during the one second interval of the timer with which it is associated. Such one second interval corresponds to the data constant shown to the right of the GET symbol in the flow path. In this particular example comprising logic paths 297, 298 and 299, because these three paths are connected in parallel as an OR function, the conveyor warning storage output having the address 03101 at the output of data path 297 will be a series of one second pulses that occurs as timer 230 is timing out the six second period. A pulse will occur during the first second, the third second and the fifth second as a result of the GET functions of the paths 297, 298 and 299. As previously indicated, a GET function can be associated with either a timer or a counter and when it is associated with a counter instead of a timer, the logic one status is achieved at a particular count as opposed to a particular time interval.

The symbols of the logic diagrams of FIGS. 35 through 53 will now be understood by a person of ordinary skill in the relevant arts whereby use of the logic diagrams of FIGS. 35 through 53 in association with Tables I through XX will enable understanding of the detail logic operation of the present invention.

The following summary provides an overview of the operating sequence of the present invention. The first step in the sequence of operation of the present invention is a check on whether the system is properly loaded. More specifically, the operator places an empty pallet on the pallet infeed section and then loads the bag magazine with empty bags. The operator then checks to be certain that a sufficient amount of particulate material product is available above the filler. The operator then starts the packing center by first activating the conveyor start push-button. As a result, the bag takeaway, lift, bridge, turning and forming conveyors all start running.

The operator then activates a cycle start push-button. The empty pallet is transported onto the elevator section and the elevator lifts the pallet up to the maximum height just below the load plates. The bag transfer device brings a bag from the magazine to the presenter table and the bag spouter extends to pick up the bag from the presenter table, opening the valve on the return stroke. The bag is then spouted on the filler spout. The bag is then filled to the proper weight and ejected onto the bag takeaway conveyor. Dust is scavenged from the areea by an adjacent cross conveyor dust collection box. The filled bag moves to the flip transfer roll where it is tumbled 180 degrees and repositioned at 90 degrees onto the lift and compression conveyor with the valve end of the bag trailing. The bag is compressed as it enters the lift conveyor. Escaping dust is again scavenged by a dust collector. The bag is elevated and inverted ultimately exiting onto the bridge conveyor traveling in an opposite direction. The bag may be optionally check weighed and then conveyed onto the bag turner. The bag is then either turned or allowed to pass unturned in order to form the appropriate layer pattern.

When the proper number of bags for a half layer are in position, the half layer is pushed laterally onto the load plates. The second half layer is then appropriately formed by the turner and pushed onto the load plates as well. The full layer is laterally compressed by the pusher in one direction and by the squaring bar in the other direction. While the layer is being retained laterally, the load plates separate, depositing the layer onto the pallet. The pallet is lowered until the bags clear the load plates at which point the load plates close. The bag layer is then raised up underneath the load plates and compressed against the bottom of the plates for a predetermined period further flattening the layer and allowing any retained air to be vented from the bags. The pallet elevator continues to operate in this manner in association with the load plates until a preselected number of layers has been deposited on the pallet.

During the forming of the initial pallet the operator will have positioned a second pallet on the pallet infeed device. When a predetermined number of layers has been deposited on a pallet, the full pallet conveyor motor starts transporting the full pallet onto a full pallet roller and exiting the packing center. The pallet infeed conveyor then starts, allowing another empty pallet to enter the packing center. During pallet changeover, bags continue to form until the forming area is saturated. At that point the turner conveyor stops with one bag held in place. The bridge conveyor also stops when it holds one bag. The bag takeaway conveyor stops running when the turner conveyor stops running. The filler continues to fill the bag in position but will not release the bag being filled until the takeaway conveyor has resumed operation.

In the event of a mis-spouted bag the spouter boom may be for example rotated about its vertical support axis to reject the improperly spouted bag. When properly ejected, the spouter automatically continues. In an alternative embodiment, in the event of a mis-spouted bag, the bag is allowed to fall onto the takeaway conveyor which is reversed in direction thereby depositing the bag at a predetermined location to the side of the packing center. Upon reaching low bag levels, that is, when the supply of empty bags at the magazine begins to run out, an alarm signal will sound. An alarm signal will also sound in the event that there is a forming of a layer without an empty pallet in position. An alarm will also sound if a layer is being formed with a full pallet accummulation. The packing center is designed to stop in the event of low product supply, no bags, full pallets, no empty pallets available or excessive mis-spouting of bags onto the filler.

Those having skill in the relevant arts will now understand that what has been disclosed herein is a novel and advantageous valve bag packing center in the form of a single integrated machine structure. The center utilizes three ingredients, namely, particulate product, valve bags and pallets and automatically properly mixes these three ingredients to provide a filled pallet of accurately filled bags with a minimum of user installation, cost and floor space. The invention combines total system integration, engineering and unitary structure to minimize manpower, floor space, utility services and plant engineering to enable the user to maximize the efficiency of the operation. The invention properly controls the incoming particulate product and conditions the product as required to gain maximum packer performance. It properly dispenses and places the valve of valve bags onto a filler spout automatically taking precaution not to allow the filler to start if a bag is not properly placed on the filling spout. It properly fills the bag to the best attainable accuracy, settling product if necessary and transferring the filled bags from the filler in such a manner as to adequately close the bag valve. It properly flattens and shapes the bag to deaerate the bag and distribute the product in the bag for optimum palletizing. It turns the bags so that the valve is properly positioned to form a layer wherein the valve is in the most secure location relative to the bag layer geometry. It properly stacks the filled bags on a pallet in an interlocking pattern to enable the filled pallets to be transported and stored effectively.

The common machine structure of the present invention is designed to properly support and house all major elements of the invention in a rectangularly shaped volume capable of being loaded and transported by truck or rail without any substantial disassembly. The structure is designed to provide structural support of all major elements including product infeed hopper, bag placer, bag flattener, conveyors and palletizing functions including turning, pushing, layer forming and elevating. The integral structure greatly simplifies installation as only the common unitary structure need be properly positioned in the user's selected location. The proper relationship of all major components is built into the common structure and fixed at the time of manufacture thereby eliminating field installation and alignment problems.

Those having skill in the relevant art will now, as a result of the applicant's teaching herein, perceive various modifications and additions to the invention. By way of example, the particular layout of conveyors including the lift and flattening apparatus of the present invention as well as the specific geometric structural layout of the invention, may be provided in many other forms and embodiments other than those specifically disclosed herein. Accordingly, the scope of the invention shall be deemed to be limited only by the claims appended hereto.

I claim:

1. An automatic apparatus for filling valve bags of the type having an orifice, with a particulate material and for stacking filled valve bags in multiple bag layers on a pallet for transport or storage, the apparatus comprising:

means for accepting empty valve bags;

means including a spout for filling each valve bag with said particulate material;

first means for transferring each empty valve bag from said accepting means to said filling means;

means for flattening and re-orienting each filled valve bag;

second means for transferring each filled valve bag from said filling means to said flattening and re-orienting means;

means for forming a layer of a plurality of said filled valve bags;

third means for transferring said filled valve bags from said flattening and re-orienting means to said layer forming means; and means for sequentially depositing a plurality of said layers onto said pallet, said accepting means, said filling means, said flattening and re-orienting means, said first, second and third transferring means, said layer forming means and said depositing means being integral elements of a common unitary structure having maximum outside dimensions of about 12 feet in height, 12 feet in width and 25 feet in length;

said depositing means comprises a pair of selectively separable load plates for receiving each said array of filled bags, means for securing said array of filled bags suspended over an aperture formed upon separation of said load plates, an elevator for raising a pallet beneath said array and adjacent said aperture and means for releasing said array onto said pallet for receiving said array as one filled layer thereon;

means for closing said load plates after said array of filled bags is released onto said pallet;

means for continuously compressing said released array on said pallet against the closed load plates for forcing air out of said filled bags; and means connected to said load plates for maintaining said compressing, said maintaining means comprising a switch responsive to upward movement of said load plates caused by said compressing.

2. The automatic apparatus recited in claim 1 wherein said accepting means comprises a bag magazine having a plurality of horizontal shelves.

3. The automatic apparatus recited in claim 1 wherein said first transferring means comprises a bag registration apparatus for receiving each empty valve bag, a transfer carriage for removing an empty valve bag from said bag magazine and depositing said bag on said bag registration apparatus, and a gripping means for grasping said bag adjacent said orifice and placing said valve bag orifice on said spout.

4. The automatic apparatus recited in claim 1 wherein said flattening and re-orienting means comprises a bag lift of which at least a portion is of a substantial semi-circular configuration, said bag lift having an outer conveyor belt for receiving said filled bags and for applying compressive force to one side of each such filled bag and having an inner conveyor belt for applying compressive force to a second opposing side of each such filled bag.

5. The automatic apparatus recited in claim 1 wherein said layer forming means comprises a bag turning apparatus for selectively turning each filled bag about a vertical axis through a desired angle, and means for assembling a plurality of turned bags in a predefined contiguous two-dimensional geometrical array of filled bags.

6. The automatic apparatus recited in claim 1 wherein said elevator comprises rolling conveyor means for conveying empty pallets onto said elevator and for conveying filled pallets off of said elevator.

7. The automatic apparatus recited in claim 1 further comprising a unitary electrical control apparatus contained within said common unitary structure and adapted for concurrent control of said accepting means, said filling means, said flattening and re-orienting means, said first, second and third transferring means, said layer forming means and said depositing means.

8. The automatic apparatus recited in claim 1 wherein said common unitary structure is adapted for transport without any substantial disassembly.

9. The automatic apparatus recited in claim 1 wherein said unitary structure comprises a lower section and an upper section and wherein said flattening and re-orienting means further comprises means for lifting said valve bags from said lower section to said upper section.

10. The automatic apparatus recited in claim 9 wherein said depositing means further comprises means for lowering said valve bags from said upper section to said lower section.

* * * * *